US011622896B2

(12) United States Patent
Malakhov

(10) Patent No.: US 11,622,896 B2
(45) Date of Patent: Apr. 11, 2023

(54) SYSTEM, METHOD AND APPARATUS TO PREVENT AND TREAT A DISEASE BY OPTIMIZATION OF SLEEP POSTURE AND ASSISTED ROLLOVERS

(71) Applicant: Syncotrance, Inc., Las Vegas, CA (US)

(72) Inventor: Mikhail P. Malakhov, Las Vegas, NV (US)

(73) Assignee: SYNCOTRANCE, INC., Las Vegas, NV (US)

( * ) Notice: Subject to any disclaimer, the term of this patent is extended or adjusted under 35 U.S.C. 154(b) by 0 days.

(21) Appl. No.: 16/870,967

(22) Filed: May 9, 2020

(65) Prior Publication Data

US 2022/0008268 A1 Jan. 13, 2022

Related U.S. Application Data

(60) Provisional application No. 62/858,886, filed on Jun. 7, 2019, provisional application No. 62/845,659, filed on May 9, 2019.

(51) Int. Cl.

| | |
|---|---|
| ***A61G 7/00*** | (2006.01) |
| ***A61G 7/008*** | (2006.01) |
| ***A61G 7/07*** | (2006.01) |
| ***A61G 7/075*** | (2006.01) |

(52) U.S. Cl.

CPC ..... *A61G 7/001* (2013.01); *A61G 7/008* (2013.01); *A61G 7/07* (2013.01); *A61G 7/075* (2013.01); *A61G 2200/327* (2013.01)

(58) Field of Classification Search

CPC ..... A61G 7/00; A61G 7/001; A61G 7/008; A61G 7/0509; A61G 7/0525; A61G 7/0526; A61G 7/065; A61G 7/07; A61G 7/005; A61G 7/072; A61G 7/05; A61G 7/075; A61G 7/0755; A61G 2200/327; A61G 7/018; A47C 19/045; A47C 20/041; A47C 20/046; A47C 1/035; A47C 1/025; A61H 2001/0248; A61H 2203/0462; A61H 2203/0437; A61H 2203/0456; A61H 1/0244; Y10S 5/942; Y10S 5/937

See application file for complete search history.

(56) References Cited

U.S. PATENT DOCUMENTS 4,920,589 A * 5/1990 LaVelle ..... A61G 7/008 5/607

OTHER PUBLICATIONS

"Behind." Oxford—Lexico, Lexico, www.lexico.com/en/definition/behind.*

* cited by examiner

*Primary Examiner* — Peter M. Cuomo
*Assistant Examiner* — Madison Emanski
(74) *Attorney, Agent, or Firm* — Thibault Patent Group

(57) ABSTRACT

A body support system, method and apparatus is described, for preventing and treating a disease or injury by optimization of sleep posture and assisted rollovers. A body support device comprises two or more extendable, retractable support walls, for supporting various parts of a user as a cradle of the body support device is rotated into various positions.

16 Claims, 33 Drawing Sheets

SYSTEM, METHOD AND APPARATUS TO PREVENT AND TREAT A DISEASE BY OPTIMIZATION OF SLEEP POSTURE AND ASSISTED ROLLOVERS

CROSS-REFERENCE TO RELATED APPLICATIONS

This application claims the benefit of U.S. provisional patent application Ser. No. 62/845,659, filed on May 9, 2019 and U.S. provisional patent application Ser. No. 62/858,886, filed on Jun. 7, 2019.

BACKGROUND

I. Field of Use

The present application relates to the field of recuperative therapeutic devices and more specifically to a body support device for comfortably positioning a person during sleep.

II. Description of the Related Art

The most comfortable position for relaxation and ease of breathing is Fowler's-Supine with torso slightly elevated and legs slightly bent at the knees. Today this position is frequently referred to as "zero-gravity" and utilized in adjustable beds and recliners. At the same time, the research shows that an average person spends 54% of his or her total sleeping time on the side (Lateral Decubitus position), which is known to put stress on the shoulders, spine, and the rest of the musculoskeletal system. The importance of side sleeping is well recognized but until recently it was explained almost exclusively from the position of reduced risk of apnea, improved digestion or blood and lymph flow.

Recent scientific discoveries provide a more meaningful explanation for the tendency to sleep on one's side. A new organ in the brain that works in a way similar to body's lymphatic system and removes neurometabolic waste produced by the brain's activities was described in 2012 (Iliff et al, *A Paravascular Pathway Facilitates CSF Flow Through the Brain Parenchyma and the Clearance of Interstitial Solutes, Including Amyloid* β. Sci Transl Med. 2012 Aug. 15; 4(147): 147ra111). The new organ is called the glymphatic system ("g" is for glial cells of the brain). The glymphatic system was later shown to be active only during sleep (Xie et al, *Sleep Drives Metabolite Clearance from the Adult Brain*. Science. 2013 Oct. 18; 342(6156); 373-377). Most recent experimental data demonstrated that the glymphatic system is most efficient at removal of the metabolic waste during the sleep in the lateral decubitus position (Lee at al, *The Effect of Body Posture on Brain Glymphatic Transport*. J Neurosci. 2015 Aug. 5; 35(31):11034-44).

Another important consideration for sleep improvement is postural changes during sleep. The general public and even most practicing physicians (who don't specialize in sleep medicine) believe that people have a favorite sleeping position which is voluntarily maintained during the night and normal sleep is static, while tossing and turning is a sign of insomnia or a bad mattress. Tossing and turning (scientific terms are "nocturnal body movements", "rollovers", or "postural changes") have been well studied and it is well established that regular rollovers are a normal and necessary part of healthy sleep.

A large 2017 study (Skarpsno et al, *Sleep positions and nocturnal body movements based on free-living accelerometer recordings: association with demographics, lifestyle, and insomnia symptoms*. Nat Sci Sleep. 2017 Nov. 1; 9:267-275) demonstrated that on average, an adult rolls over completely from one side to the other about 13 times a night (1.6 rollovers per hour, or every 37 minutes (Skarpsno et al, *Sleep positions and nocturnal body movements based on free-living accelerometer recordings: association with demographics, lifestyle, and insomnia symptoms*. Nat Sci Sleep. 2017 Nov. 1; 9:267-275). An earlier publication similarly reported rollover frequencies of 4.4 to 2.1 rollovers per hour (every 14-29 minutes) (De Koninck et al, *Sleep positions and position shifts in five age groups: an ontogenetic picture*. Sleep. 1992 April; 15(2):143-9).

Rollovers are critical for release of pressure and blood flow through the compressed tissues. Immobile patients or those who are bed ridden for long time have to be rolled over every 2 hours to prevent formation of bed sores. Accumulation of fluid in the lungs and subsequent lung infections is another complication of static sleep. Prolonged pressure on intervertebral disks and other joints is also an important reason to engage in postural changes.

Skarpsno et al (2017) reported that time in the side position increased with age, accompanied by a proportional decrease in time in the back position. In the age-group 20-34 years, time spent on the side was 47.7%, whereas in the age group 55-65 years, time spent on the side was 58.3%. An earlier study on 65-75-year-old subjects showed that 77% of sleeping time was spent on a side (Lorrain et al, *Sleep positions and postural shifts in elderly persons*. Percept Mot Skills. 1986 October; 63(2 Pt 1):352-4). A continuous shift in preference toward the side position is also supported by a study that included age-groups from 3-5 years to 65-85 years (De Koninck et al, 1992). A study conducted on 600 women of different age demonstrated the same trend (Sahlin et al, *Sleep in women: Normal values for sleep stages and position and the effect of age, obesity, sleep apnea, smoking, alcohol and hypertension*. Sleep Med. 2009 October; 10(9): 1025-30).

It has been proposed that the preference for lateral position in older individuals may be due to loss of spine flexibility or decreased efficiency of respiratory or cardiovascular functions (De Koninck et al, 1992).

Fewer body movements during sleep may mimic the overall decrease in motor activity seen in old people during wakefulness (Renfrew et al, *Motor activity and sleep duration as a function of age in healthy men*. Physiol Behav. 1987; 41(6):627-34). Another possibility may be that the brain becomes with age less able to produce body movements during sleep (Giganti et al, *Body movements during night sleep and their relationship with sleep stages are further modified in very old subjects*. Brain Res Bull. 2008 Jan. 31; 75(1):66-9). Yet another possible explanation is that skin nociceptors, become less able to detect pressure (or ischemia) and produce signals that lead to postural changes.

The older individuals who already have back and shoulder problems are particularly vulnerable. It was suggested that it is not sleeping in the decubitus position per se that puts the patient at risk but postural immobility in the decubitus position. The groups that had high occurrence of shoulder pain (the elderly, those with neurodegenerative diseases or spinal cord injury, suffering from rheumatoid arthritis, patients that are given sedatives) are known to experience greater postural immobility during sleep (Zenian J, *Sleep position and shoulder pain*. Med Hypotheses. 2010 April; 74(4):639-43). The longer the person remains in the same decubitus position, the greater the amount of strain imposed on the shoulder by the weight of the upper body. Experimental studies have shown that the harmful effects of pressure (ischemia, and cellular damage and inflammation) increase the longer the body stays in the same position.

Optimization of sleep routine by (1) improved comfort and postural alignment in lateral decubitus position, (2) ease of transitioning between the positions, and (3) predetermined amount of time in specified positions can provide better sleep and brain recovery, and likely prevent and treat neurodegenerative diseases and cognitive decline.

A body support device has been described in U.S. Pat. No. 8,713,729, comprising a frame having side walls to support a user in a lateral decubitus position as the frame is rotated. The system described by U.S. Pat. No. 8,713,729 has side walls permanently fixed and lacking structure, which in some cases made the system less suitable for all-night, long-term use.

Specifically, each side wall was formed by a pair of supporting rods and fabric suspended between the supporting rods. The hammock-like structure of the suspended fabric does not have a shape of its own and under the weight of user's thorax will assume a concave (i.e., D-shaped) form. While perfectly acceptable for a user with minimal muscle definition and average adiposity in the thoracic area (pectoral muscle-armpit-latissimus dorsi) it may not be suitable for both athletic and skinny individuals, because it may squeeze the large muscles of chest and back (pectorals and latissimus dorsi) together (filling the void under armpit) and causing discomfort.

Moreover, the right side wall is only required when a user is in the right lateral decubitus position. Likewise, the left side wall is only required when a user is in the left lateral decubitus position. Stationary positioning of the side walls (and upper arm support extending therefrom) unnecessarily restricts movements in the supine position and reduces access to different body parts (i.e., can't reach the ear or chest for a trivial scratch). Furthermore, taking a deep breath may be difficult due to the requirement that the stationary side walls fit snuggly so that the user's torso does not sag when in a lateral decubitus position.

Further still, when a user of the prior art body supporting device is in the left lateral decubitus position, the user's right arm is above the body. The left side wall performs the function of supporting the user while the right side wall in this position at that moment performs no useful function. Due to the stationary nature, the right side wall remains between the user's body and upper arm. The inner side of the user's upper arm resides on the side wall. Even though the side wall is relatively thin and soft (about 2 cm when not compressed) it is a foreign object pressing against a sensitive inner area of the arm just a few centimeters below the armpit. The inner side of upper arm contains brachial plexus nerves (musculocutaneous, radial, median, axillary, ulnar) and blood vessels running from the body down the arm. These nerves and blood vessels reside in the thin layer of tissues between the skin and bone and are protected only by a thin layer of adipose and muscle tissue, making the upper arm's inner surface sensitive and irritable. Extended pressure on upper arm's inner side may cause discomfort, numbing, tingling feeling in the fingers, etc. While the stationary side walls described in prior art are acceptable for users with significant adiposity, thin users run a risk of pressure and irritation on the nerves of the inner upper arm.

It would be desirable to alleviate the problems caused by the stationary sidewalls in a device that allows a sleeper to maintain proper spinal alignment, distribute body weight evenly, and eliminate shoulder pain and discomfort from sleeping on one's side.

SUMMARY

A body support system, method and apparatus is described, for preventing and treating a disease or injury by optimization of sleep posture and assisted rollovers. In one embodiment, a body support device is described, comprising a back rest comprising left and right vertical openings spaced apart from each other by approximately a width of a human torso, an electric motor for rotating the body support device around a longitudinal axis of the body support device and holding the body support device in a plurality of angles from a horizontal reference position, a right torso-support assembly, located behind the back rest and aligned with the right vertical opening, the right torso-support assembly comprising a right torso support wall for supporting a right side of the human torso when the body support device is rotated to a first angle with respect to the horizontal reference position, and a left torso-support assembly, located behind the back rest and aligned with the left vertical opening, the left torso-support assembly comprising a left torso support wall for supporting a left side of the human torso when the body support device is rotated to a second angle with respect to the horizontal reference position.

BRIEF DESCRIPTION OF THE DRAWINGS

The features, advantages, and objects of the present invention will become more apparent from the detailed description as set forth below, when taken in conjunction with the drawings in which like referenced characters identify correspondingly throughout, and wherein.

DETAILED DESCRIPTION

The ideas presented herein relate to various embodiments of a body support device used to promote therapeutic sleep.

Figure 1:
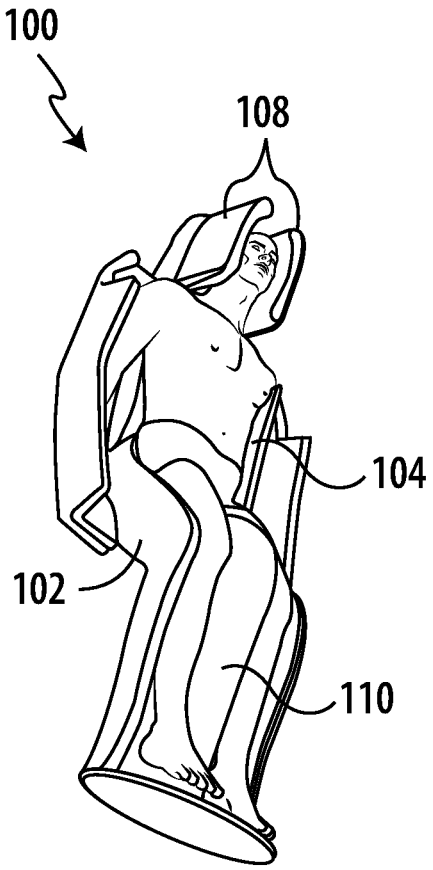
FIG. 1 is a three-quarter, perspective view of one embodiment of a body support device.
Figure 2:
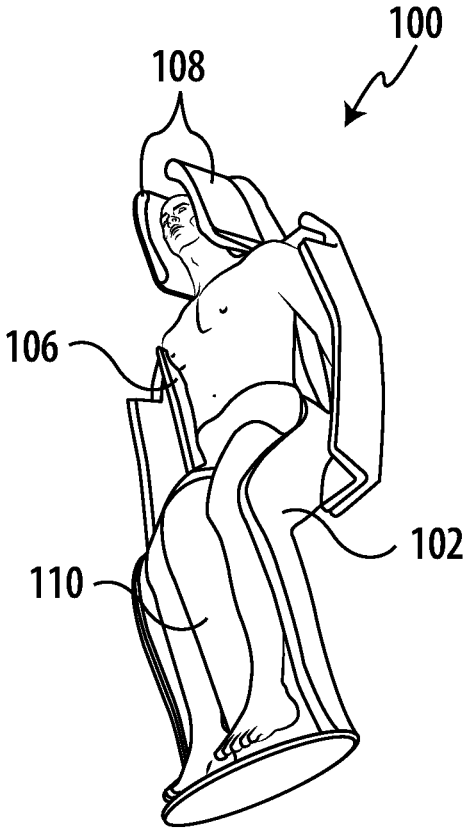
FIG. 2 shows a cradle of the body support device as shown in FIG. 1, rotated to a user's right by about 60 degrees from a horizontal reference position.

FIG. 1 is a three-quarter, perspective view of one embodiment of a body support device 100, comprising a cradle 102 that supports a user's body while asleep, resting or undergoing therapy. Cradle 102 is rotatable along an axis running longitudinally through the device, extending from the "head" portion to the "feet" portion of the device, thus allowing the user to be rotated generally between +/−about 95 degrees from a horizontal reference position, i.e., from a "flat" position where the user is placed in a supine position or zero degrees rotation from a flat, horizontal position. The horizontal reference position may also refer to a "zero-gravity" position, best shown in FIG. 5. Cradle 102 is rotated using an electric motor and control unit (not shown) that causes cradle 102 to rotate into various angles, as will be described later herein. FIG. 1 illustrates cradle 102 rotated to the user's left by about 60 degrees from the horizontal reference position, while FIG. 2 shows cradle 102 rotated to the user's right by about 60 degrees from the horizontal reference position.

As cradle 102 is rotated from the horizontal reference position, i.e., at about 5-15 degrees from the horizontal reference position, towards the user's left, a left torso support wall 104 is deployed/extended from behind cradle 102, through a left vertical slip (not shown) that is formed through the cradle in an area between the user's torso and the user's left arm. Left torso support wall 104 supports the user's torso as cradle 102 is rotated into a left position, as shown in FIG. 1. In one embodiment, the control unit determines when cradle 102 is at an angle of about 5 and 15 degrees with respect to the horizontal reference position and causes the left torso support assembly to deploy the left torso support through the left vertical opening. In another embodiment, the control unit causes the left torso support assembly to deploy the left torso support through the left vertical opening just before the control unit begins rotating cradle 102, i.e., while cradle 102 is in a supine position. The left torso-support assembly is mounted behind cradle 102, in an area behind the user's left torso. Similarly, a right torso support mechanism is mounted in an area behind the user's right torso, and a right torso support wall 106 is deployed through a right vertical opening when the control unit determines that cradle 102 is being rotated toward the right and the angle from the horizontal reference position is about between 5 and 15 degrees. The right vertical opening is formed through the cradle in an area between the user's torso and the user's right arm.

Generally, only one of the torso support walls is deployed at any given time, although when cradle 102 is within about 15 degrees of the horizontal reference position, neither side wall is deployed.

Cradle 102 also comprises two head supports 108 extending from a head support area of cradle 102, spaced apart approximately the width of an average human head. Leg support 110 extends from a lower portion of cradle 102, supporting each leg as cradle 102 is rotated, with the user's left leg resting on leg support 110 when cradle 102 is rotated towards the user's right, and with the user's right leg resting on leg support 110 when cradle 102 is rotated towards the user's left.

Figure 3:
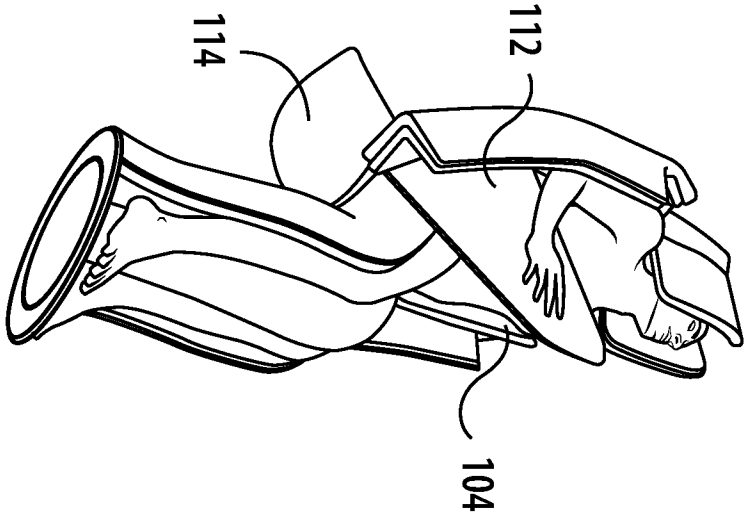
FIG. 3 is a perspective view of another embodiment of a body support device rotated into a left position and utilizing a right arm support.
Figure 4:
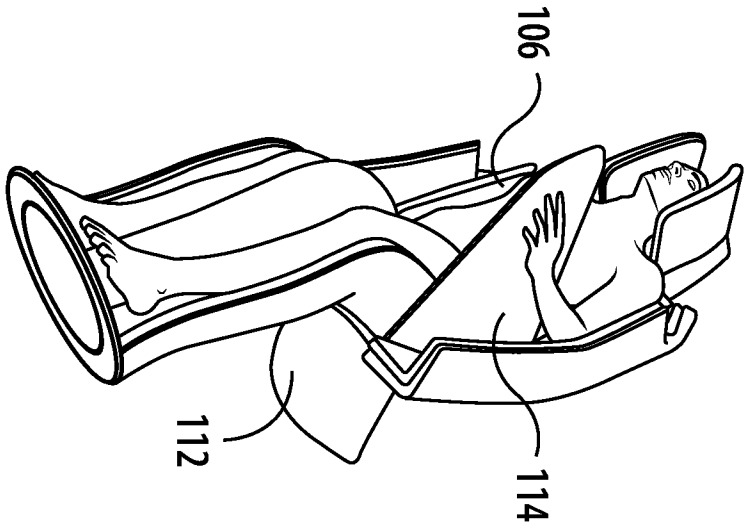
FIG. 4 is a perspective view of the body support device shown in FIG. 3, rotated into a right position and utilizing a left arm support.

FIGS. 3 and 4 are perspective views of another embodiment of the body support device shown in FIGS. 1 and 2. In this embodiment, left arm support 114 and right arm support 112 are used to support the user's arm when cradle 102 is rotated from the horizontal reference position. As shown in FIG. 3, as a user begins to rotate to the user's left from the horizontal reference position, left side wall 104 is deployed/extended to support the user's left torso, as before. However, in addition, right arm support 112 is deployed/extended either through the same left vertical opening where right torso support wall 106 extends, or through a separate opening proximate to the left vertical opening between the user's right arm and torso. Similar to the torso support walls as described above, left arm support 114 is retracted behind cradle 102, as shown, as right arm support 112 is deployed (or at some point during rotation to the user's left). Similarly, as shown in FIG. 4, as cradle 102 is rotated to the user's right from the horizontal reference position, right side wall 106 is deployed/extended from the vertical opening as before, and also left arm support 114 is deployed/extended through either the same left vertical opening where left torso support wall 104 extends, or through a separate opening proximate to the vertical opening between the user's left arm and torso. Right arm support 112 is retracted as left arm support 104 is deployed (or at some point during rotation of cradle 102 to the user's right). By extending the arm supports as described, the user's arm opposing the direction of rotation is comfortably supported by an arm support above the user's body, while the arm in the direction of rotation is in direct contact with the user's body, thereby improving the user's comfort and preventing nerve irritation.

The side walls may comprise rigid or semi-rigid material, such as fiberglass, carbon fiber, plastic, polyurethane, or some other material strong enough to support the user's torso when cradle 102 is rotated, 0-100 degrees from the horizontal reference position. In some embodiments, the side walls may be customized to a particular user by casting a mold, by electronic scanning, or some other known method, of the user's torso and forming the side walls from the mold. Customization helps fill a void between the user's pectoralis and latissimus dorsi muscles when a side wall is deployed. In some embodiments, the side walls may comprise two rods with fabric stretched therebetween, or a combination of a rigid portion with fabric or some other soft material in other portions to accommodate for certain conditions and body types, or to facilitate deployment and retraction. The arm supports, if used, allow a user's arm to be in very close proximity with the body (or in some embodiments in direct contact) during rotation of cradle 102, yet remain comfortably supported, especially when the user's elbow is bent as shown in FIGS. 3 and 4, to prevent overstretching of a user's infraspinatus muscles. Arm supports 112 and 114 described here ensure that infraspinatus and other upper back muscles are not overstretched by the upper arm pulled down by the gravity and the sensitive nerves (brachial plexus) and blood vessels of the upper arm are not in contact with any object which may cause pressure and nerve irritation.

Each of the arm supports is part of an electro-mechanical arm support assembly located behind cradle 102 in proximity to the torso support assemblies described with respect to FIGS. 1 and 2. Each of the arm support assemblies comprises one or more electric motors, gears, a rack and pinion or other suitable mechanical device(s), that cause each arm support to extend and retract through respective vertical openings formed through cradle 102, spaced apart from each other about the width of a typical human torso.

Figure 5:
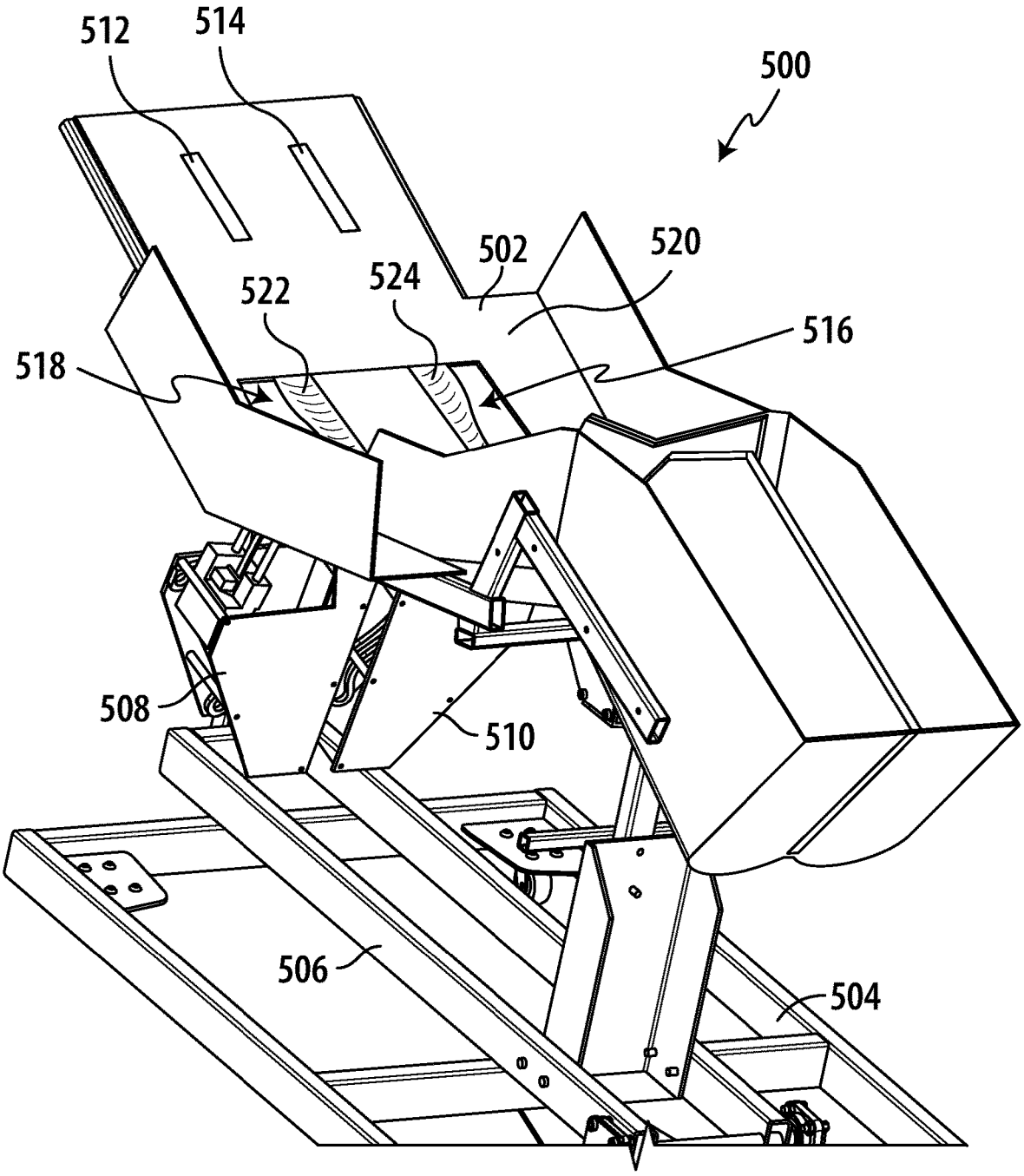
FIG. 5 is a perspective view of another embodiment of a body support device.

FIG. 5 is another embodiment of a body support device, in this embodiment, body support device 500, comprising cradle 502, base frame 504, tilt support member 506, left torso-support assembly 508 and left torso-support assembly 510. This embodiment does not utilize arm supports. Cradle 502 is shown in the horizontal reference position, i.e., not rotated to the left or the right and placing a user in cradle 502 in a supine (face up) position.

Figure 7:
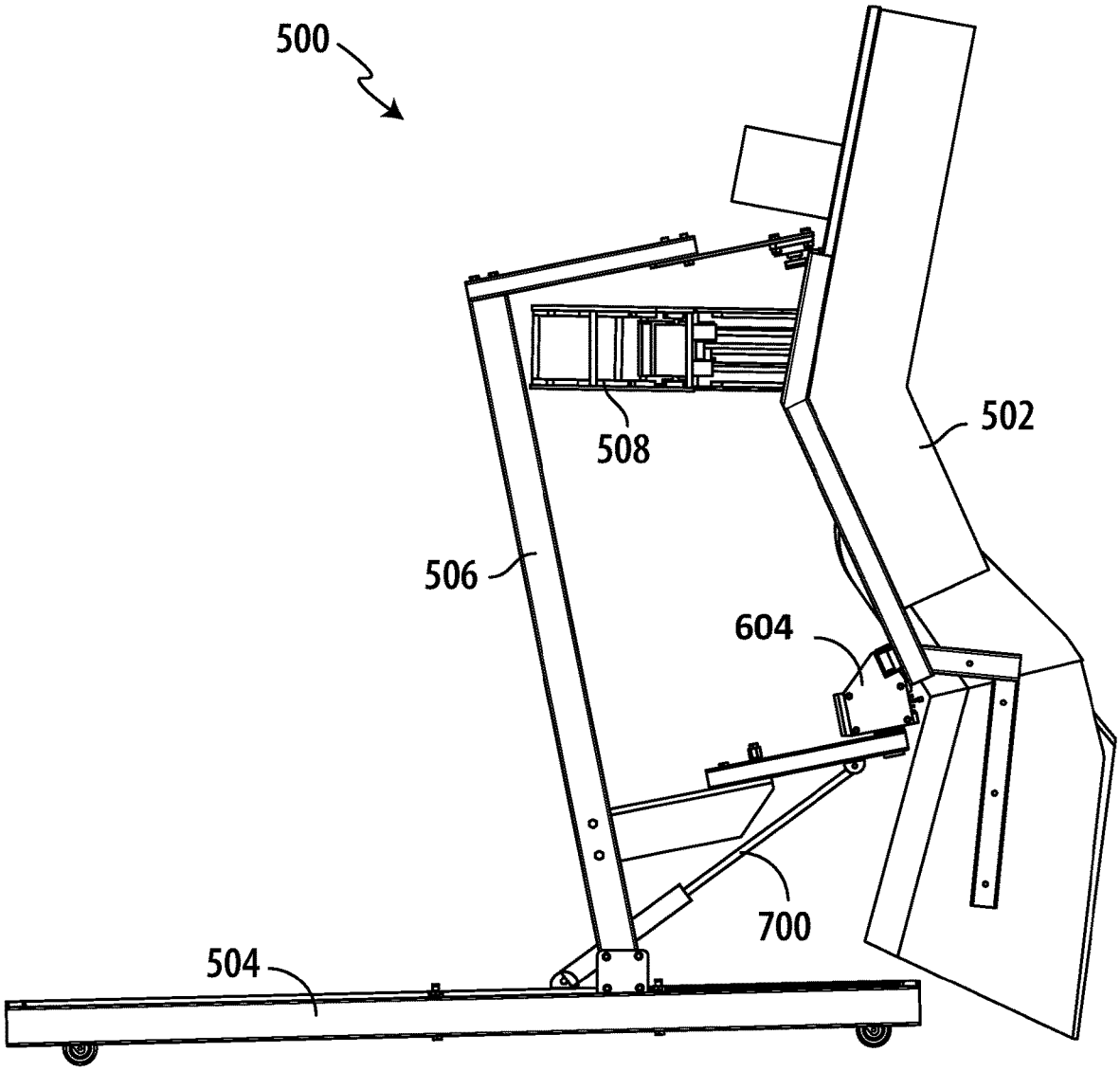
FIG. 7 is a side view of the body support device as shown in FIGS. 5 and 6, positioned almost upright for allowing a user to get in and out of the body support device.

During operation, while a user is laying in cradle 102, with the user's back against back rest 520, cradle 102 is rotated along an imaginary axis running along the length of cradle 102, to the user's right and left. It may also be positioned vertically in order for a user to easily move in and out of cradle 102. For example, FIG. 5 shows cradle 102 in a supine position, and FIG. 7, shows cradle 102 positioned upright in order to easily allow the user to get in and out of cradle 102. Actuator 700 is responsible for pivoting cradle 502 from the supine position to the upright position. In one embodiment, actuator 700 comprises a linear actuator controlled by control unit (not shown) that is part of body support device 500. In other embodiments, any other well-known electro-mechanical device could be used to position cradle 500 into the positions shown in FIGS. 5 and 7. The term "actuator" means a linear actuator, a gear/motor combination, linear motor, rack and pinion, or any other mechanical or electro-mechanical device well-known in the art to move the cradle. Actuator 700 can move cradle 502 anywhere between a supine position to an upright position to angle the cradle to raise a user's head above the user's feet or vice versa while cradle is in supine or any rotated position.

Right torso-support assembly 508 is shown mechanically coupled to the frame that also supports the cradle 502 in an area behind opening 518 near where a user's left torso would lie in cradle 102, extending perpendicularly thereto, while left torso-support assembly 510 is also shown mechanically coupled to the frame that supports the cradle 502 in an area behind opening 516 near where a user's right torso would lie in cradle 102, extending perpendicularly thereto. Each of the torso-support assemblies comprises a motor, a linkage and a torso support wall. The torso support wall of each assembly is extended/retracted through cradle 102 as the motor drives the linkage. Each torso-support assembly moves its respective side wall in a complex manner that causes each side wall to move around the user's torso while being deployed or extracted, as will be explained in greater detail later herein. Opening 518 is sized and shaped to allow a right torso support wall to extend and retract in a complex motion where the right torso support wall moves both horizontally (with respect to a user's torso) and also in and out from the surface of cradle 500. The same applies to opening 516. Each of the openings may be partially filled with a custom back support (described later herein), leaving enough space for each respective wall to retract and extend in a complex way.

Proximate to each of the openings is a respective back support, fixed to cradle 500, referenced as right back support 522 and left back support 524. Each of the back supports may be customized to match a portion of a user's back, for providing maximum comfort to a user.

Also shown in FIG. 5 is right head support opening 512 and left head support opening 514, spaced apart by approximately a width of a human head. Each opening allows a respective head support wall to extend/retract through a front surface of cradle 502, for supporting a user's head when cradle 502 has been rotated to the left and for supporting a user's head when cradle 502 has been rotated to the right.

Figure 6:
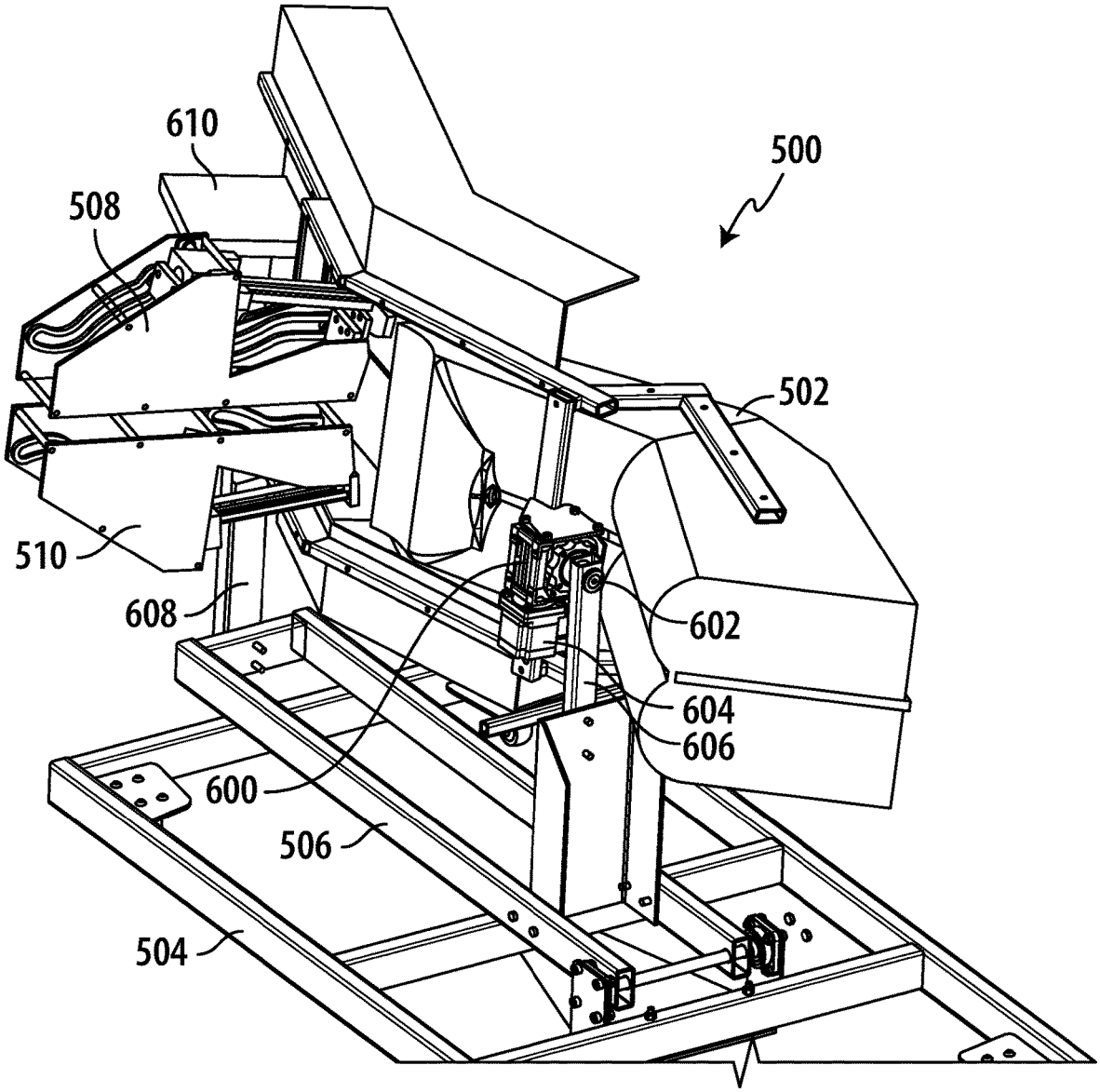
FIG. 6 is a perspective view of the body support device as shown in FIG. 5, rotated into a full left orientation.

FIG. 6 is a perspective view of the body support device 500 shown in FIG. 5, with cradle 502 rotated to the left by approximately 95 degrees. This view illustrates electric motor 604 coupled to gear box 600 coupled to pivot point 602, which causes rotation of cradle 502 in accordance with signals from control unit (not shown). Pivot point 602 is rotatably coupled to vertical support member 606. A similar pivot point rotatably supports and connects cradle 502 to vertical support member 608. Also shown is a simplified view of a right head support wall 610, in a retracted state, for supporting a right side of a user's head while cradle 502 is in a right-rotated position, which will be explained in further detail later herein (not shown is a deployed left head support wall for supporting a left side of a user's head while cradle 502 is in a left-rotated position).

Figure 8:
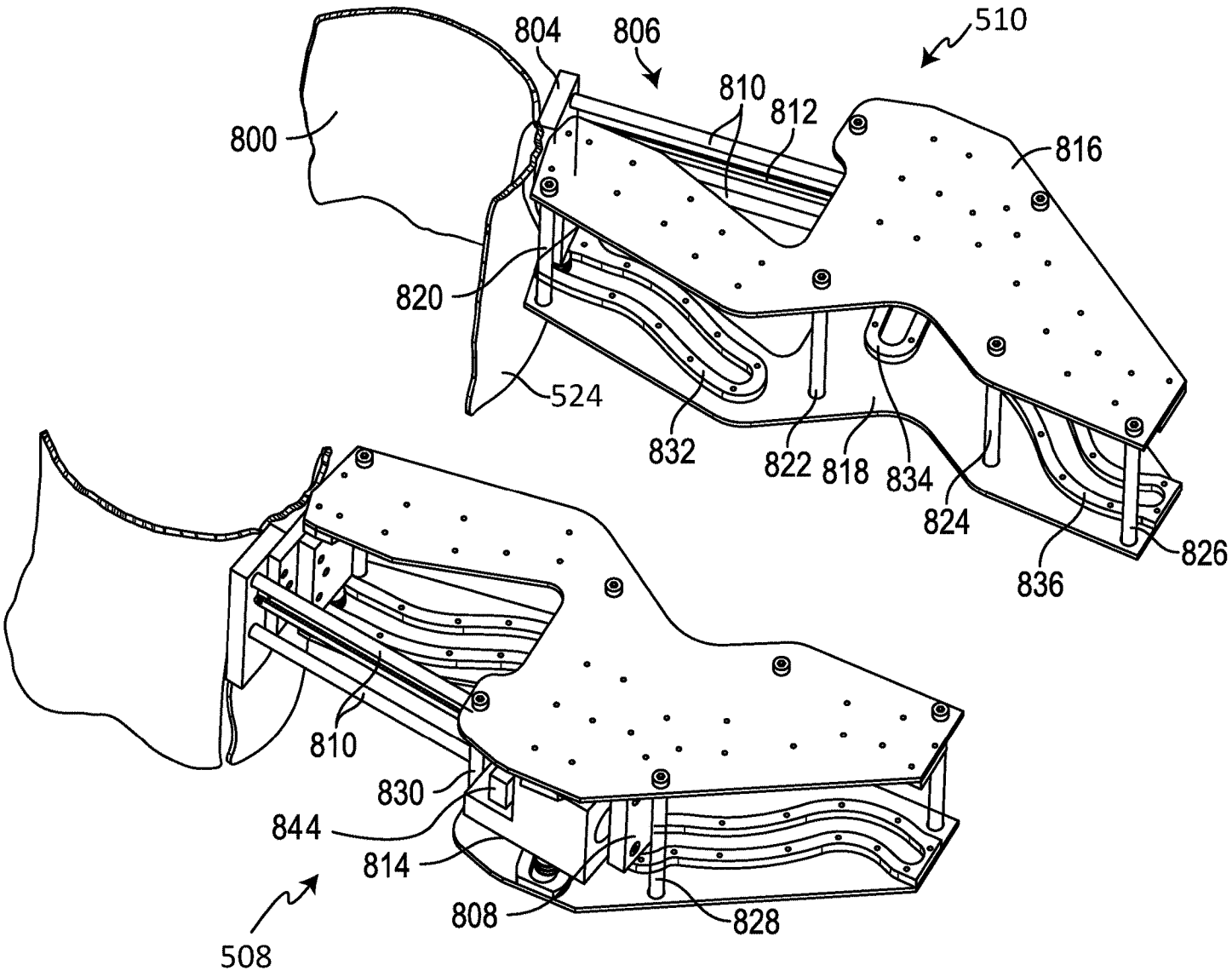
FIG. 8 is a perspective view of a right torso-support assembly and left torso-support assembly as shown in FIGS. 5-7 as they would appear when coupled to the back of a cradle as shown in FIGS. 5-7.

FIG. 8 is a perspective view of left torso-support assembly 508 and right torso-support assembly 510 as they would appear when coupled to the back side of cradle 502 from a rear, bottom, right vantage point. Left torso-support assembly 508 and right torso-support assembly 510 are mirror images of each other, i.e., each assembly comprises the same parts as the other. Therefore, only a discussion of left torso-support assembly 510 is provided, equally applicable to right torso-support assembly 508. Further, some components are additionally or alternatively shown in right torso-support assembly 510 for purposes of clarity. It should be understood that the same or similar components shown in FIG. 8 to form left torso-support assembly 510 could be used to form one or more head support assemblies, for extending/retracting head support walls, one or more leg support assemblies, for extending/retracting leg support walls, or some other support assemblies and associated walls.

Each torso-support assembly comprises two, parallel plates 816 and 818, in this embodiment spaced apart about 16 cm from each other, coupled together by six standoffs 820, 822, 824, 826, 828 and 830. Each of the plates comprise three guide grooves 832, 834 and 836, with matching guide grooves not shown on plate 816, due to the viewing angle of FIG. 8. A linkage 806 is held by the guide grooves by rollers in three places, at a top end cap 804 (held by guide groove 832), a bottom end cap 808 (held by guide groove 836, a carriage 814 (held by guide groove 834) and an electric motor 844 embedded in, or coupled to, carriage 814. The guide grooves cause linkage 806 (and the torso support 800 attached via end cap 804) to move in a complex manner that causes the torso support wall to move around the user's torso while being deployed or retracted.

Left torso-support assembly 508 is shown fully extended, i.e., with left torso support wall 800 aligned with back support 524 such that the two form a continuous back and side support for a user's right torso when cradle 502 is rotated into a right angle with respect to the horizontal reference position. In this position, left torso support wall 800 is extended through a left vertical opening formed in cradle 502 in proximity to an area between the user's left torso and the user's left arm while positioned in cradle 502. Each of left torso support wall 800 and back support 524 is shown as curved pieces formed from a mold of a typical user's torso or a mold from a particular user's torso.

Left torso support wall 800 is mechanically coupled to top end cap 804, which forms part of linkage 806. Linkage 806 comprises top end cap 804 and bottom end cap 808, joined together by two connecting rods 810. The connecting rods are slidably coupled to electric motor 844 via two through holes formed through a carriage 814 (with linear ball bearings). The rods are generally made from a strong, rigid material, such as metal, e.g. forged steel, as the rods support the weight of a user when cradle 501 is rotated. Linkage 806 further comprises rack 812, which comprises an elongated, toothed member that is also coupled to top end cap 804 and bottom end cap 808. Rack 812 engages with a pinion gear of an electric motor 844, which causes linkage 806 to extend and retract as dictated by the guide grooves when electric motor 844 is energized in forward and reverse directions, respectively.

Figure 9:
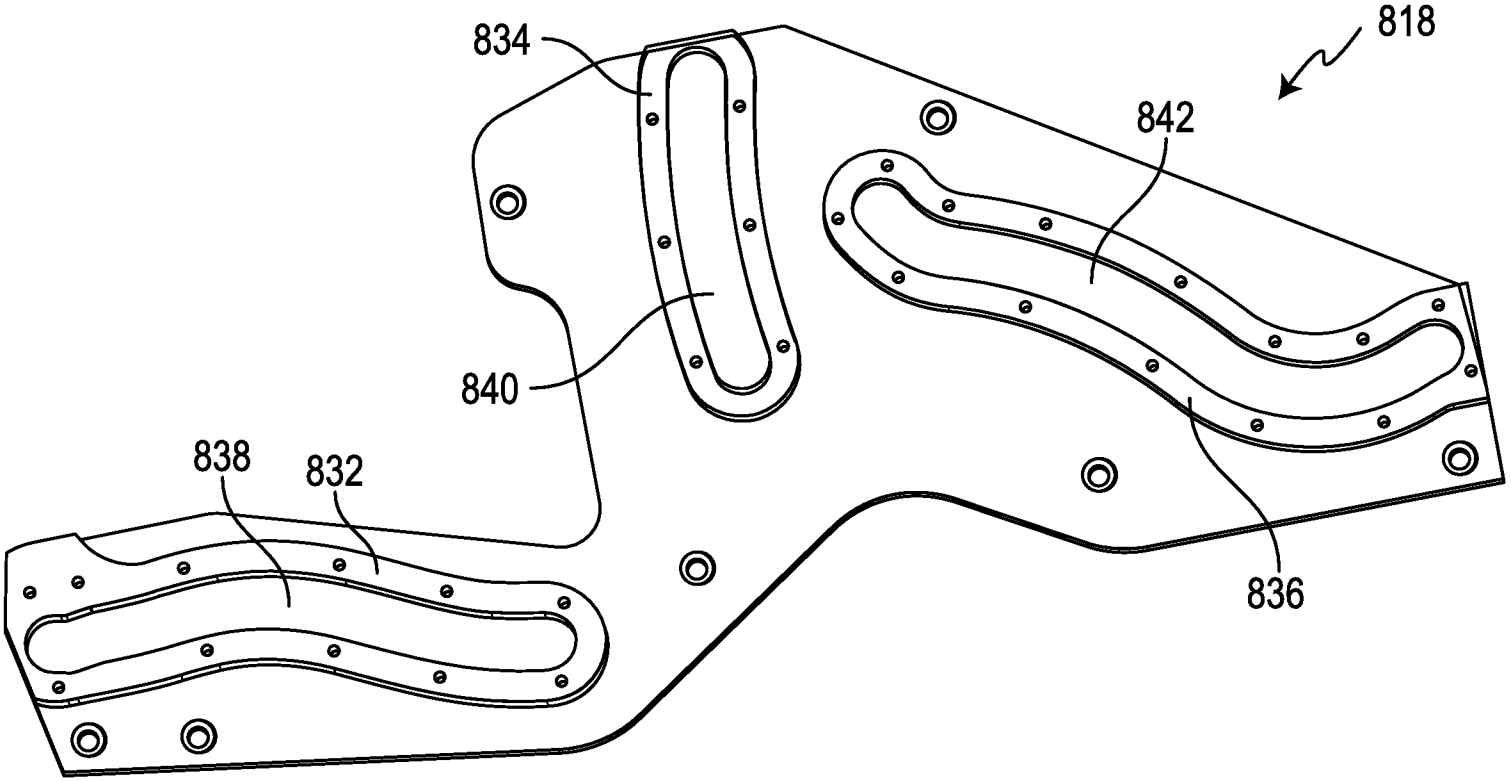
FIG. 9 is a top, plan view of a plate as part of the right and left torso-support assemblies as shown in FIGS. 5-8.

FIG. 9 is a top, plan view of plate 818, showing the shapes and relationships among guide grooves 832, 834 and 836. Each of the guide grooves comprises an uninterrupted wall approximately 10 mm thick and 10 mm tall. The walls define areas 838, 840 and 842, which are sized to accommodate rollers attached to top end 804, carriage 814 and bottom end 808, respectively. As electric motor 844 is energized, its pinion gear acts on rack 812, causing the carriage with electric motor 844 to move generally horizontally within area 840, while top end 804 and bottom end 808 each moves generally vertically, guided by guide groove 832 and 836, respectively. This causes the complex movement of the torso support wall, i.e., the torso support wall moving around the user's torso while being deployed or retracted.

Figure 10:
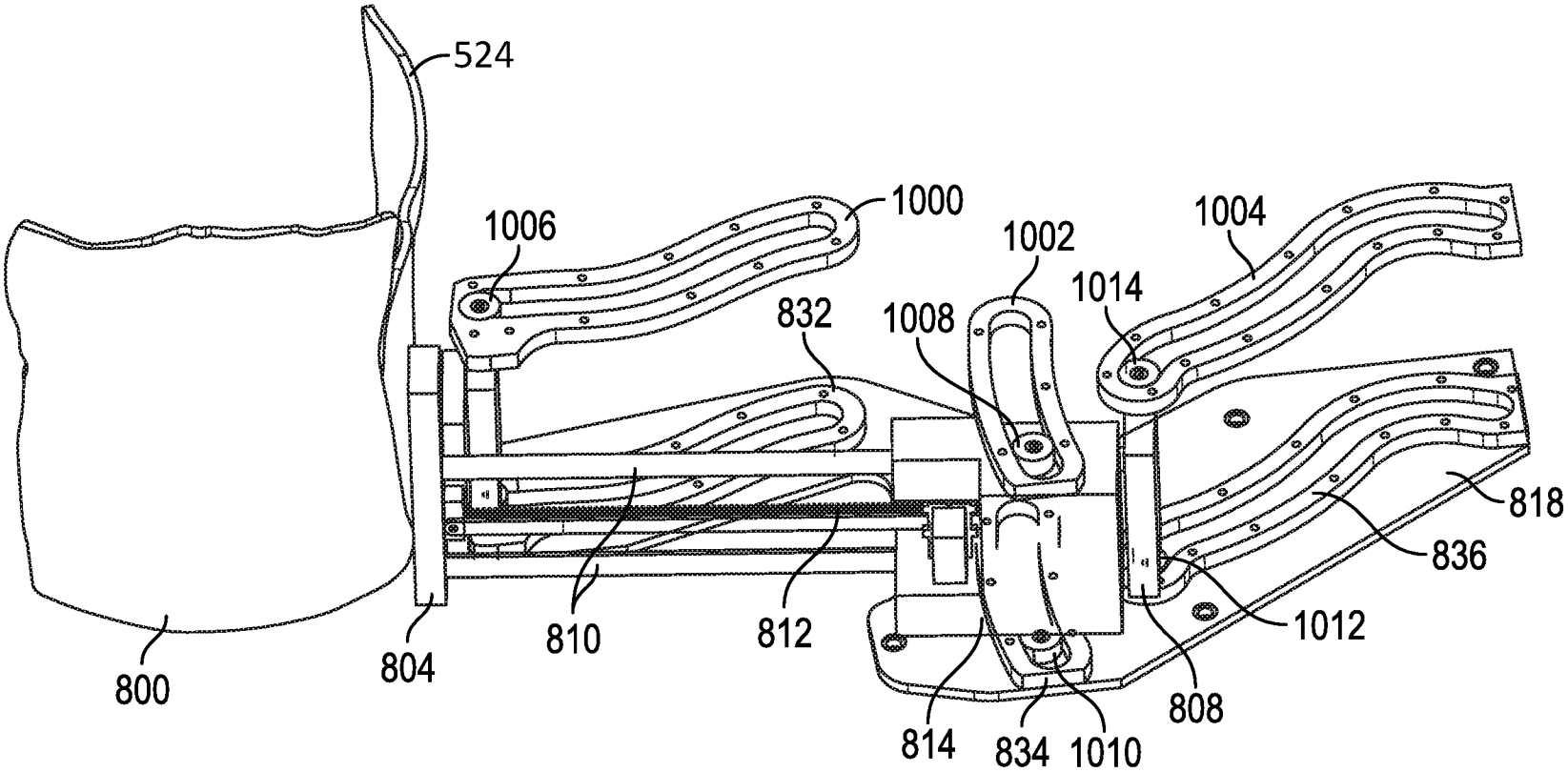
FIG. 10 is a perspective, cutaway view of the left torso-support assembly as shown in FIGS. 5-8, with a left torso support wall of the assembly fully extended.

FIG. 10 is a perspective, cutaway view of left torso-support assembly 510, shown in a horizontal position, with left torso support wall 800 fully extended. Plate 816 is not shown in this figure, however reciprocal guide grooves 1000, 1002 and 1004, normally located on plate 816 and corresponding to guide grooves 832, 834 and 836, respectively, are shown in position where they would normally be, in order to visualize how the guide grooves work in pairs to guide left torso support wall 800 as it moves from the fully-extended position, as shown, to a fully-retracted position, and vice-versa.

In the position shown in FIG. 10, a pinion gear of electric motor 844 has acted on rack 812, causing rack 812 to move connecting rods 810 through the carriage 814, and thereby left torso support wall 800, into a fully-extended position. Top end cap 804 comprises a pair of rollers, one of which is visible in FIG. 10 as roller 1006. The rollers move within guide grooves 832 and 1000, respectively, as electric motor 844 acts on rack 812 which, in turn, causes movement of top end cap 804 and left torso support wall 800 in both lateral and vertical directions. Similarly, the carriage 814 comprises a pair of rollers 1008 and 1010, which guide carriage 814 and electric motor 844 primarily in a lateral direction, substantially perpendicularly to the motion of left torso support wall 800, via guide grooves 834 and 1002, respectively. The rollers 1008 and 1010 and guide grooves 834 and 1002 hold the carriage in its position relative to the vertically moving linkage as well as provide a moving (laterally) pivot point and also allows to change the linkage angle (as the rollers on top and bottom end caps follow their respective grooves) and, consequently, the angle at which torso support wall retracts/deploys and contacts the torso.

Finally, again referring to FIG. 10, bottom end cap 808 is shown, comprising rollers 1012 and 1014 that cause bottom end cap 808 to move within guide grooves 836 and 1004, respectively, as electric motor 844 acts on rack 812 which, in turn, causes movement of bottom end cap 808 in both a lateral and a vertical direction.

Figure 11:
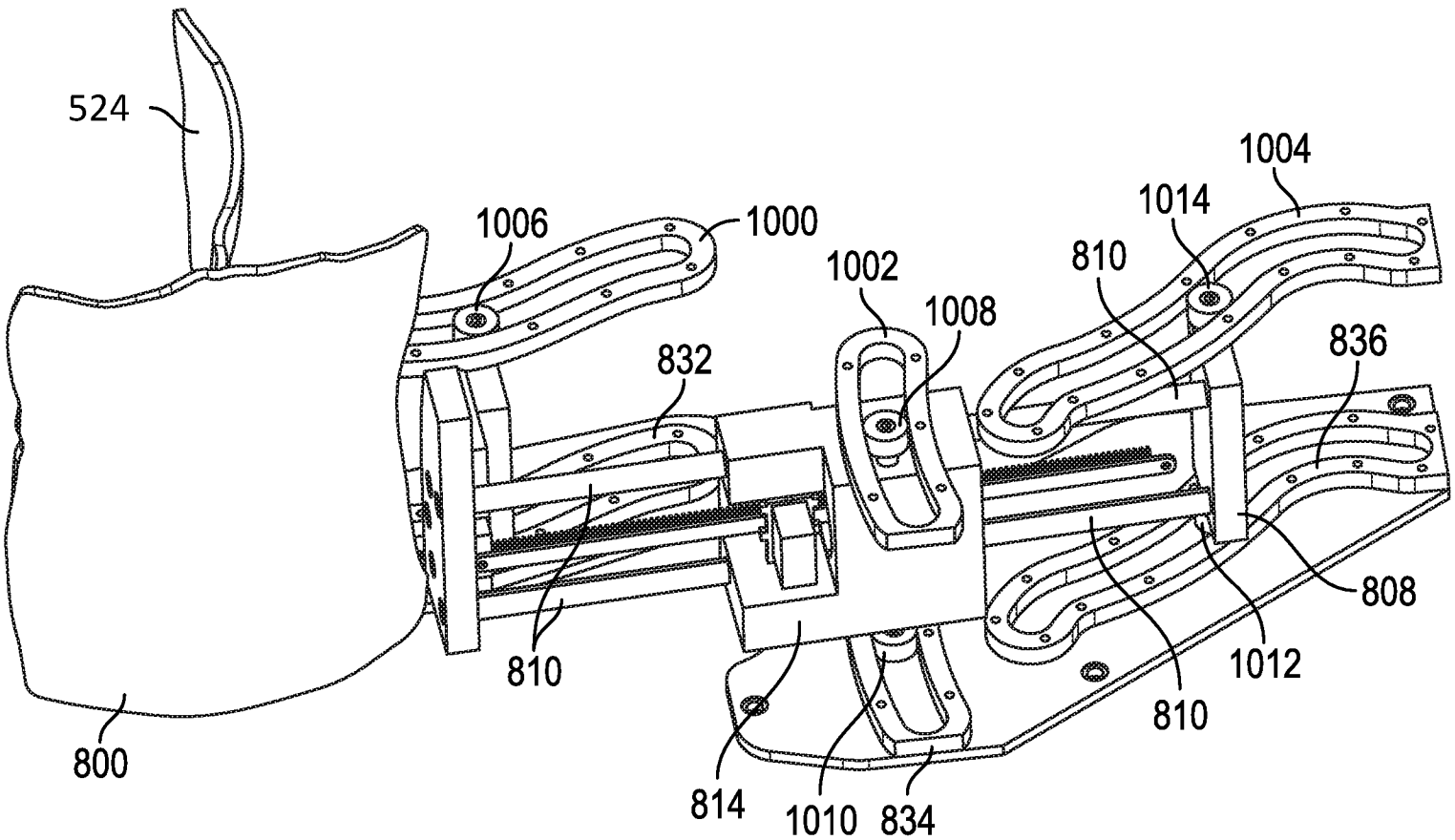
FIG. 11 is a perspective, cutaway view of the left torso-support assembly as shown in FIGS. 5-8 and 11, with the left torso support wall of the assembly about half-way extended.

FIG. 11 is a perspective, cutaway view of left torso-support assembly 510 with left torso support wall 800 about half-way extended/retracted. Plate 816 is again not shown in order to visualize guide grooves 1000, 1002 and 1004 and how they influence the movement of left torso support wall 800. In the position shown in FIG. 11, the pinion gear of electric motor 844 has acted on rack 812, causing rack 812 to move connecting rods 810 about half-way through carriage 814, and thereby left torso support wall 800, in a vertical direction towards carriage 814 into the position as shown. Rack 812 and connecting rods 810 are shown as having moved about half their length past carriage 814. Top end cap 804 has moved along a contour defined by the shape of guide groove 832 and 1000 via rollers 1006 and another roller not shown in this view. Carriage 814 is shown as having moved primarily laterally within guide grooves 834 and 1002 to about a mid-point of guide grooves 834 and 1002 via rollers 1008 and 1010. In the position shown in FIG. 11, left torso support wall 800 is positioned a maxim distance away from back support 524 when carriage 814 is positioned as shown at a mid-point inside guide grooves 834 and 1002. Allowing carriage 814 to slide horizontally within guide grooves 834 and 1002 creates a sliding pivot point for the right torso support wall 800 to extend around a human torso of a user laying in the cradle, via the connecting rods.

Bottom end cap 808 is shown also as having been moved along a contour of guide grooves 836 and 1004 about mid-way, via rollers 1012 and 1014, as electric motor 844 acts on rack 812 which, in turn, causes movement of bottom end cap 808 in both a lateral and a vertical direction.

Figure 12:
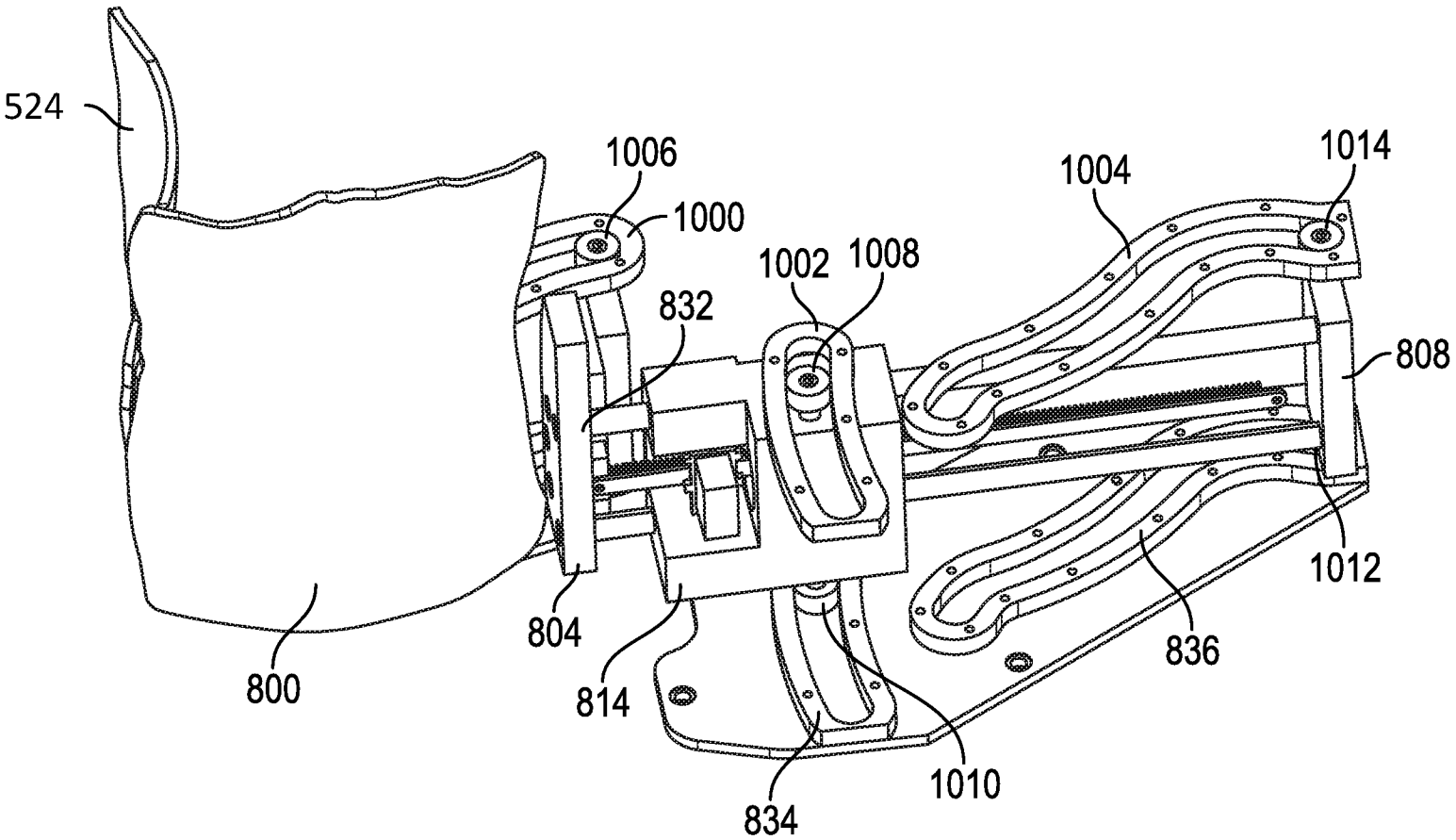
FIG. 12 is a perspective, cutaway view of the left torso-support assembly as shown in FIGS. 5-8 and 11, with the left torso support wall of the assembly fully retracted.

FIG. 12 is a perspective, cutaway view of left torso-support assembly 510 with left torso support wall 800 fully retracted. Plate 816 is again not shown in order to visualize guide grooves 1000, 1002 and 1004 and how they influence the movement of left torso support wall 800. In the position shown in FIG. 12, the pinion gear of electric motor 844 has acted on rack 812, causing rack 812 to move connecting rods 810 fully through carriage 814, and causing left torso support wall 800 to move primarily in a vertical direction towards carriage 814 into the position as shown. Rack 812 and connecting rods 810 are shown as having moved entirely past carriage 814. Top end cap 804 has moved fully along the contour defined by the shape of guide groove 832 and 1000 via rollers 1006 and another roller not shown in this view. Carriage 814 is shown as having moved primarily laterally within guide grooves 834 and 1002 to the opposing end of guide grooves 834 and 1002 via rollers 1008 and 1010. In the position shown in FIG. 12, left torso support wall 800 is retracted fully through opening 516 when carriage 814 is positioned as shown at the opposing end position inside guide grooves 834 and 1002. Bottom end cap 808 is shown also as having been moved fully along the contour of guide grooves 836 and 1004, via rollers 1012 and 1014, as carriage 814 acts on rack 812 which, in turn, causes movement of bottom end cap 808 in both a lateral and a vertical direction.

Figure 13A:
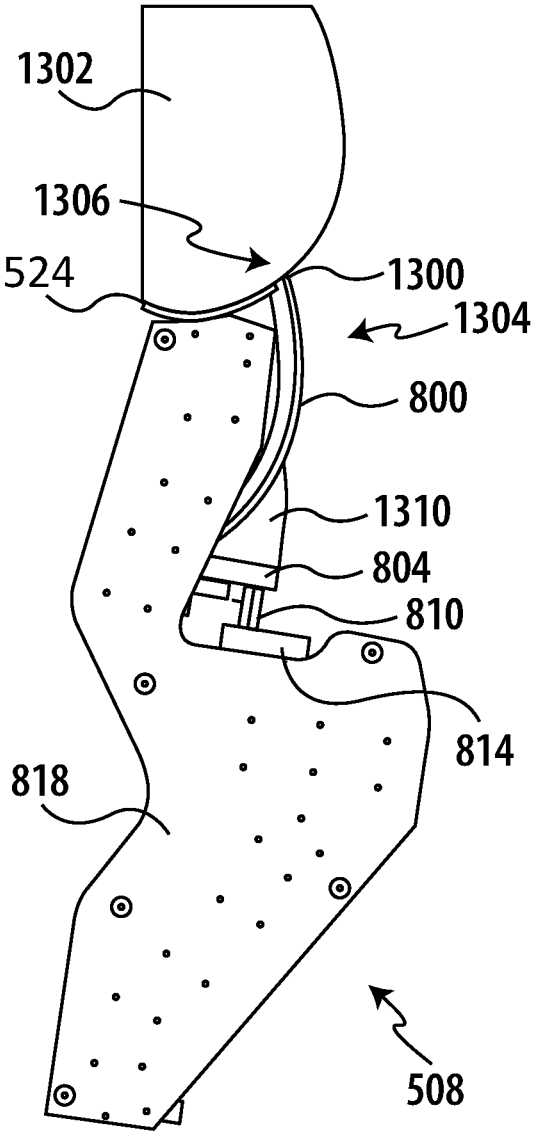
FIGS. 13A-13F illustrate a left torso-support assembly as shown in FIGS. 5-8, viewed from a bottom position, as a left torso support wall of the assembly is deployed from a fully retracted position to a fully-extended position.
Figure 13B:
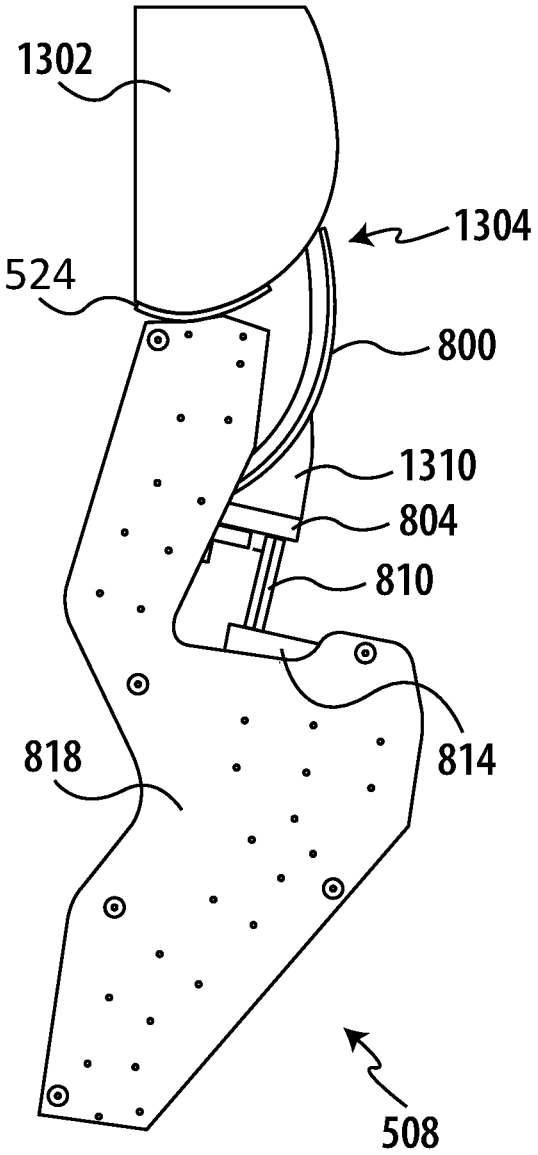
Figure 13C:
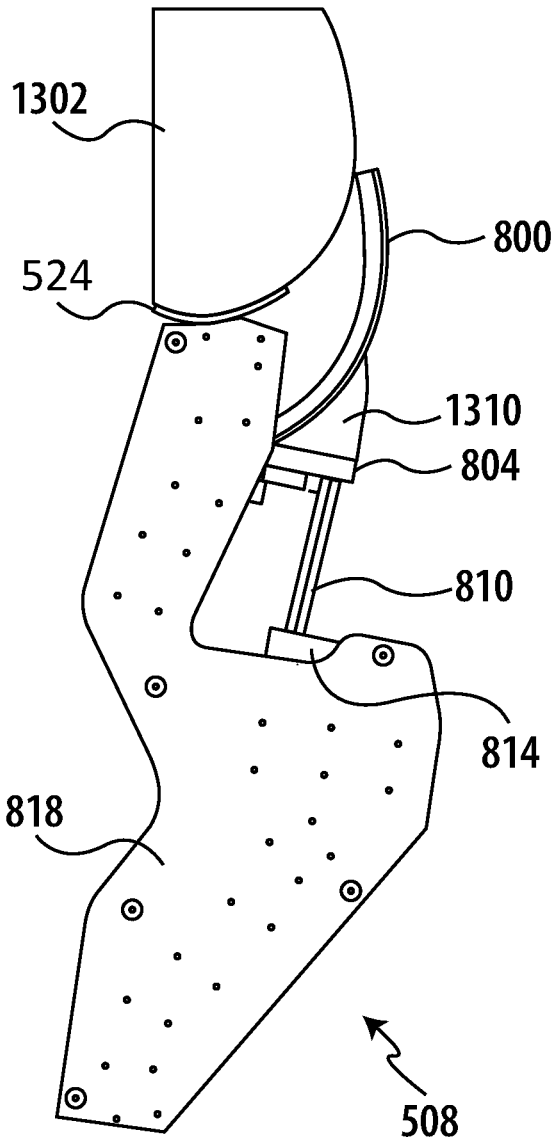
Figure 13D:
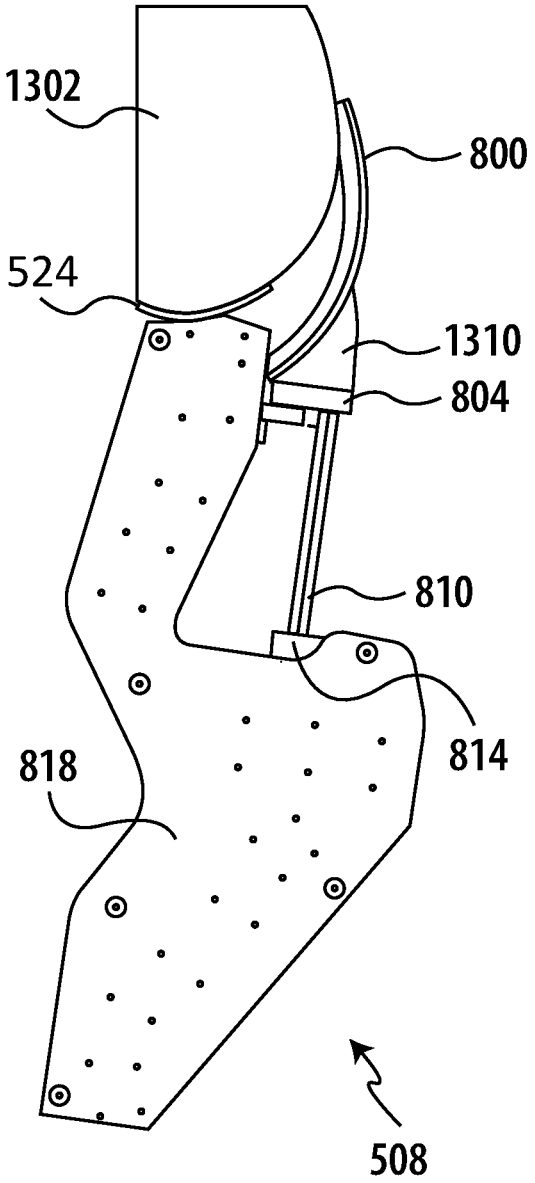
Figure 13E:
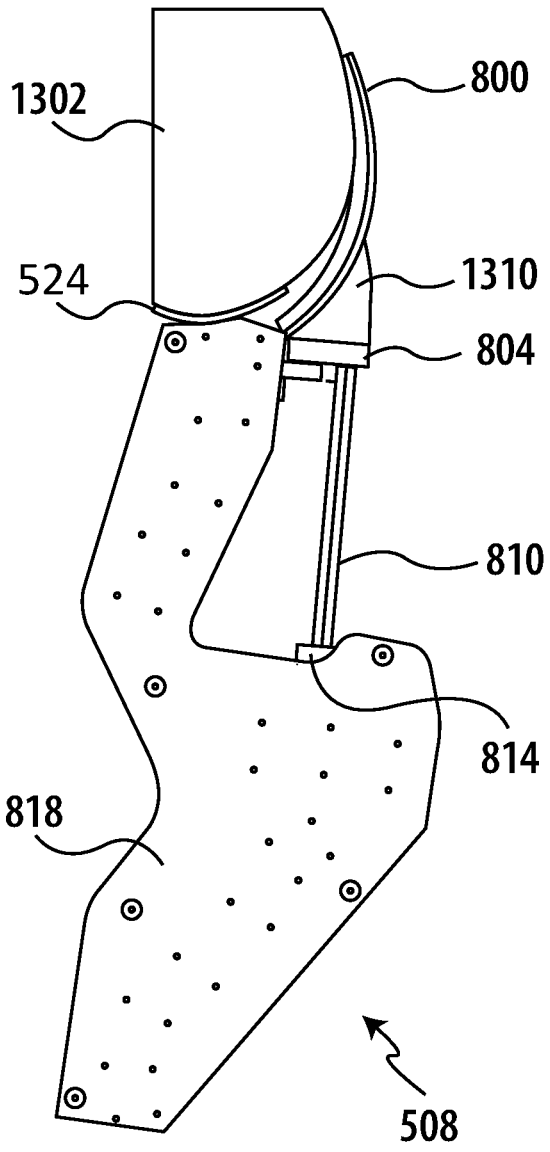
Figure 13F:
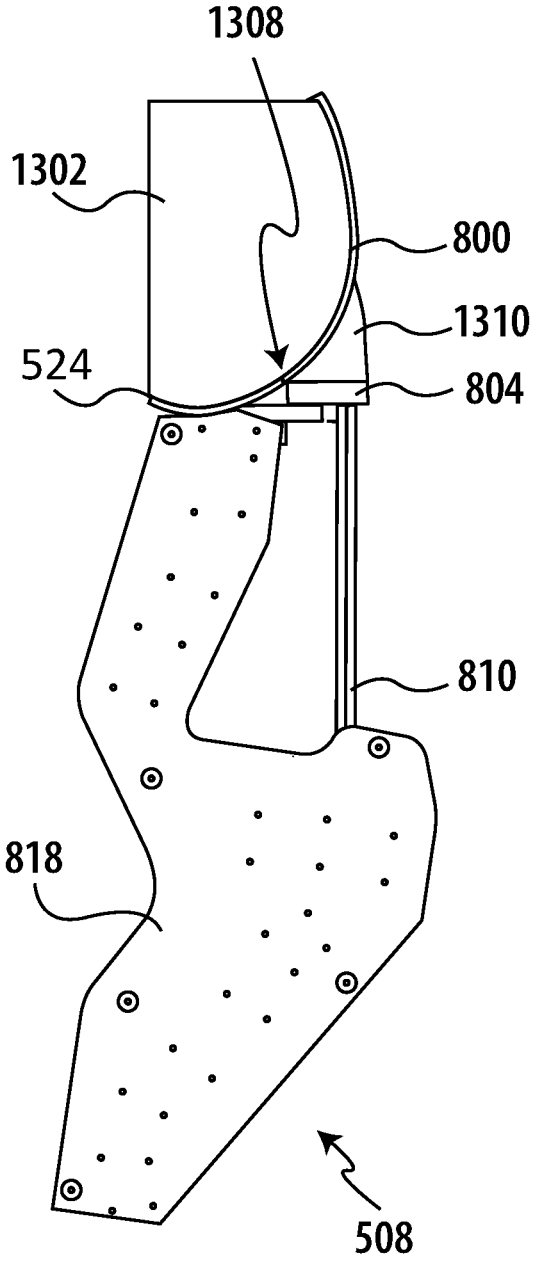

FIGS. 13A-13F illustrate left torso-support assembly 508, viewed from a bottom position, i.e., looking along an axis through cradle 502 from a user's feet to the user's head as the user lays on cradle 502, as left torso support wall 800 is deployed from a fully retracted position, as shown in FIG. 13A, to a fully extended position in FIG. 13F. For clarity, no other elements of body support device 500 is shown in these figures.

FIG. 13A shows left torso support wall 800 fully retracted behind a front surface of cradle 502 (not shown). Left torso support wall 800 meets with back support 524 at a point 1300, where a top portion 1304 of left torso support wall 800 is flush with a left portion 1306 of back support 524, in this embodiment. In this way, a user's torso 1302 is supported primarily by back support 524 while lying in the horizontal reference position. In other embodiments, left torso support wall 800 may be retracted further, so that top portion 1304 of left torso support wall 800 is not flush with right portion 1306 of back support 524. Left torso support wall 800 is mechanically coupled to fill portion 1310, which comprises hard or semi-hard material for supporting left torso support wall 800 at a position shown with respect to top end cap 804. In one embodiment, the fill portion 1310 comprises fiber-glass resin or some other moldable compound that ultimately becomes rigid or semi-rigid.

FIG. 13A further illustrates the components of left torso-support assembly 508, namely parallel plate 818, top end cap 804, one of two connecting rods 810, and carriage 814. As shown, top end cap 804 is positioned near carriage 814 while a majority of the length of the connecting rods are pushed through motor 844 (hidden behind parallel plate 818).

FIG. 13B illustrates left torso support wall 800 positioned about 20% deployed. Here, motor 844 has extended the connecting rods, via rack 812, and thus torso support wall 800, into the position shown. Note that carriage 814 has moved to the right (further to the left of the torso) within guide grooves 834 and 1002, and how left torso wall 800 has moved vertically, horizontally and has also been rotated slightly counter-clockwise with respect to the torso, due to the sliding pivot point of carriage 814 within guide grooves. This complex, arcing movement continues as left torso support wall 800 moves from the fully retracted position to the fully extended position.

FIG. 13C illustrates left torso support wall 800 positioned about 40% deployed. Carriage 814 has still further extended the connecting rods via rack 812, and thus torso support wall 800, into the position shown. Left torso support wall 800 continues to move around the contour of torso 1302, and carriage 814 has been moved further to the right ((further to the left of the torso).

FIG. 13D illustrates left torso support wall 800 positioned about 60% deployed. Carriage 814 has still further extended the connecting rods via rack 812, and thus torso support wall 800, into the position shown. Left torso support wall 800 continues to move around the contour of torso 1302, and carriage 814 has been moved still further to the right (further to the left of the torso). At the same time support wall 800 started to move in the opposite direction to (from left to right of the torso) to complete deployment.

FIG. 13E illustrates left torso support wall 800 positioned about 80% deployed. Carriage 814 has still further extended the connecting rods via rack 812, and thus torso support wall 800, into the position shown. Left torso support wall 800 continues to move around the contour of torso 1302, and carriage 814 has been moved further to the right.

FIG. 13F illustrates left torso support wall 800 positioned 100% deployed. Carriage 814 has extended the connecting rods fully via rack 812, and thus fully extended torso support wall 800 so that the bottom portion 1308 of left torso support wall 800 forms a predominantly continuous surface with right side 1306 of back support 524. Left torso support wall 800 now fully contacts torso 1302, thus supporting torso 1302 as cradle 502 is rotated to the right. Note that carriage 814 has moved to a maximum right position, no longer visible behind parallel plate 818 and that the rod 810 and side wall 800 have gradually changed the angle compared to the position in FIG. 13A. Support wall 800 completed the crest-like path as it travelled up and to the left of torso in FIGS. 13A-C and up and to the right of torso in FIGS. 13D-F.

Figure 14:
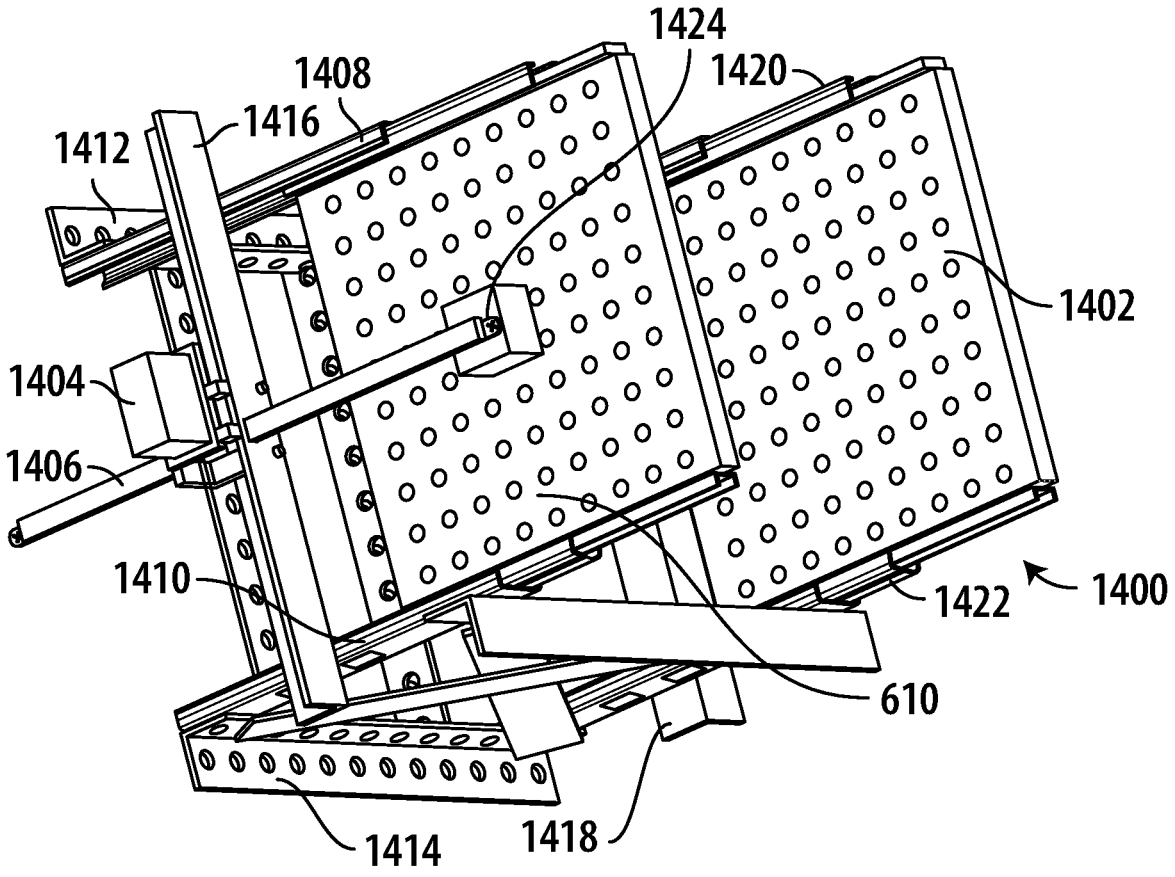
FIG. 14 is a perspective view of one embodiment of a head support assembly used in the body support devices of FIG. 5.

FIG. 14 is a perspective view of one embodiment of head support assembly 1400, comprising right head support wall 610, right electric motor 1404, right rack 1406, top right guide 1408, bottom right guide 1410, left head support wall 1402, top left guide 1420, bottom left guide 1422, and a supporting frame, comprising frame members 1412, 1414, 1416, and 1418. Not shown are several components for extending/retracting left head support wall 1402, such as a corresponding left electric motor and a left rack. Left head support wall 1402 operates in the same manner as right head support wall 610, so that any discussion with respect to right head support wall 610 will be also applicable to left head support wall 1402. For clarity, no other elements of body support device 500 are shown in FIG. 14. It should be understood that the same or similar components shown in FIG. 14 to form head support assembly 1400 could be used to form one or more leg support assemblies, for extending/retracting leg support walls, as shown later in FIGS. 18-21.

In FIG. 14, both head support walls are shown in a fully extended position, extending through openings 512 and 514 if cradle 502 were shown. Right side wall 610 is extended/retracted by right electric motor 1404 operating on rack 1406, which comprises a toothed edge for engagement with a pinion (not shown) of right electric motor 1404. One end of rack 1406 is mechanically coupled to right head support wall 610 via block 1424 such that right head support wall 610 extends/retracts as right electric motor 1404 acts on rack 1406. Right electric motor 1404 rotates in one direction for extending right head support wall 610 and in an opposing direction for retracting right head support wall 610. Right electric motor 1404 is operated by a control unit (not shown, but discussed later herein) and motor driving circuitry, which is well-known in the art.

Right electric motor 1404 is mechanically coupled to frame member 1416, which in turn is mechanically coupled to the other frame members to form a mechanical frame for supporting the electric motors, the guides and the head support walls. Right head support wall 610 is slidably attached to top guide 1408 and bottom guide 1410 (similar guides for left head support wall 1402 are shown as left top guide 1420 and right bottom guide 1422). The guides define a direction that each head support wall follow during extension/retraction, in this case, essentially perpendicularly with openings 512 and 514. The guides also bear weight of user's head placed on the deployed support wall 610 when cradle is rotated. Each guide, in this embodiment, comprises a movable portion that is mechanically coupled to each head support wall, respectively, and a fixed portion for receiving the movable portion, similar to standard drawer slides.

It should be understood that in other embodiments, head support assembly 1400 could comprise a number of other components, or types of components, arranged differently than is shown in FIG. 14, without departing from the scope of the disclosure as shown in FIG. 14, and that such alternative mechanical arrangements would be obvious to one skilled in the art.

Figure 15:
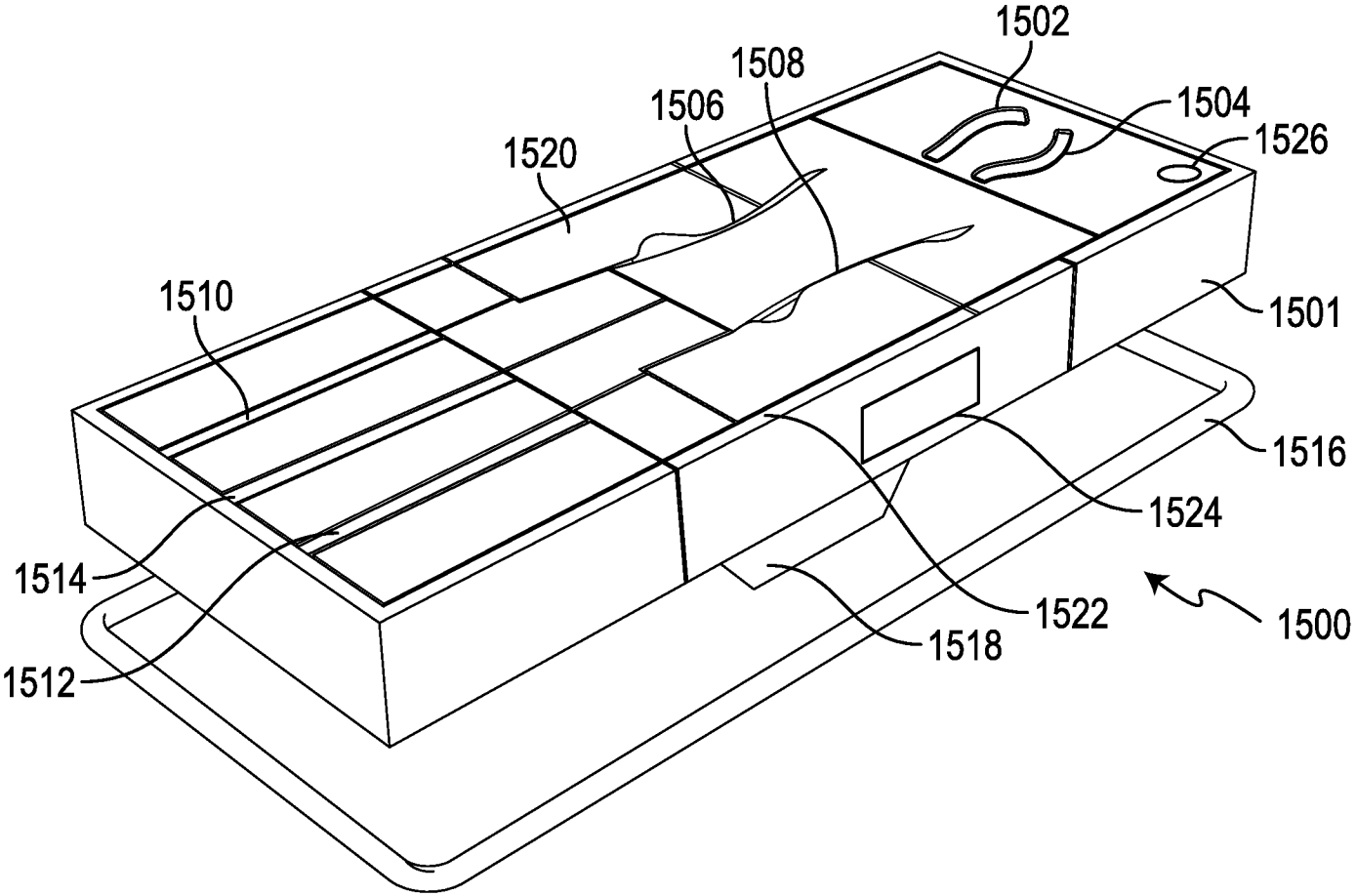
FIG. 15 is a perspective view of yet another embodiment of a body support device shown in a flat, supine position.

FIG. 15 is a perspective view of another embodiment of a body support device, in this embodiment body support device 1500, shown in a flat, supine position. In this embodiment, cradle 1501 is comparable to cradle 502 and cradle 102 in that it supports a user's body during sleep, capable of rotating cradle 1501 about a longitudinal axis of cradle 1501, as shown later in FIGS. 18-20. Cradle 1501 is shown in a "flat" position with respect to base frame 1516, allowing a user to easily access body support device 1500 by lying face up on cradle 1501. In one embodiment, cradle 1501 is rotatably coupled to gimbal 1518, which provides mechanical support to cradle 1501 as well as an electric motor for rotating cradle 1501 about its longitudinal axis and, in some embodiments, for additionally rotating cradle 1501 in a fore and aft direction, i.e., about an axis running sideways through cradle 1501.

In the embodiment shown in FIG. 15, cradle 1501 comprises extendable/retractable head support walls 1502 and 1504, torso support walls 1506 and 1508, arm support walls (not shown) and leg support walls 1510, 1512 and 1514. It should be understood that in other embodiments, fewer support walls could be used. For example, in another embodiment, arm support walls are not used. It should also be understood that each of the support walls are extended/retracted using electro-mechanical assemblies similar to the ones shown in FIG. 8 (for complex deployment/retraction) or the one shown in FIG. 14, each assembly coupled to the back side of cradle 1501 behind respective openings or slits in cradle 1501.

Each of the walls is extendable/retractable through cradle 1501, where each wall is part of an electro-mechanical assembly that causes each wall to extend or retract based on a rotational position of cradle 1501. Each electro-mechanical assembly is not shown, however each assembly may resemble torso or head support assemblies 508, 510 or 1400. In some embodiments, the complex movement provided by torso support assemblies 508 and 510 is not required for some of the support walls, such as head support walls 1502 and 1504, arm support walls, or leg support walls 1510 and 1512. In these embodiments, the guide grooves of these assemblies could be formed vertically (referencing FIGS. 10-12), with no provision for lateral movement of a wall as a wall is being extended/retracted. In other embodiments, guide groves are not used, and the walls are extended/retracted using known electro-mechanical means using a combination of motors, gears, pulleys, cams and/or other mechanical devices, including hydraulic and pneumatic devices, to cause walls to extend and retract. In one embodiment, one or more of the walls are extended/retracted by inflation/deflation of one or more inflatable walls.

Each of the support walls shown in FIG. 15 is retracted and flush with a top surface of cradle 1501.

FIG. 15 additional shows control unit 1524. Control unit 1524 may comprise a user interface, comprised of a number of pushbuttons, knobs, touchscreens or one or more of a number of well-known components to allow a user to enter and receive information pertaining to the operation of body support device 1500. Control unit 1524 causes rotation of cradle 1501 in accordance with processor-executable instructions stored in a memory of 1524, as well as other functions, such as, in one embodiment, recording various metrics during use of body support device 1500, such as a time cradle 1501 is positioned at various rotational angles, as well as, in some embodiments, vital metrics of a user, such as a history of heartbeat, respiratory rate, etc. if cradle 1501 is equipped with sensors to monitor such metrics.

FIG. 15 further shows tilt sensor 1526 located at a top right position of cradle 1501, however it could be located virtually anywhere on cradle 1501. Tilt sensor 1526 is used to determine the rotational angle of cradle 1501 and provide this rotational angle information to control unit 1524, for causing control unit 1524 to deploy/retract various walls when cradle 1501 reaches +/−about five to fifteen degrees from the horizontal reference position. Electronic tilt sensors are well-known in the art.

Figure 16:
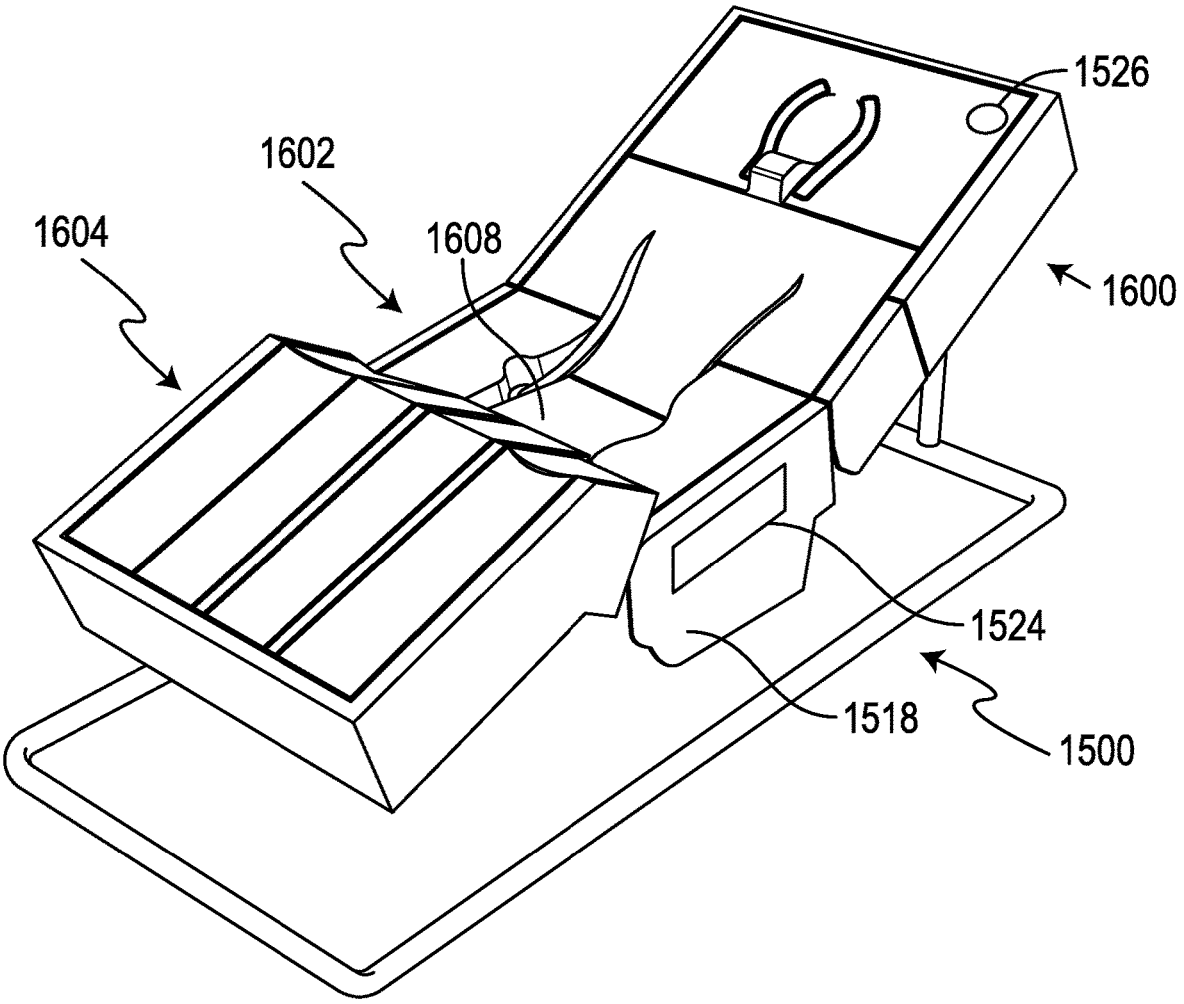
FIG. 16 is a perspective view of the body support device as shown in FIG. 15, in a reclined position.

FIG. 16 is a perspective view of body support device 1500, shown in a reclined position. As shown here, cradle 1501 comprises three sections, an upper section 1600, a mid-section 1602 and a lower section 1604. Upper section 1600 and lower section 1604 are movable with respect to mid-section 1602 via electro-mechanical means using a combination of motors, gears, pulleys, cams and/or other mechanical devices to place upper section 1600 and lower section 1604 into the positions shown in FIG. 16. The electro-mechanical means are generally located on a back surface of cradle 1501 and, therefore, are not shown. Upper support 1600, lower support 1604, and mid-section 1602 are shown angled with respect to each other to position legs and torso (hip angle) at approximately 128 degrees and knees bent at approximately 133 degrees, the position sometimes referred to as "zero-gravity" and resembles mid-Fowler's, but could, alternatively, be placed at any angle between 180 and 90 degrees, depending on user comfort and/or medical necessity.

In the position shown in FIG. 16, cradle 1501 forms a depression 1608, formed by a cut through cradle 1501 around an area where a user's hips may be located. This may add to the comfort of a user while using body support device 1500.

In addition to providing mechanical support and rotation of cradle 1501, gimbal 1518 may also be configured to position upper section 1600 and lower section 1604 using a combination of additional motors, gears, pulleys, cams and/or other suitable mechanical components.

Figure 17:
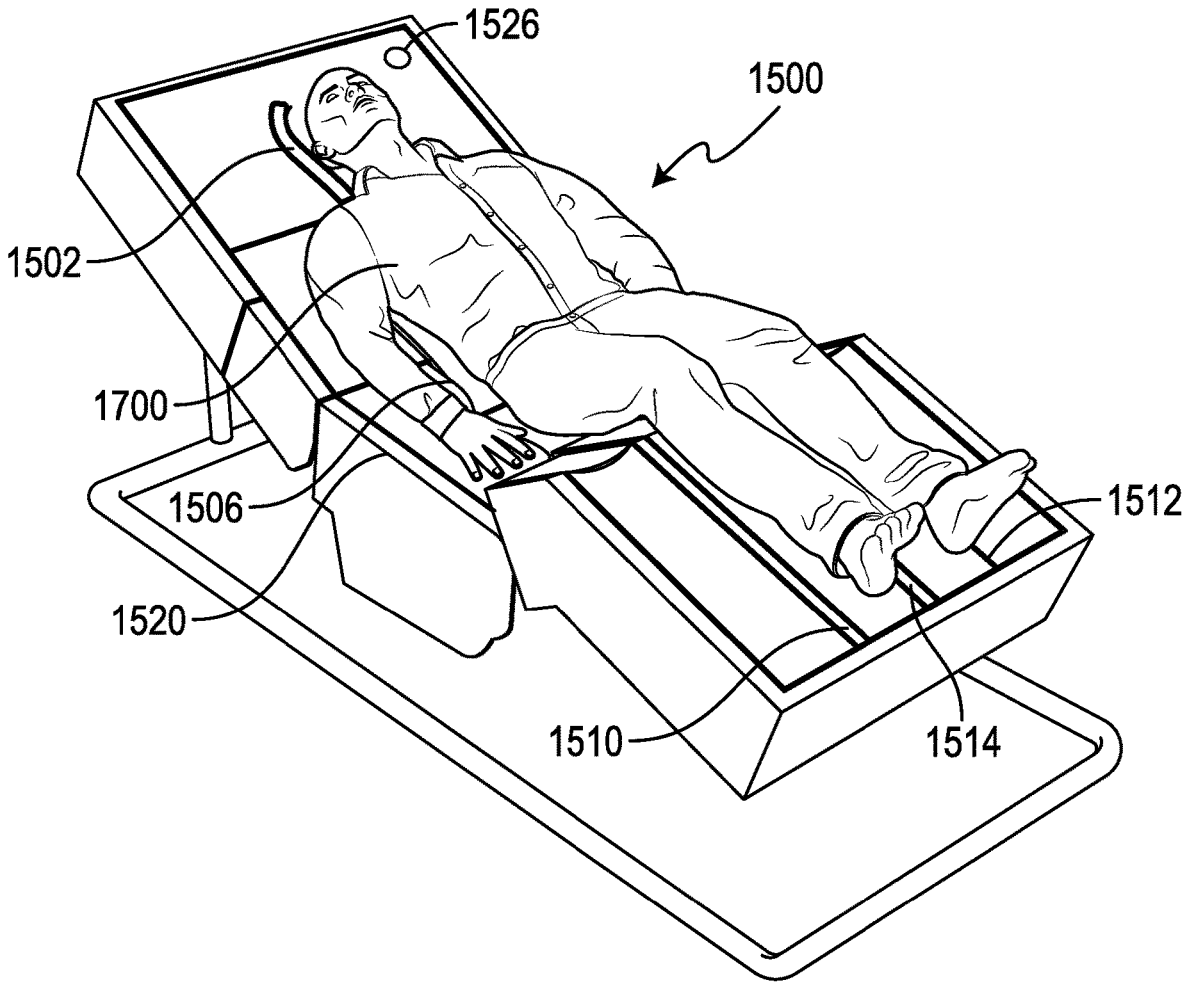
FIG. 17 is an opposing, perspective view of the body support device as shown in FIGS. 15 and 16, in the reclined position with a user laying on the body support device.

FIG. 17 is a perspective view of body support device 1500, shown in a reclined position along with a user 1700 lying in cradle 1501. Some of the support walls can be seen, still retracted, as cradle 1501 is in the horizontal reference position, i.e., in a position where user 1700 is in a supine position, i.e., face up.

Figure 18:
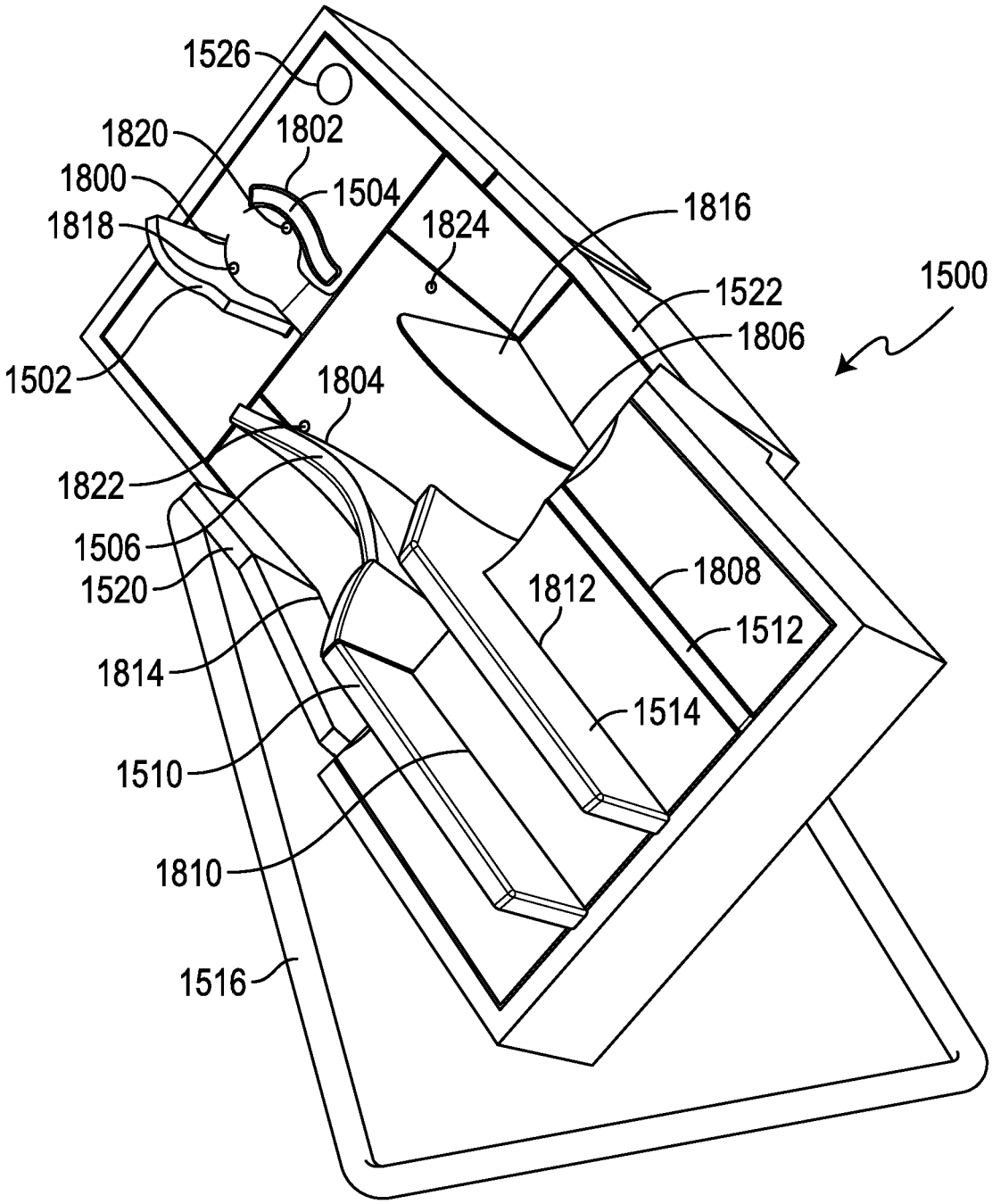
FIG. 18 is a perspective view of the body support device as shown in FIGS. 15-17, shown without a user, in a right-rotated position.

4 is a perspective view of body support device 1500, shown without user 1700, in a right-rotated position, i.e., towards a user's right side if user 1700 were occupying cradle 1501. As shown, cradle 1501 has been rotated approximately 50 degrees to the right from the horizontal reference position by gimbal 1518. As cradle 1501 is moving to the right from the horizontal reference position, at about between 0 and 15 degrees from the horizontal reference position (herein the "right deployment/retraction angle"), a number of walls are extended through cradle 1501 to support the user while cradle 1501 continues rotating past the right deployment/retraction angle. In the embodiment of FIG. 18, right head support wall 1502, right torso support wall 1506, outer right arm support wall 1520, right leg support wall 1510, middle leg support wall 1514, and left arm support wall 1816 are extended through right head support slit 1800, right torso support slit 1804, outer right arm support slit 1814, right leg support slit 1810, middle leg support slit 1812 and left arm support slit 1806, respectively, as cradle 1501 is rotated past the right deployment/retraction angle. Each of the slits is formed completely through cradle 1501, allowing respective walls to retract and extend. Outer right arm support wall 1520 supports a user's right arm while cradle 1501 is rotated to a position greater than the right deployment/retraction angle. Slits 1800 and 1802 are spaced apart from each other approximately a width of an expected user's head, while slits 1806 and 2000 (shown in FIG. 20) are spaced apart from each other approximately a width of an expected user's torso.

Also shown in FIG. 18 are sensors 1818, 1820, 1822 and 1824. The sensors comprise one or more of pressure sensors, motion sensors, electroencephalography sensors, eye tracking sensors, temperature sensors, capacitance sensors, or some other kind of sensors that help determine a desire of a user to rotate cradle 1501. For example, in one embodiment, torso sensors 1822 and 1824 comprise pressure sensors, and are located within or on a surface of cradle 1501 as shown, near a user's upper torso on each side such that when the user rolls over to the left, for example, the user's weight pressed upon torso sensor 1824 causes torso sensor 1824 to send a signal to a control unit 1524, causing control unit 1524 to rotate cradle 1501 to the left. Similarly, when a user turns his or her head to the right, head sensor 1818 detects the movement of the user's head and sends a signal to control unit 1524, causing the cradle to rotate to the right.

In one embodiment, one or more sensors may comprise a heartbeat sensor, a respiratory rate sensor, a temperature sensor, or some other sensor used to capture human vital signs. In this embodiment, the sensor(s) provide vital sign information to control unit 1524 for historical record-keeping purposes and/or for control unit 1524 to adjust the rotational angle of cradle 1501 in response to receiving certain vital signs. For example, control unit 1524 may cause cradle 1501 to rotate back to the horizontal reference position if the user's heartbeat exceeds a predetermined threshold, such as 99 beats per minute or if electroencephalography sensor detects a switch in sleep phase.

Figure 19:
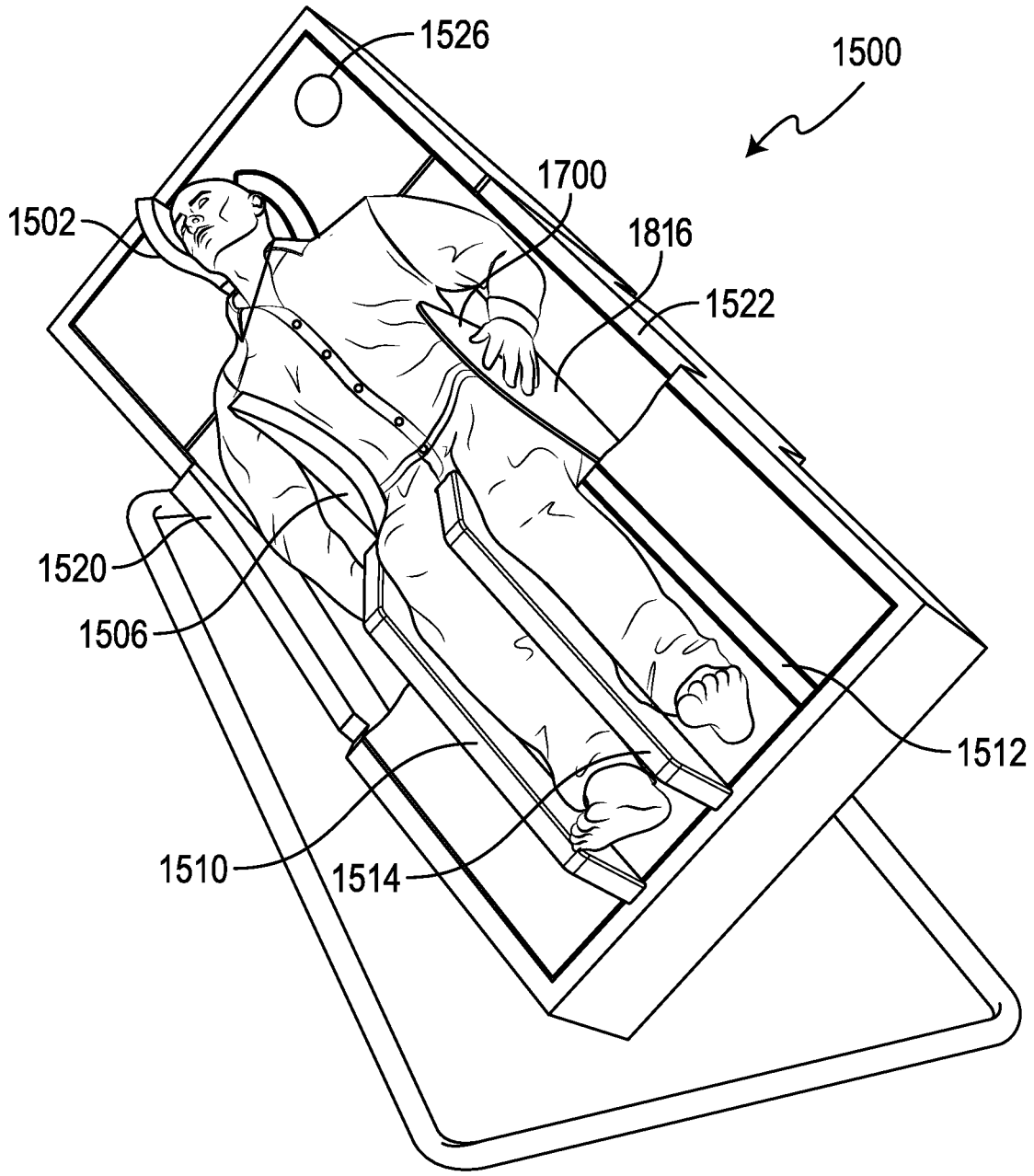
FIG. 19 shows a user laying in the body support device as shown in FIGS. 15-18 as a cradle of the body support device is held in a right-rotated position of about 50 degrees from a horizontal reference position, with a number of support walls having been deployed.

FIG. 19 shows user 1700 lying in cradle 1501 as cradle 1501 is held in the right-rotated position of about 60 degrees from the horizontal reference position while all of the aforementioned walls of FIG. 18 have been deployed. The right side of user 1700's head is supported by right head support wall 1502. The right side of user 1700's torso is supported by right torso support wall 1506. User 1700's right arm is supported by outer right arm support wall 1520. The right side of user 1700's right leg is supported by right leg support wall 1510. The right side of user 1700's left leg is supported by middle support wall 1514. Finally, user 1700's left arm is supported by left arm support wall 1816.

Figure 20:
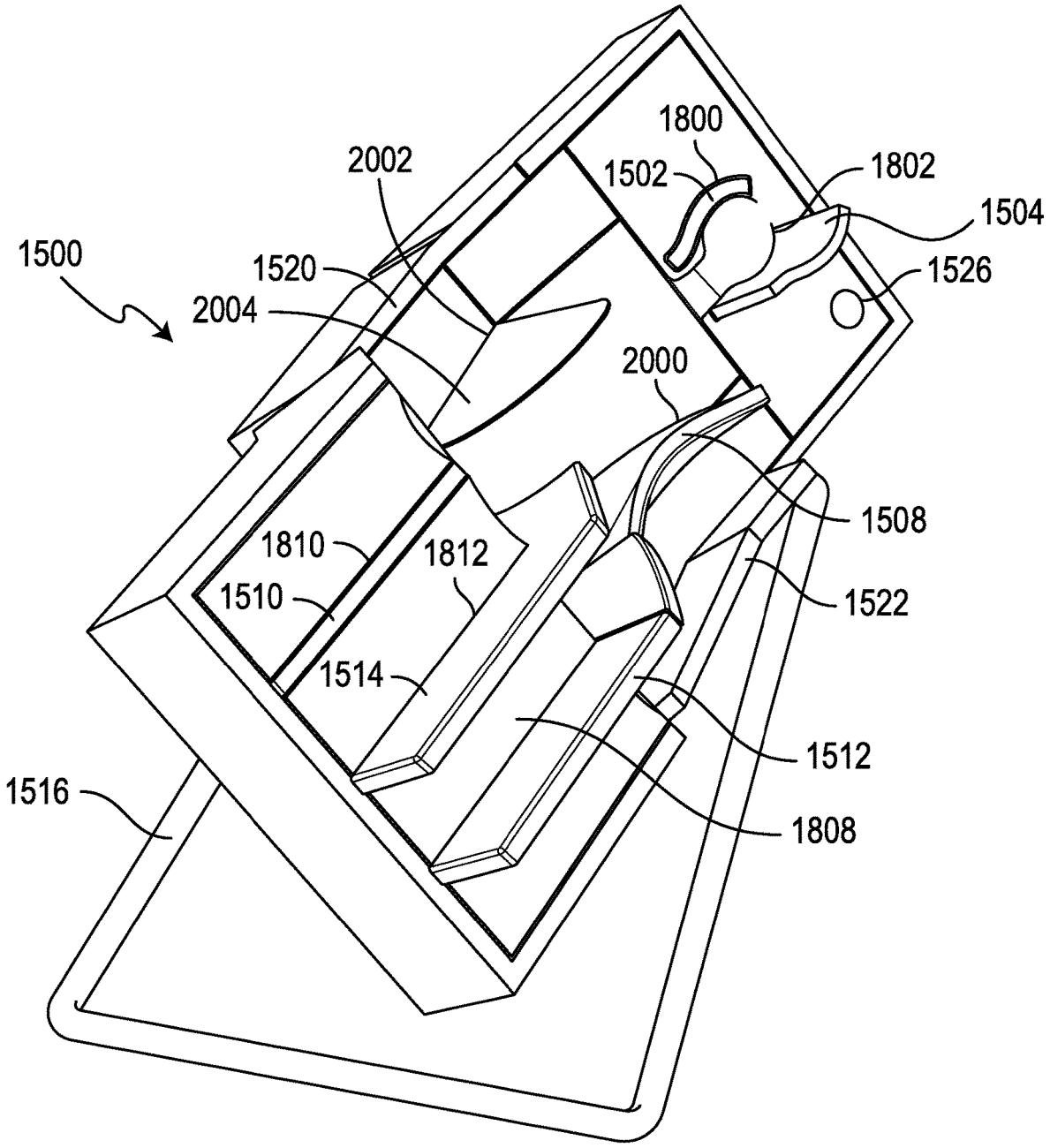
FIG. 20 is a perspective view of the body support device as shown in FIGS. 15-19, shown without a user, in a left-rotated position.

FIG. 20 is a perspective view of body support device 1500, shown without user 1700, in a left-rotated position, i.e., towards a user's left side if user 1700 were occupying cradle 1501. As shown, cradle 1501 has been rotated approximately 60 degrees to the left from the horizontal reference position by gimbal 1518. As cradle 1501 is moving from the horizontal reference position to the left, at about between 5 and 15 degrees from the horizontal reference position (herein the "left deployment/retraction angle"), a number of walls are extended through cradle 1501 to support the user while cradle 1501 continues rotating past the left deployment/retraction angle. In the embodiment of FIG. 20, left head support wall 1504, left torso support wall 1508, outer left arm support wall 1522, left leg support wall 1512, middle leg support wall 1514, and right arm support wall 2004 are extended through left head support slit 1802, left torso support slit 2000, outer left arm support slit (not shown), left leg support slit 1808, middle leg support slit 1812 and right arm support slit 2002, respectively, as cradle 1501 is rotated past the left deployment/retraction angle. Each of the slits is formed completely through cradle 1501, allowing respective walls to retract and extend. Outer left arm support wall 1522 supports a user's left arm while cradle 1501 is rotated to a position greater than the left deployment/retraction angle.

Figure 21:
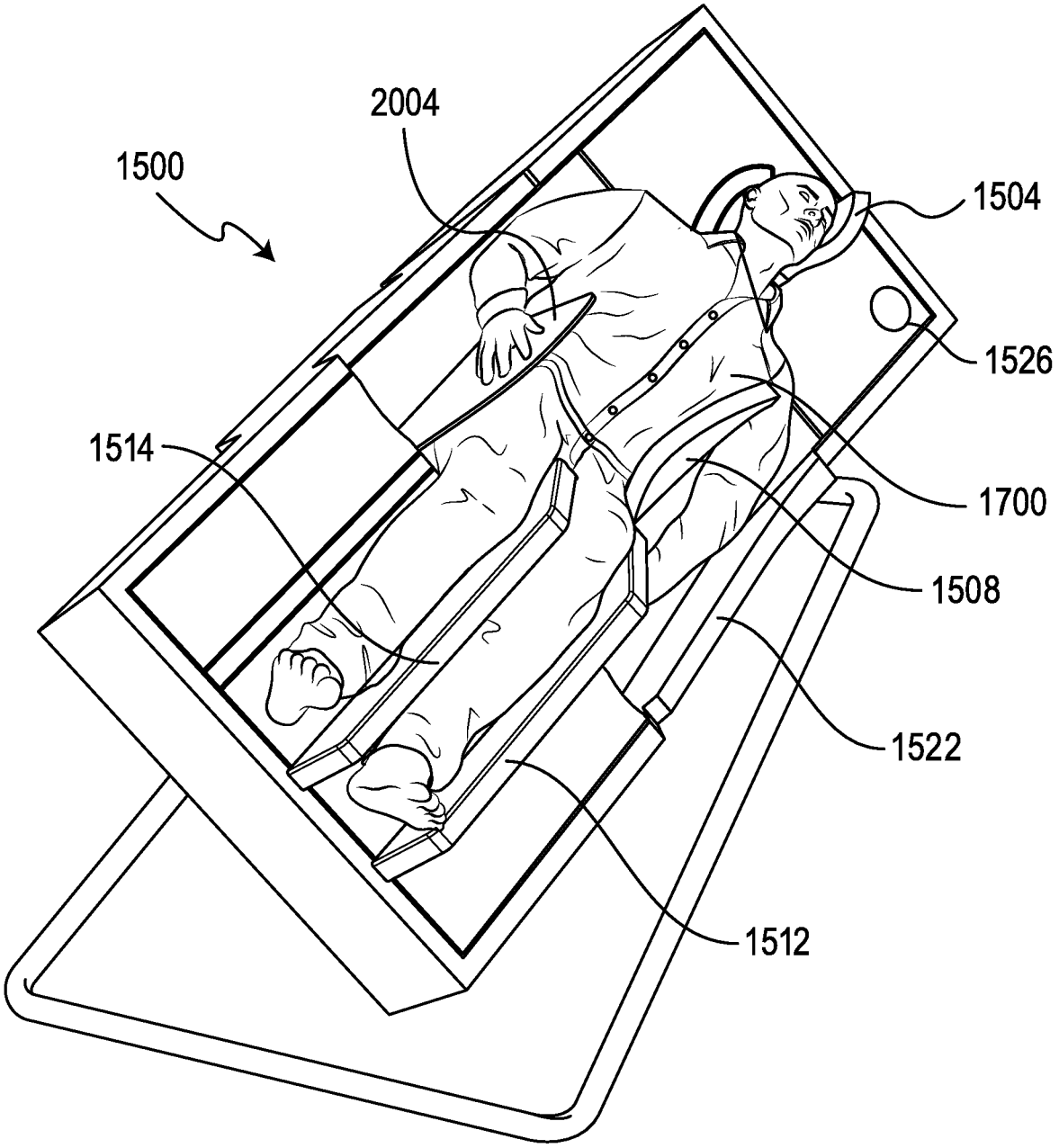
FIG. 21 shows a user laying in the body support device as shown in FIGS. 15-20 as the cradle is held in a left-rotated position of about 50 degrees from a horizontal reference position, with a number of support walls having been deployed.

FIG. 21 shows user 1700 lying in cradle 1501 as cradle 1501 is held in the left-rotated position of about 50 degrees from the horizontal reference position while all of the aforementioned walls of FIG. 20 have been deployed. The left side of user 1700's head is supported by left head support wall 1504. The left side of user 1700's torso is supported by left torso support wall 1508. User 1700's left arm is supported by outer left arm support wall 1522. The left side of user 1700's left leg is supported by left leg support wall 1512. The left side of user 1700's right leg is supported by middle support wall 1514. Finally, user 1700's right arm is supported by right arm support wall 2004.

Generally, cradle 1501 is rotated from the horizontal reference position, to either a user's left or the right, then rotated back through the horizontal reference position and to the user's other side. This rotation may occur several times over the course of sleep and may include rotations from one side to the horizontal reference position, and then back to the same side. As cradle 1501 is being rotated from the left towards the horizontal reference position, any wall that is deployed is retracted through cradle 1501 when cradle 1501 reaches the left deployment/retraction angle. In one embodiment, all of the walls remain retracted until either cradle 1501 is rotated past the right deployment/retraction angle, at which time the walls shown in FIGS. 20 and 21 are deployed, or cradle 1501 is rotated back to the left, past the left deployment/retraction angle, at which time the walls shown in FIGS. 18 and 19 are deployed. Similarly, as cradle 1501 is being rotated from the right towards the horizontal reference position, any wall that is deployed is retracted through cradle 1501 when cradle 1501 reaches the right deployment/retraction angle. In one embodiment, all of the walls remain retracted until either cradle 1501 is rotated past the left deployment/retraction angle, at which time the walls shown in FIGS. 18 and 19 are deployed, or cradle 1501 is rotated back to the right, past the right deployment/retraction angle, at which time the walls shown in FIGS. 20 and 21 are deployed. In some embodiments, some of the walls remain deployed, no matter what angle cradle 1501 is rotated to. For example, left leg support wall 1510, middle leg support wall 1514 and right leg support wall 1512 could remain deployed after the user lays on cradle 1501 and remain deployed as cradle 1501 is rotated to various positions by gimbal 1518. Or, in another embodiment, one or more of the walls are permanently deployed, i.e., fixed to cradle 1501, and are not retractable. For example, middle leg support wall 1514 could be permanently fixed to cradle 1501.

Figure 22:
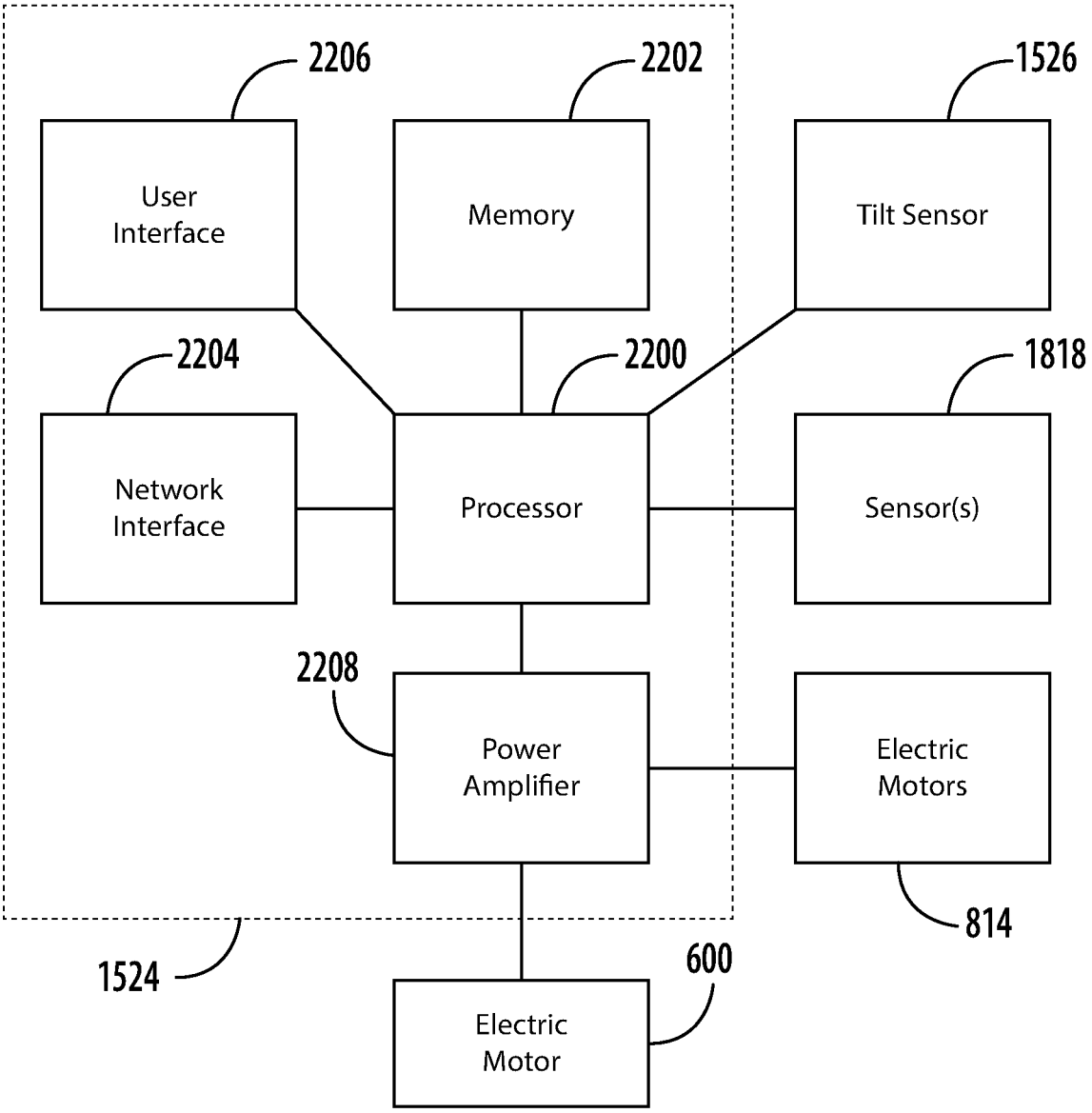
FIG. 22 is a functional block diagram of one embodiment of electronic components of the body support devices as shown in FIGS. 1-7 and 15-21.

FIG. 22 is a functional block diagram of one embodiment of electronic components of the body support devices as shown in FIGS. 1-7 and 15-21. Shown in FIG. 22 is control unit 1524, comprising processor 2200, memory 2202, network interface 2204, user interface 2206, and power amplifier 2208, plus electric motor 604, tilt sensor 1526, one or more sensors 1818 (referencing any of sensors 1818, 1820, 1822 and/or 1824, and/or other sensor(s)) and motors 604 and 844. It should be understood that the functional blocks shown in FIG. 22 could be arranged in different manners in other embodiments, and that some basic functional blocks have been omitted, such as a power supply, for clarity.

Processor 2200 is configured to provide general operation of control unit 1524 by executing processor-executable instructions stored in memory 2402, for example, executable code. Processor 2200 comprises one or more general or special-purpose microprocessors, microcontrollers and/or ASICs, such as any one of a number of Core i-series class microprocessors manufactured by Intel Corporation of Santa Clara, Calif., chosen based on implementation requirements such as power, speed, size and cost.

Memory 2202 comprises one or more information storage devices, such as RAM, ROM, EEPROM, flash memory, SD memory, XD memory, or virtually any other type of information storage device. Memory 2202 is used to store the processor-executable instructions for operation of control unit 1524 as well as any information used by processor 2200 to perform such operations. Such information may comprise a schedule of times and rotational angles for a sleep session for one or more particular users. In some embodiments, memory 2202 is incorporated into processor 2200, such as the case in embodiments where processor 2200 comprises a microcontroller or custom ASIC.

Network interface 2204 is coupled comprises circuitry necessary for control unit to communicate over one or more local and/or wide-area digital networks, such as a home Wi-Fi network and/or the Internet. In one embodiment, network interface 2204 receives wireless signals from a user's mobile device, such as a smartphone or wearable device. In this embodiment, the user provides instructions to processor 2200 via an app running on the mobile device, and the mobile device transmits signals for cradle 1501 to rotate into various angles. The signal is received by network interface 2204 and provided to processor 2200, where the instructions are performed, causing electric motor 604 and electric motors 844 to rotate cradle 1501 and to extend/retract the support walls, respectively. Such circuitry is well known in the art.

Optional user interface 2206 is coupled to processor 2200, allowing users to enter information into control unit 1524 as well, in some embodiments, to view information provided by control unit 1524. For example, a user may manually enter one or more time periods and rotational angles into control unit 1524, causing cradle 1501 to rotate to the desired angles and held in each angle for the time period specified by the user. Settings may be reviewed by users via a display screen. User interface 2206 may comprise one or more pushbuttons, joysticks, switches, sensors, touchscreens, keypads, keyboards, ports, and/or microphones that generate signals for use by processor 2200. User interface 2206 may additionally comprise one or more seven-segment displays, cathode ray tubes (CRT), liquid crystal displays (LCD), or any other type of visual display for display of information to users. Of course, the aforementioned items could be used alone or in combination with each other and other devices may be alternatively, or additionally, used.

Power amplifier 2208 is coupled to processor 2200, for amplifying control signals from processor 2200 and providing the amplified signals to electric motor 604 (the motor responsible for rotating cradle 1501) and electric motors 844 (responsible for extending/retracting at least the torso support walls). Electric motor 604 is, in some embodiments, incorporated into gimbal 1518. Electric motors 844 represent one motor for each extendable/retractable wall of cradle 1501. For example, in the embodiment shown in FIGS. 5-7, two electric motors 844 are used, one for left torso-support assembly 510 and one for right torso-support assembly 508. In the embodiment shown in FIG. 17, as many as eleven electric motors 844 are used, one each to extend/retract right head support wall 1502, left head support wall 1504, right torso support wall 1506, left torso support wall 1508, right leg support wall 1510, left leg support wall 1512, middle leg support wall 1514, outer left arm support wall 1522, right arm support wall 1804, left arm support wall 1616 and outer right arm support wall 1520. Each power amplifier may provide a different power output related to the power needed to extend/retract particular walls. Power amplifier 2208 typically comprises a series of power transistors and/or relays for amplifying the control signals from processor 2200. Power amplifiers are well-known in the art.

Block 1818 is labeled as "Sensor(s)", which includes any of sensors 1818, 1820, 1822 and/or 1824, and/or other sensor(s), coupled to processor 2200 and comprising one or more sensors, as described previously. The sensors may be used to control rotation of cradle 1501 or to collect human vital information from a user while the user is using cradle 1501, such as heartbeat, temperature, respiratory rate, electroencephalography, etc. In one embodiment, one or more sensors may be located away from body support device 1500, such as a motion sensor, temperature sensor, humidity sensor, noise level sensor, or an incontinence sensor, which can turn an HVAC system on or off, or call a caretaker. Sensor 1818 may further comprise a vibration sensor to detect snoring. In this case, processor 2200 may initiate rotation of cradle 1501 upon detection of snoring via the vibration sensor and continue rotation until snoring stops.

The motor(s) and/or drive assemblies are activated when a tilt sensor as part of the support device determines that the support device has been rotated a predetermined rotation angle from the supine position, for example, once the support device has been rotated 5 degrees from the supine position, i.e. at 0 degrees and prior to initiation of rotation of the cradle. In another embodiment, the side walls and/or arm supports are extended/retracted once a user provides an instruction to the support device to rotate the device to a user-defined angle from the supine position. For example, the support device may comprise a hardware controller that is coupled to a control unit, where the controller allows a user to enter commands that are received by the control unit to cause rotation of the support device. When the user enters a command to rotate to an angle greater than a predetermined angle (such as 5 degrees), the control unit causes the side walls/arm supports to extend or retract as described above. In another embodiment, a hardware controller is not used.

Figure 23A:
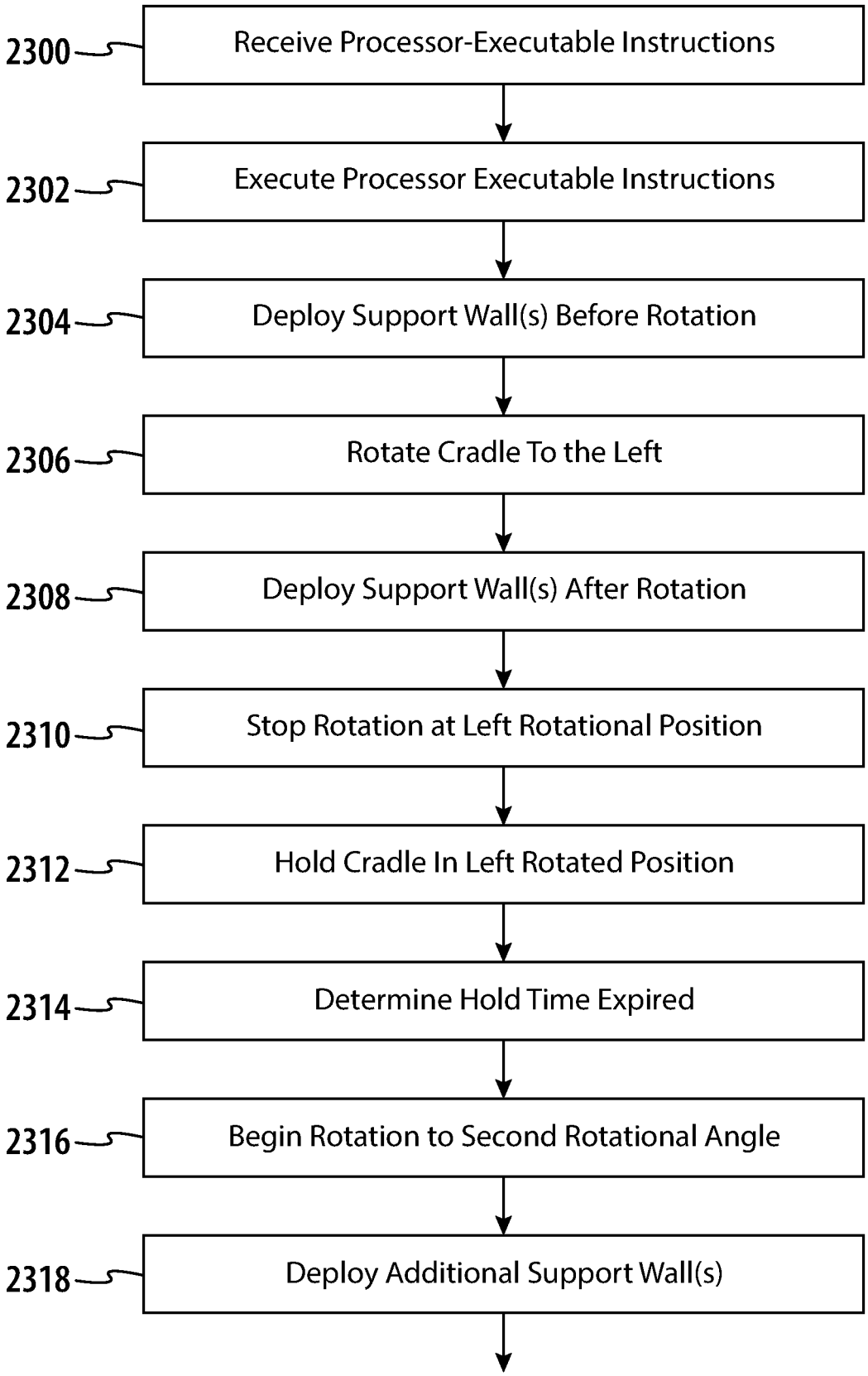
FIGS. 23A and 23B represent a flow diagram illustrating one embodiment of a method, performed by a control unit as shown in FIG. 22 for operation of the body support devices as shown in FIGS. 1-7 and 15-21.
Figure 23B:
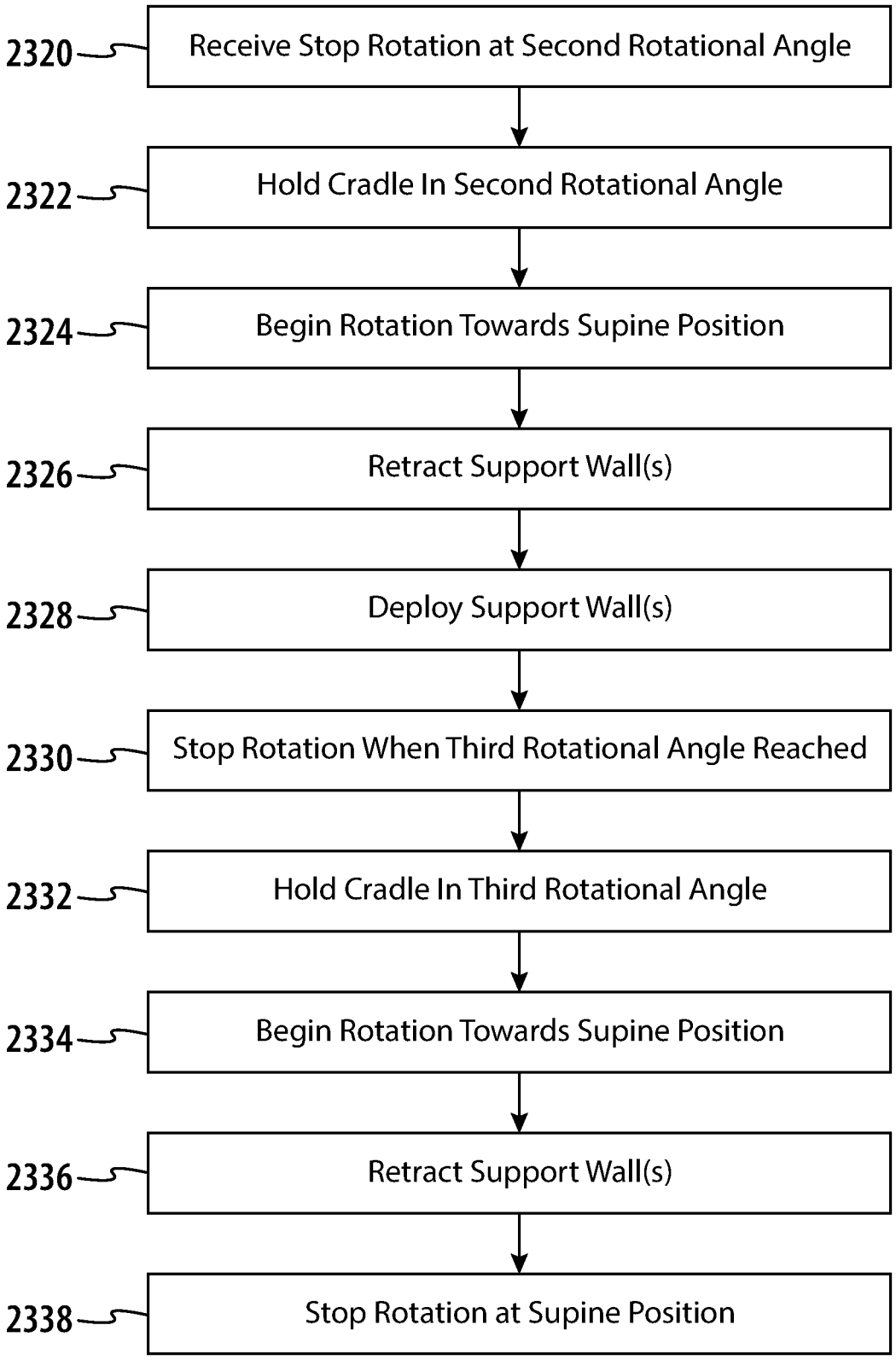

FIG. 23 is a flow diagram illustrating one embodiment of a method, performed by control unit 1524 (or by a personal electronic device such as a mobile phone), for operation of body support device 100, 500 or 1500. For purposes of discussion of the method, reference shall be made to body support device 1500, although such discussion may equally apply to body support device 100 and/or 500. It should be understood that in some embodiments, not all of the method steps shown in FIG. 23 are performed, and that the order in which the steps are performed may be different in other embodiments. It should also be understood that the steps described in this method could be applicable to one or all of the embodiments of a body support device as described herein. It should be further understood that while the method is described as a "sleep session" comprising rotation of cradle 1501 into four particular rotational angles, holding each position for a particular hold time, cradle 1501 could be rotated into rotational angles different than what is described below, each with the same or different hold times than described, and using fewer or a greater number of rotational angles than the four that are described below. The term "sleep session" defines a series of rotational angles and holding times for a particular time period, such as 8 hours, 4 hours, or even on a continuous basis until canceled, and need not be related to a time period when a user is sleeping.

At block 2300, processor 2200 receives processor-executable instructions for controlling the rotation of cradle 1501 via network interface 2204. In other embodiments, the processor-executable instructions could be received in other ways that are well-known in the art. The processor-executable instructions comprise a series of hold times and associated cradle rotation positions, i.e., angles of rotation and orientation (i.e., left or right rotation, and in embodiments employing vertical rotation, up or down rotation). The processor-executable instructions are stored in memory 2202.

In another embodiment, rotational angles and hold times are provided to processor 2200 via user interface 2206. In this embodiment, user interface 2206 may provide audio or visual cues to a user to enter one or more rotational angles and associated hold times. For example, a user could program body support device 1500 to first rotate to the left at an angle of 45 degrees and hold that position for 30 minutes, then rotate to the supine position (i.e., the horizontal reference position) for 5 minutes, rotate to the right at an angle of 45 degrees and hold that position for 30 minutes, then return to the supine position. Any number of rotational angle/hold time entries could be permitted.

A user may get into cradle 1501 using user interface 2206, or an app on the user's personal electronic device, such as a mobile phone, to raise cradle 1501 into a more upright position through activation of linear actuator 700, as shown in FIG. 7. Once the user is in cradle 1501, the cradle 1501 pivots back to the position shown in FIG. 5.

At block 2302, processor 2200 begins executing the processor-executable instructions that cause cradle 1501 to rotate in accordance with the rotational angles and associated hold times provided at block 2300. Typically, a user is lying on cradle 1501 while cradle 1501 is in the supine position, and most or all of the walls are retracted behind cradle 1501. Then, the user provides an activation signal to processor 2200 to begin executing the instructions, such as via user interface 2206, for example.

At block 2304, in one embodiment, before processor 2200 causes any rotation of cradle 1501, processor 2200 causes at least left torso support wall 1508 to deploy through cradle 1501 for supporting the user's torso when cradle 1501 is rotated to the left. In other embodiments, one or more other walls may also be deployed, such as one or more of left head support wall 1504, left leg support wall 1512, middle leg support wall 1514, outer left arm support wall 1522 and right arm support wall 2004.

At block 2306 processor 2200 causes cradle 1501 to begin rotating to the user's left side, in accordance with the processor-executable instructions, by energizing electric motor 844 to rotate in a first direction.

At block 2308, in an embodiment where all of the walls of body support device 1500 are still retracted behind cradle 1501 after cradle 1501 begins rotating, processor 2200 causes at least left torso support wall 1508 to deploy through cradle 1501 when processor 2200 determines that cradle 1501 has been rotated to, or past, a left deployment/retraction angle. Processor 2200 determines that cradle has been rotated to, or past, the left deployment/retraction angle by receiving one or more signals from one or more sensors 1818 (such as a tilt sensor), from an encoder that counts motor/gear rotations, or some other well-known rotational determination device(s). In another embodiment, processor 2200 determines the amount of rotation simply be knowing the angular rotational speed delivered to cradle 1501 by electric motor 604, and tracking the elapsed time from when electric motor 604 was energized or by a stepper motor that delivers a predetermined amount of steps. When cradle 1501 has been rotated to, or past, a left deployment/retraction angle, one or more other walls may also be deployed, such as one or more of left head support wall 1504, left leg support wall 1512, middle leg support wall 1514, outer left arm support wall 1522 and right arm support wall 2004.

At block 2310, processor 2200 causes cradle 1501 to stop rotating to the left when cradle 1501 has been rotated to a first programmed angle, in this example, 40 degrees to the left. Processor 2200 determines the rotational angle of cradle 1501 using techniques discussed above.

At block 2312, processor 2200 holds cradle 1501 at 40 degrees for a hold time associated with the rotational angle of 40 degrees, as provided by the processor-executable instructions. In this example, the hold time is 1 hour. Thus, the user is held at a rotational angle of 40 degrees from the supine position, to the user's left, with one or more side walls supporting the user's torso, head, legs and/or right arm. This position is held for 1 hour. In one embodiment, a hold time can be defined as a very short duration, such as 0-2 seconds, where cradle 1501 is rotated to one position and quickly then rotated to another position. In one embodiment, cradle 1501 could be rotated to two angles, for example, a right rotational angle of 20 degrees and a left rotational angle of 20 degrees, each with a hold time of zero seconds, resulting in cradle 1501 "rocking" back and forth between the two angles, reversing course instantly as cradle 1501 reaches each rotational angle.

At block 2314, processor 2200 determines that the hold time has expired.

At block 2316, processor 2200 begins rotating cradle 1501 to a second rotational angle as directed by the processor-executable instructions. In this example, the second rotational angle is 65 degrees to the user's left, even further from the supine position.

At block 2318, processor 2200 stops the rotation when cradle 1501 has reached 65 degrees. In one embodiment, any wall(s) that was/were deployed through cradle 1501 generally remains that way. In another embodiment, a second left deployment/retraction angle may be defined that causes one or more additional walls to be deployed once cradle 1501 reaches an "extreme" rotational angle, to better support the user in these extreme rotational angles. For example, when cradle 1501 is rotated to the left past 5 degrees past from the supine position to the left (the first left deployment/retraction angle), processor 200 may cause left torso support wall 1508 and left head support wall 1504 to deploy, and no others. As cradle 1501 continues to rotate to the left, past, say, 25 degrees (the second left deployment/retraction angle), processor 2200 may cause left leg support wall 1512 and middle leg support wall 1514 to deploy, thus supporting the user's legs. Other deployment/retraction angles may be defined as well, causing particular walls, e.g. 2004 and 1816, to deploy and retract.

At block 2320, processor 2200 stops rotating cradle 1501 once cradle 1501 has been rotated to 65 degrees.

At block 2322, processor 2200 holds cradle 1501 at 65 degrees for a hold time associated with this angle, in this example, for 30 minutes. It should be understood that at some other time during this method, cradle 1501 could be rotated back to the 65 degree position and be held for a different amount of time other than 30 minutes.

At block 2324, after expiration of the 30 minute hold time, processor 2200 causes cradle 1501 to begin rotating towards the supine position, and past the supine position to a third rotational angle, in this case a right rotational angle of 40 degrees, in accordance with the processor-executable instructions, by energizing electric motor 604 to rotate in a second direction.

At block 2326, in one embodiment, as cradle 1501 is rotated to, or past, the second left deployment/retraction angle, processor 2200 may retract one or more walls that had previously been deployed at the second left deployment/retraction angle. Continuing the example from above, when cradle 1501 reaches the 25 degree rotational position, being rotated towards the supine position, processor 2200 causes left leg support wall 1512 and middle leg support wall 1514 to retract behind cradle 1501.

At block 2326, when cradle 1501 reaches the first left deployment/retraction angle, or a predefined retraction angle different from the first left deployment/retraction angle (in this case, both a left deployment and a left retraction angle are defined), processor 2200 may retract one or more walls that had previously been deployed at the first left deployment/retraction angle. For example, a first left deployment angle may have been predefined as 5 degrees and a retraction angle may be defined as 3 degrees of a left rotation from the supine position, or even the supine position itself (i.e., zero degrees). Continuing the example from above, when cradle 1501 reaches the 5 degree rotational angle left of the supine position, being rotated towards the supine position, processor 2200 causes left head support wall 1504, left leg support wall 1512, middle leg support wall 1514, outer left arm support wall 1522 and right arm support wall 2004 to retract behind cradle 1501.

At block 2328, in one embodiment, when cradle 1501 reaches the supine position on its way to the third rotational angle, processor 2200 causes at least right torso support wall 1506 to deploy through cradle 1501. In another embodiment, at least right torso support wall 1506 is deployed as cradle 1501 reaches a first right deployment/retraction angle, such as between zero and about 10 degrees. When cradle 1501 has been rotated to, or past, the supine position or a left deployment/retraction angle, one or more other walls may also be deployed, such as one or more of left head support wall 1504, left leg support wall 1512, middle leg support wall 1514, outer left arm support wall 1522 and right arm support wall 2004.

At block 2330, processor 2200 stops rotating cradle 1501 once cradle 1501 has reached the third rotational angle of, for example, 40 degrees to the user's right, in accordance with the processor-executable instructions.

At block 2332, processor 2200 holds cradle 1501 at 40 degrees for a hold time associated with this angle, in this example, for 50 minutes. It should be understood that at some other time during this method, cradle 1501 could be rotated back to the 40 degree position and be held for a different amount of time other than 50 minutes.

At block 2334, after expiration of the 50 minute hold time, processor 2200 causes cradle 1501 to begin rotating towards the supine position, the last of the four rotational angles defined by the processor-executable instructions in this example. As mentioned previously, the processor-executable instructions could define fewer, or a greater number of rotational angles during a sleep session.

At block 2336, when cradle 1501 reaches the first right deployment/retraction angle, or a predefined retraction angle different from the first right deployment/retraction angle (in this case, both a deployment and a retraction angle are defined), processor 2200 may retract one or more walls that had previously been deployed at the first right deployment/retraction angle (or the supine position while cradle 1501 was being rotated toward the third rotational angle). For example, a first right deployment angle may have been predefined as 5 degrees and a retraction angle may be defined as 3 degrees of a right rotation from the left of the supine position, or even the supine position itself (i.e., zero degrees). Continuing the example from above, when cradle 1501 reaches 3 degrees from the supine position as cradle 1501 is being rotated towards the supine position, processor 2200 causes right torso support wall 1506 and right head support wall 1502 to retract behind cradle 1501.

At block 2338, when cradle 1501 reaches the supine position, processor 2200 stops further rotation of cradle 1501, and the sleep session is terminated.

Figure 24A:
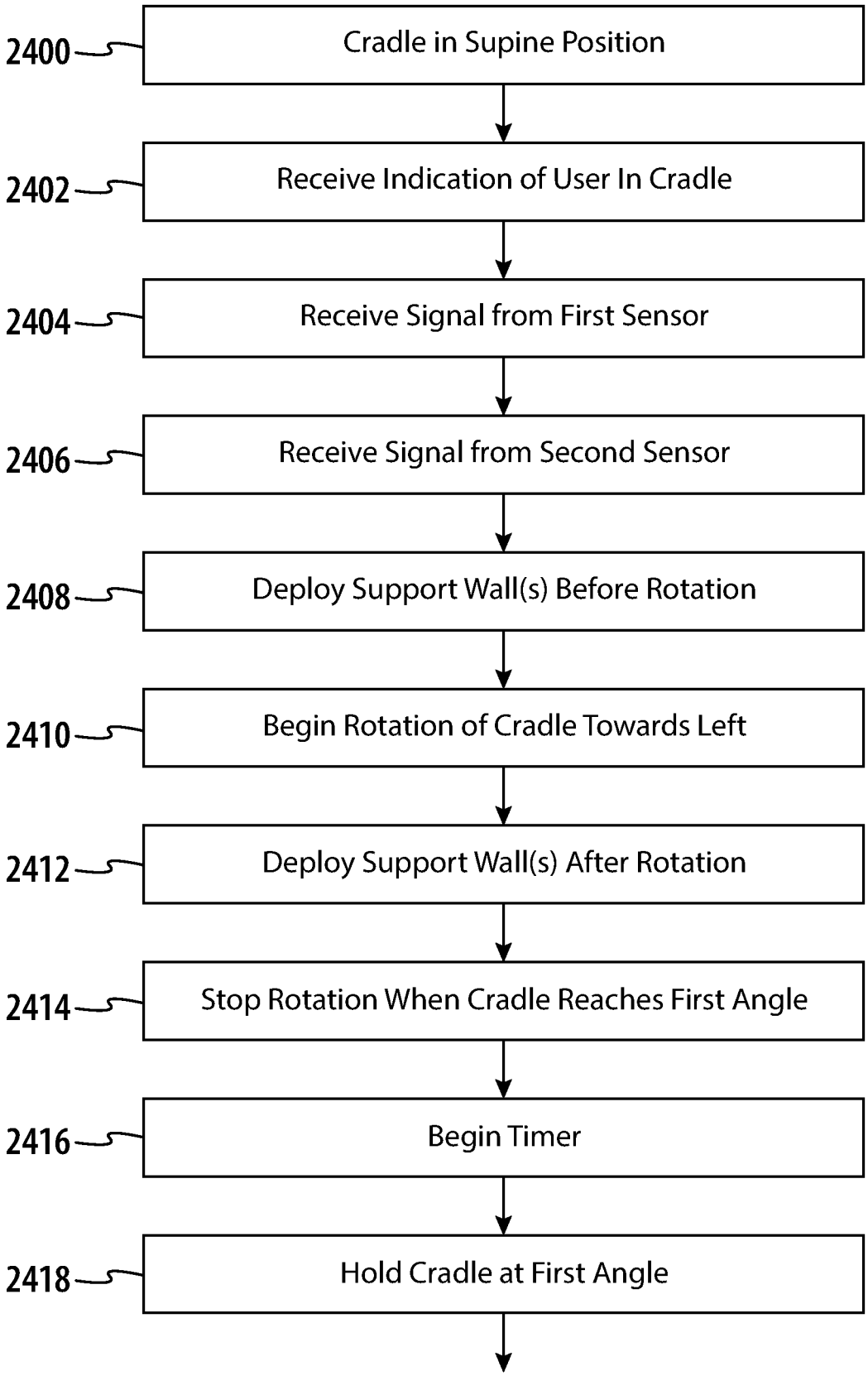
FIGS. 24A and 24B represent a flow diagram illustrating one embodiment of a method, performed by the control unit as shown in FIG. 22, for operation of the body support device as shown in FIGS. 1-7 and 15-21, using one or more sensors.
Figure 24B:
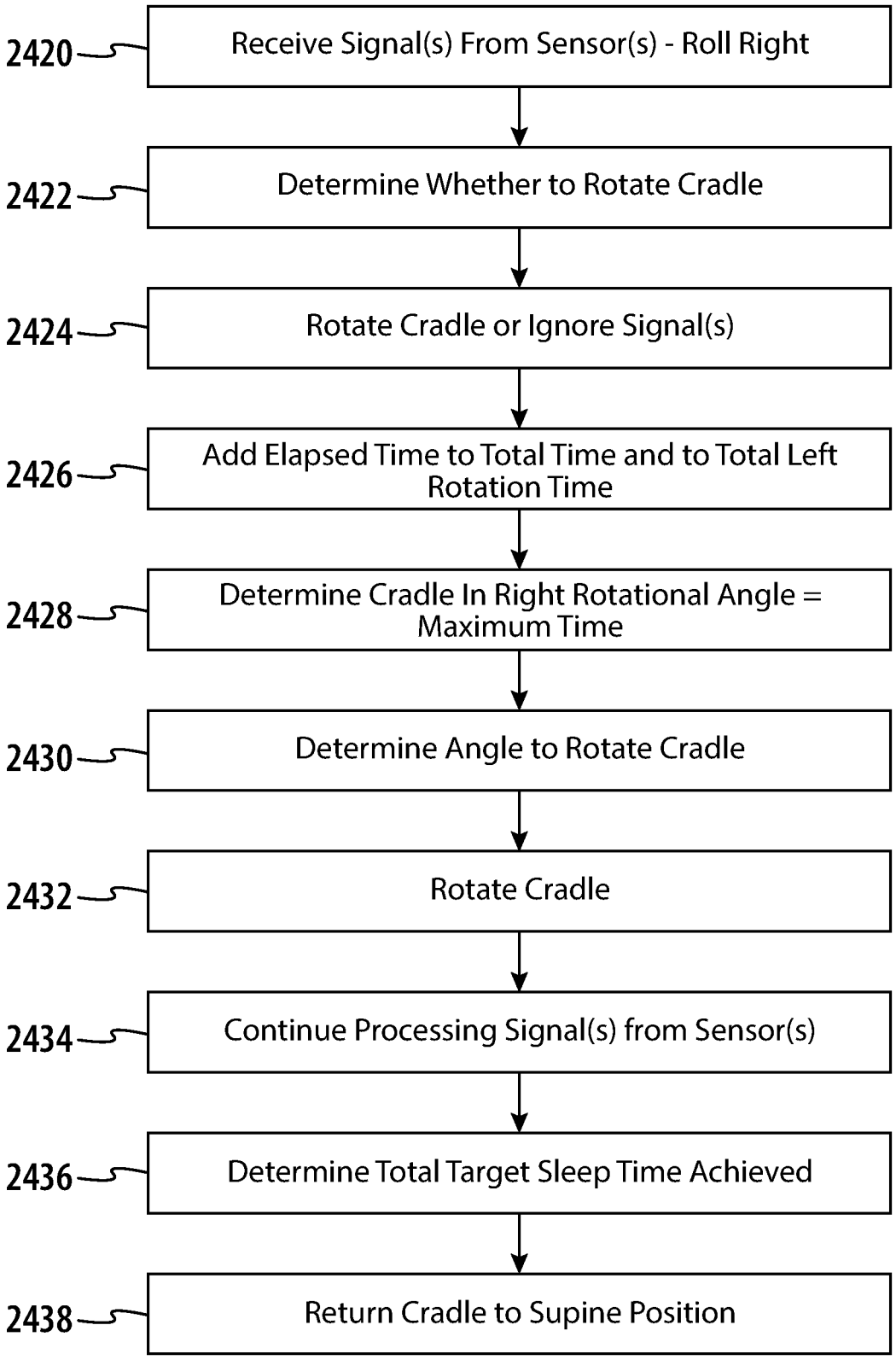

FIG. 24 is a flow diagram illustrating one embodiment of a method, performed by control unit 1524 (or by a personal electronic device such as a mobile phone), for operation of body support device 100, 500 or 1500 using one or more sensors 2218. In this example, reference will be made to torso sensors 1822 (right torso sensor) and 1824 (left torso sensor). For purposes of discussion of the method, reference shall be made to body support device 1500, although such discussion may equally apply to body support device 100 and/or 500. It should be understood that in some embodiments, not all of the method steps shown in FIG. 24 are performed, and that the order in which the steps are performed may be different in other embodiments. It should also be understood that the steps described in this method could be applicable to one or all of the embodiments of a body support device as described herein. It should be further understood that although the method is described in connection with two pressure sensors, the method is not limited to the number and type of sensors.

At block 2400, cradle 1501 is in the supine position, and a user lays down on cradle 1501. In another embodiment, the user may get into cradle 1501 using user interface 2206, or an app on the user's personal electronic device, such as a mobile phone, to raise cradle 1501 into a more upright position, as shown in FIG. 7. Once the user is in cradle 1501, the cradle 1501 pivots back to the position shown in FIG. 5.

At block 2402, processor 2200 may receive an indication from the user that the user is laying on cradle 1501. The indication may be provided manually via user interface 2206, via a user's personal communication device, such as mobile phone, wearable device, etc., or automatically via a sensor embedded into cradle 1501. The indication may be used by processor 2200 to begin a timer to track the time that the user is laying in cradle 1501.

At block 2404, processor 2200 may receive a signal from left torso sensor 1824, indicating that the user has shifted his body to influence left torso sensor 1824. For example, if left torso sensor 1824 is a pressure sensor, left torso sensor 1824 will send a signal to processor 2200 when it detects an increased pressure against it due to the user positioning his or her body against left torso sensor 1824, for example, when the user begins to roll to his or her left. In another embodiment, left torso sensor 1824 provides a continuous signal to processor 2200, such as presenting a resistance, voltage, current or some other measurable parameter that changes in response to pressure applied to left torso sensor 1824.

At block 2406, as the user begins to roll to the left, any pressure detected by right torso sensor 1822 may decrease, as the user's body is in less/no contact with right torso 1822 sensor. In this case, right torso sensor 1822 may report a decreased pressure to processor 2200. The combination of increased pressure from left torso sensor 1824 and a decreased pressure from right torso sensor 1822 may confirm to processor 2200 that the user wishes to lay on his or her left side, or wants cradle 1501 to rotate to the user's left side. User's movements resulting in weight shift and sensor activation could be either intentional (when a user is awake) or unconscious (when a user is asleep).

At block 2408, in one embodiment, in response to the signal(s) received from left torso sensor 1824 and, in some embodiments, right torso sensor 1822, indicating that the user wishes to lay on his or her left side, and before processor 2200 causes any rotation of cradle 1501, processor 2200 causes at least left torso support wall 1508 to deploy through cradle 1501. In other embodiments, one or more other walls may also be deployed, such as one or more of left head support wall 1504, left leg support wall 1512, middle leg support wall 1514, outer left arm support wall 1522 and right arm support wall 2004.

At block 2410 processor 2200 causes cradle 1501 to begin rotating to the user's left side by energizing electric motor 604 to rotate in a first direction.

At block 2412, in an embodiment where all of the walls of body support device 1500 are still retracted behind cradle 1501 after cradle 1501 begins rotating, processor 2200 causes at least left torso support wall 1508 to deploy through cradle 1501 when processor 2200 determines that cradle 1501 has been rotated to, or past, a left deployment/retraction angle. Processor 2200 determines that cradle has been rotated to, or past, the left deployment/retraction angle as described earlier herein. When cradle 1501 has been rotated to, or past, a left deployment/retraction angle, one or more other walls may also be deployed, such as one or more of left head support wall 1504, left leg support wall 1512, middle leg support wall 1514, outer left arm support wall 1522 and right arm support wall 2004.

At block 2414, processor 2200 causes cradle 1501 to stop rotating to the left when cradle 1501 has been rotated to a first programmed angle, in this example, 25 degrees to the left.

At block 2416, processor 2200 begins a timer to determine how long the user is held in this position. The time is used in connection with a number of rotational positions and respective hold times, sometimes referred to herein as "target values", as follows.

A variety of target values are pre-defined and stored in memory 2202 for use with the processor-executable instructions. The target values may comprise a number of associated rotational angles and desired times that the user should be held is each position. Other target values may comprise a desired total sleep time, i.e., a desired total time that the user should spend in cradle 1501 each day or night and a desired total time spent at any particular rotational angle and in some embodiments, an inclination angle.

For example, the following target values could be predefined and stored in memory 2200:

Total Target Sleep Time—The desired total time that the user should spend in cradle 1501 during each sleep/rest/therapy session.

Total Target Left Rotation Time—The total time during a session that the user should spend rotated to the left. In some embodiments, a number of such times are defined, each one defining a particular angle and a desired time to hold the user in a particular angle. For example, two Total Target Left Rotation Times could be defined: 25 degrees for 2 hours and 65 degrees for 3 hours.

Total Target Right Rotation Time—The total time during a session that the user should spend rotated to the right.

Total Target Supine Time—The total time during a session that the user should spend in supine position.

Minimum/Maximum Lap Times—The minimum and/or maximum time that a user should spend at a particular rotational angle.

As an example, the Total Target Sleep Time could be set to 8 hours, the Total Target Left Rotation Time could be set to 2 hours, the Total Target Right Rotation Time could be set to 4 hours, and the Total Target Supine Time could be set to 2 hours. A Minimum Lap Time could be defined as 10 minutes and a Maximum Lap Time could be defined as 30 minutes. The remaining discussion will assume that only three rotational angles will be defined (one left rotational angle of 25 degrees, one right rotational angle of 45 degrees, and the supine position, i.e., zero degrees), and each rotational angle will have the same Minimum and Maximum Lap Times. In other embodiments, a greater number of rotational angles may be defined, each having its own Minimum and Maximum Lap Times that may be different from each other. The parameters may be selected based on specific conditions of a user. E.g. for certain conditions of digestive tract sleeping on the left side may be maximized, whereas for cardio-vascular conditions the right side sleep may be maximized to achieve therapeutic effect.

Returning to the method, at block 2418, processor holds cradle 1501 at 25 degrees left rotation while the timer tracks the elapsed time spent at this angle.

At block 2420, the user may attempt to roll over on cradle 1501 to the right, in an effort to sleep on the user's right side. Sensor 1824 and/or sensor 1822 provide an indication(s) to processor 2200 of such user movement.

At block 2422, in response to receiving the indications(s) from the sensor(s), processor 2200 determines whether or not to rotate cradle 1501, or to ignore the signal(s) by determining whether one or more desired target values have been achieved before rotating cradle 1501 to the right. For example, if cradle 1501 has been held at the 25 degree angle for at least 10 minutes, processor 2200 may cause cradle 1501 to rotate either back to the supine position, or to a left-rotated angle of 65 degrees. If cradle 1501 has not been held at the 25 degree angle for at least 10 minutes, processor 2200 may ignore the signal(s) from the sensor(s) and keep cradle 1501 at the same left-rotational angle of 25 degrees. In one embodiment, processor 2200 notifies the user when processor 2200 ignores the signal(s), such as providing an audible or visual indication to the user via user interface 2206.

In another embodiment, processor 2200 performs two or more comparisons of the elapsed time spent in any rotational angle to two or more target values in order to determine whether to allow rotation of cradle 1501 or not, in order to achieve one or more of the target values. For example, after the user has been using body support device 1500 for 5 hours of an 8 hour Total Target Sleep Time, cradle 1501 may have spent 2 hours in the left rotational angle, 1 hour in the right rotational angle, and 2 hours in the supine position. For illustrative purposes, it will be assumed that cradle 1501 is in the left rotational angle and that cradle 1501 has been in this position for 29 minutes. If the Total Target Left Rotation Time is 3 hours, the Total Target Right Rotation Time is 2 hours, and the Total Target Supine Time is 3 hours, processor 2200 may check not only whether the Minimum Left Lap Time has been met, but also whether the Total Target Right Rotation Time has been met. In this case, when the user rolls to his or her right in a desire to lay on his or her right side, processor 2200 determines that the Minimum Left Lap Time has been met, but that the Total Target Right Rotation Time has also been met. As a result, processor 2200 ignores the signal(s) from the sensor(s) to rotate cradle 1501 to the right. In one embodiment, processor 2200 does rotate cradle 1501 to the right, even when the Total Target Right Rotation Time has been met, but rotates cradle 1501 only to the supine position, provided that the Total Target Supine Time has not been reached.

At block 2424, processor 2200 either rotates cradle 1501 to the right, or ignores the signal(s) from the sensor(s), based on the determination performed at block 2322. If cradle 1501 is rotated to the right, one or more walls are retracted and/or deployed, as described elsewhere herein.

At block 2426, if processor 2200 rotates cradle 1501 to the right, processor 2200 adds the elapsed time that the user was at the 25 degree rotational angle to a Total Actual Sleep Time register stored in memory 2202 and to a Total Actual Left Rotation Time register, also stored in memory 2202. As cradle 1501 is moved into the three rotational angles, in this example, processor 2200 updates these registers, as well as a Total Actual Right Rotation Time, to track the amount of time that the user spends in each of the three rotational angles during a sleep/rest/therapy session.

At block 2428, if no signal(s) is/are received from the sensor(s), processor 2200 determines that cradle 1501 has been in the left rotational angle for a Maximum Left Lap Time of, in this example, 30 minutes.

At block 2430, processor 2200 determines which of the two remaining rotational angles, either supine or left, to rotate cradle 501. Processor 2200 makes this determination, in one embodiment, based on the Total Actual Right Rotation Time and the Total Actual Supine Time stored in respective registers in memory 2202 vs Total Target times for these positions. In this embodiment, processor 2200 rotates cradle 1501 to the rotational angle that is most in need of meeting a respective Total Target Rotation Time. For example, if the Total Actual Right Rotation Time is 2 hours, the Total Actual Supine Time is 2 hours, the Total Target Right Rotation Time is 3 hours, and the Target Supine Time is 2½ hours, processor 2200 rotates cradle 1501 to the right rotational angle, because the time needed to achieve the Target Right Rotation Time is 1 hour, while the time needed to achieve the Target Supine Time is ½ an hour. Thus, more time is needed in the right rotational angle to achieve the Total Target Right Rotation Time than is needed to achieve the Total Target Supine Time.

In another embodiment, processor 2200 determines which of the two remaining rotational angles, either supine or left, to rotate cradle 501, based not only on the Total Actual Right Rotation Time and the Total Actual Supine Time, but based on a pre-determined Partial Target Time defined for each of the right, left and supine positions for the most recent 2 hours. This achieves a more balanced positioning and may be particularly desirable for treatment of bed sores or for managing burn victims. For example, a Left Partial Target Time could be defined as 40-50 minutes in the past 2 hours, and a Supine Partial Target Time could be defined as 15-25 minutes in the past 2 hours, and Right Partial Target Time 45-55 minutes in the past 2 hours, each of these times decreased by processor 2200 as cradle 1501 is positioned into the right and supine positions, respectively. Processor 2200 determines where to rotate cradle 1501 by comparing time accrued in each position in the past 2 hours.

At block 2432, processor 2200 rotates cradle 1501 into either the supine position or a right rotational angle.

At block 2434, processor 2200 continues to process signal(s) from the sensor(s), and to reposition cradle 1501 when any Maximum Lap Time has been exceeded.

At block 2436, processor 2200 determines that the Total Target Sleep Time has been achieved, indicating that the current sleep/rest/therapy session is complete.

At block 2438, in response to determining that the Total Target Sleep Time has been achieved, processor 2200 returns cradle 1501 to the supine position, retracting some or all of any deployed walls, so that the user may easily get up from body support device 1500.

Figure 25:
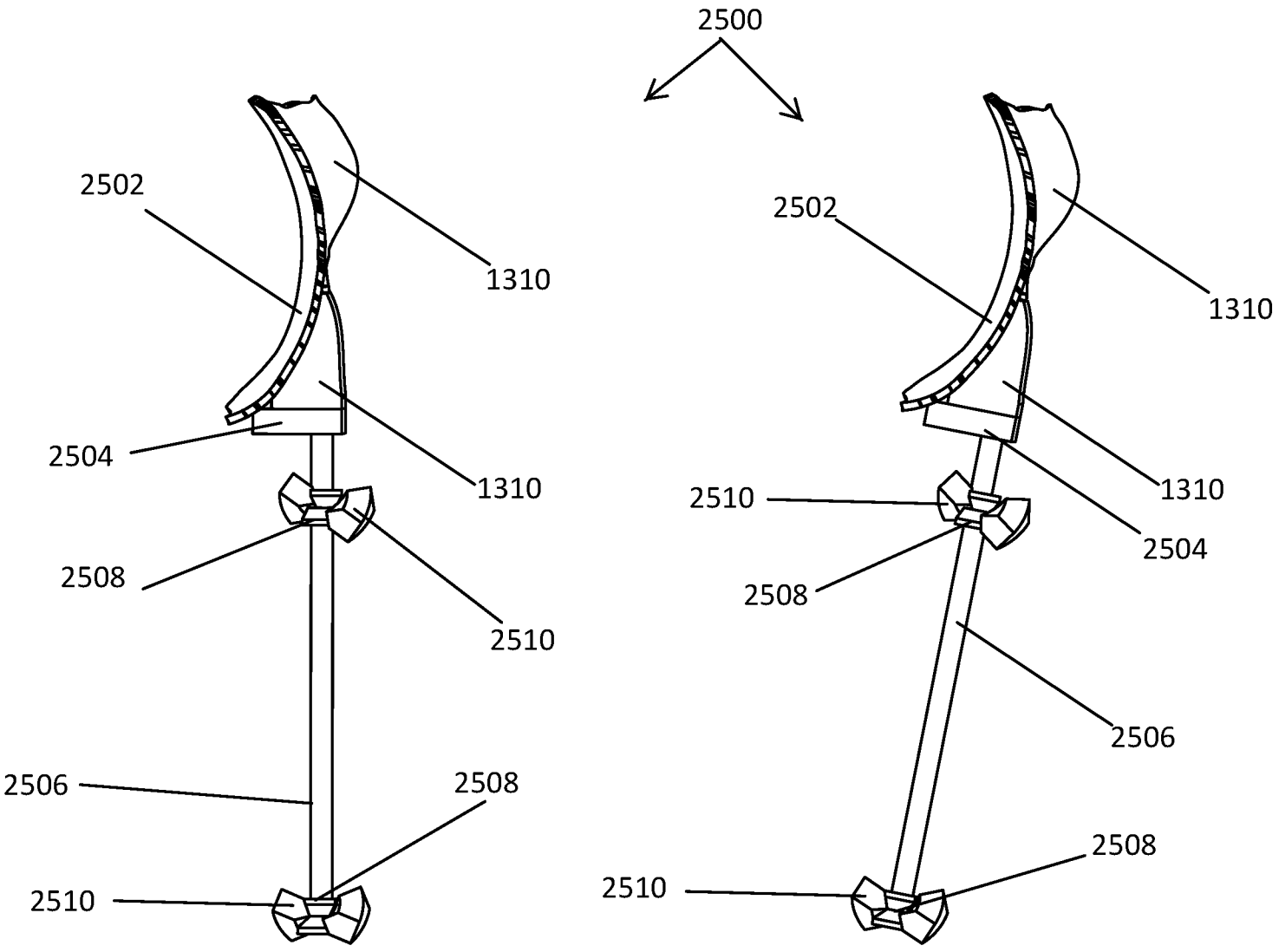
FIG. 25 is another embodiment of a left side wall assembly similar to the side wall assemblies shown in FIGS. 8-13.

FIG. 25 and the following FIGS. 26-30 illustrate another embodiment of a side wall assembly 2500 for a torso support having a side wall similar to side wall 802 shown in FIGS. 8-13. In this embodiment, left side wall 2502 is connected to end cap 2504 and support rods 2506 in the same manner as shown above using a resin based structure 1310. In this embodiment, the torso support wall 2502, when fully deployed, assumes the same position as shown in FIG. 8, 10 or 13F or as part 104 of FIGS. 1 and 3. However, the retraction of the side wall 2502 with end cap 2504 and support rods 2506 and rollers 2508 works differently. Rather than retracting the side wall through an opening 516 in the cradle and behind the cradle, side wall 2502 slides down under a user's waist and, when in a retracted position, remains next to a left hip portion of the cradle and a user's left palm. The details of a retraction mechanism are not shown for clarity but it should be understood that a mechanism employing a linear actuator or a rack and pinion shown in the examples above can be connected to end cap 2504 or supporting rods 2506 or other members of linkage to move side wall 2502. In FIG. 25, Left side wall 2502 is viewed from the hip/waist direction. The lower end of side wall 2502 follows the shape of a waist line is seen. The left image shows wall 2502 in a deployed state as it is positioned to be in contact with a user's torso. The right image shows the wall 2502 in a retracted state, slightly away from the user's body and the cradle. Guiderails 2510 are placed at an angle of approximately 10 degrees to provide the tilt and move the support wall 2502 slightly away from the cradle is it retracts below the user's waist.

Figure 26:
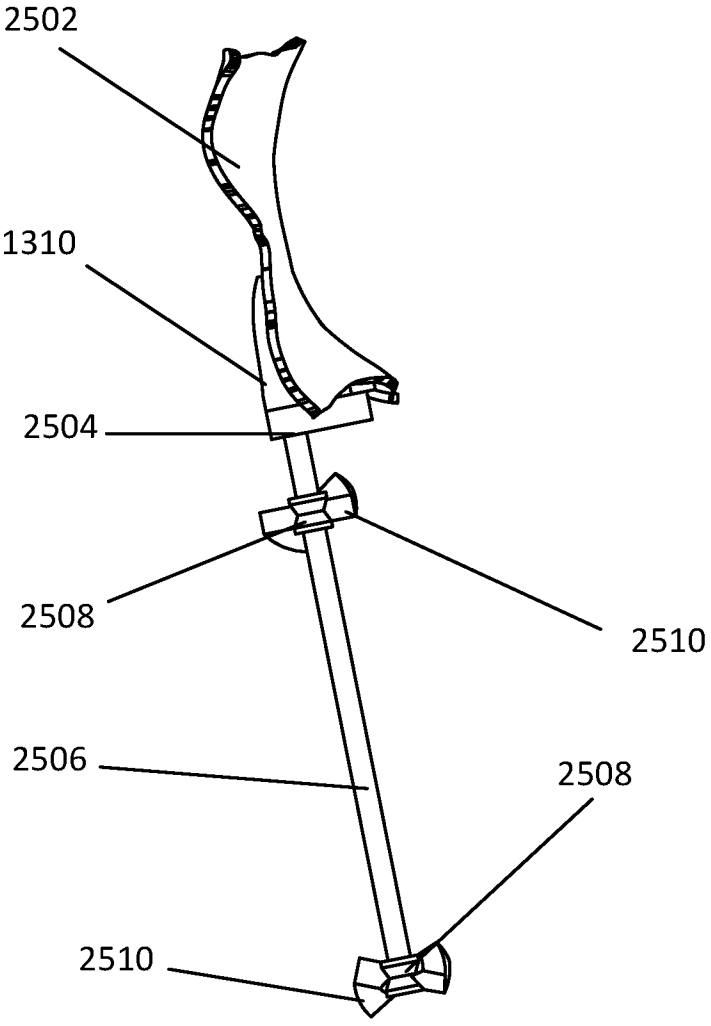
FIG. 26 shows the left side wall assembly of FIG. 25 at a different viewing angle.
Figure 26:
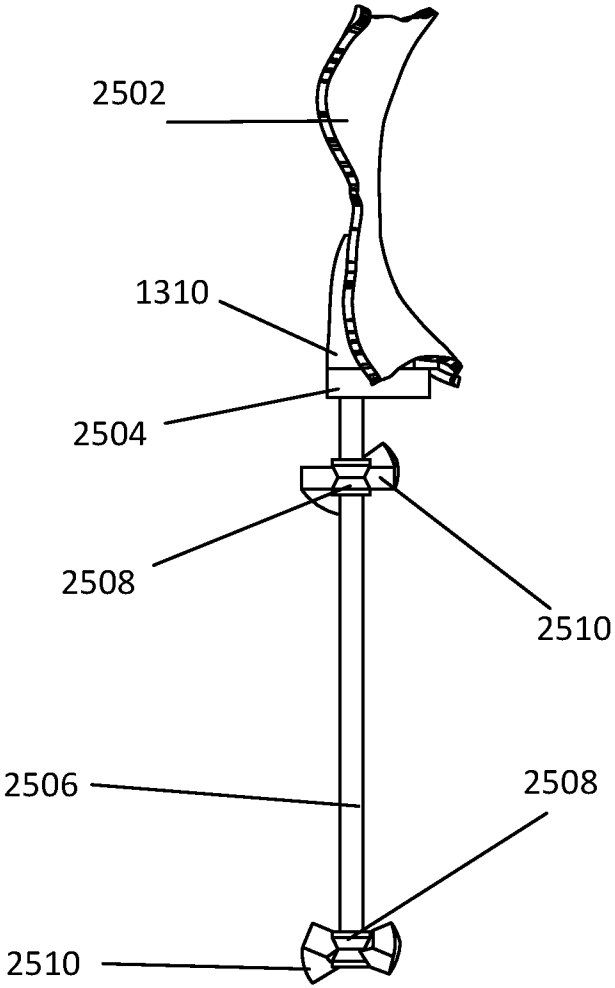

FIG. 26 shows the left side wall assembly 2500 of FIG. 25 at a different angle. Left side wall 2502 is viewed here from the head direction. The curved side of side wall 2502 follows the shape of an athletic figure with recesses for latissimus dorsi and pectoral muscles are seen. The left image shows wall 2502 in a deployed state in which it contacts a user's torso. The right image shows wall 2502 in a retracted state, slightly away from the user's body and the cradle. Guiderails 2510 are placed at an angle of approximately 10 degrees to provide tilt and move the support wall 2502 slightly away from the cradle is it retracts below the user's waist.

Figure 27:
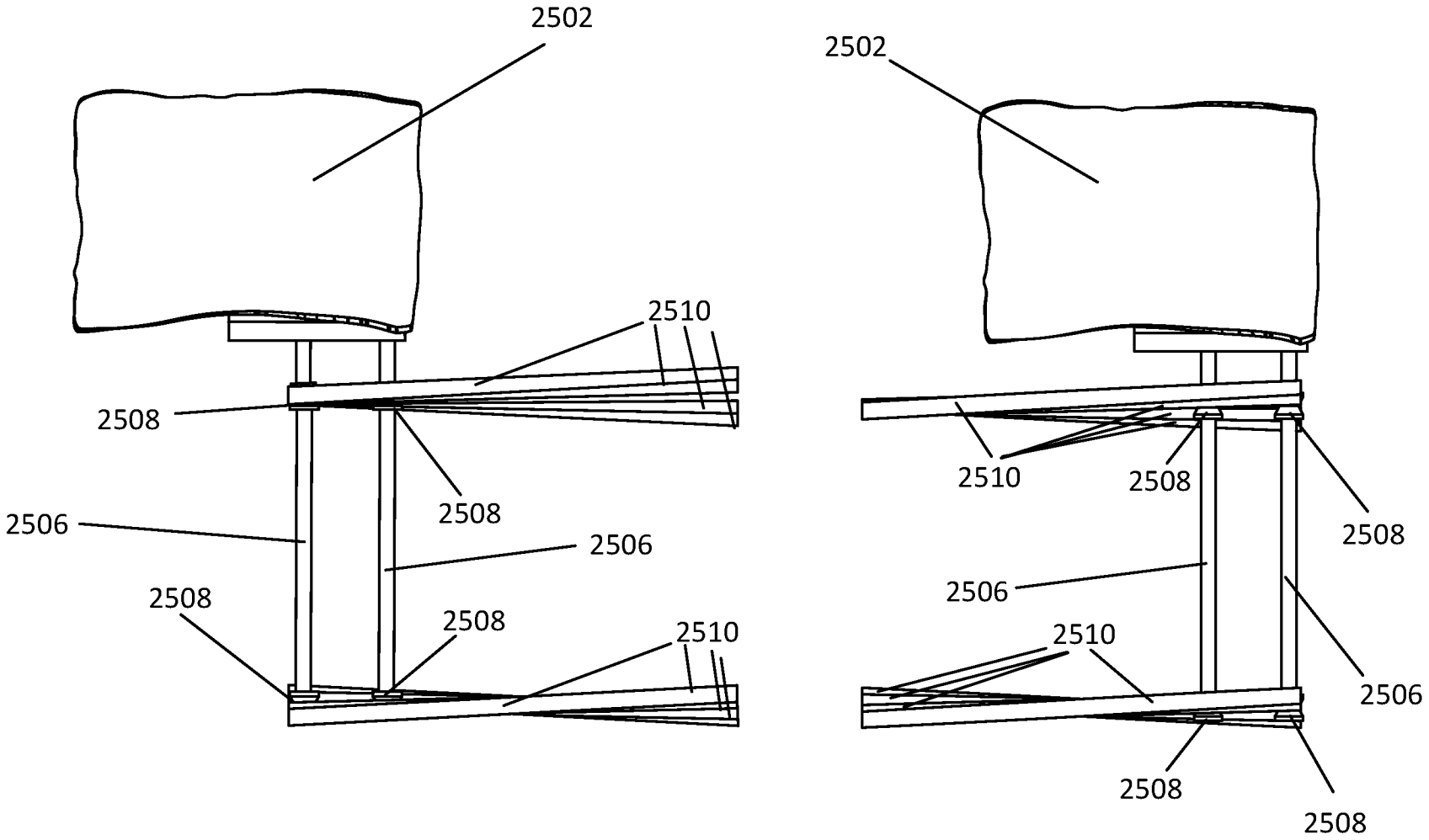
FIG. 27 shows the left side wall assembly of FIG. 25 at a yet another, different angle.

FIG. 27 shows the left side wall assembly 2500 of FIG. 25 at yet another angle. Left side wall 2502's surface contacts the user's torso is shown. The left image shows wall 2502 in a deployed state as it contacts the user's torso. The right image shows wall 2502 in a retracted state. Guiderails 2510 are placed under an angle of approximately 10 degrees to provide tilt and move support wall 2502 slightly away from the cradle is it retracts below the waist.

Figure 28:
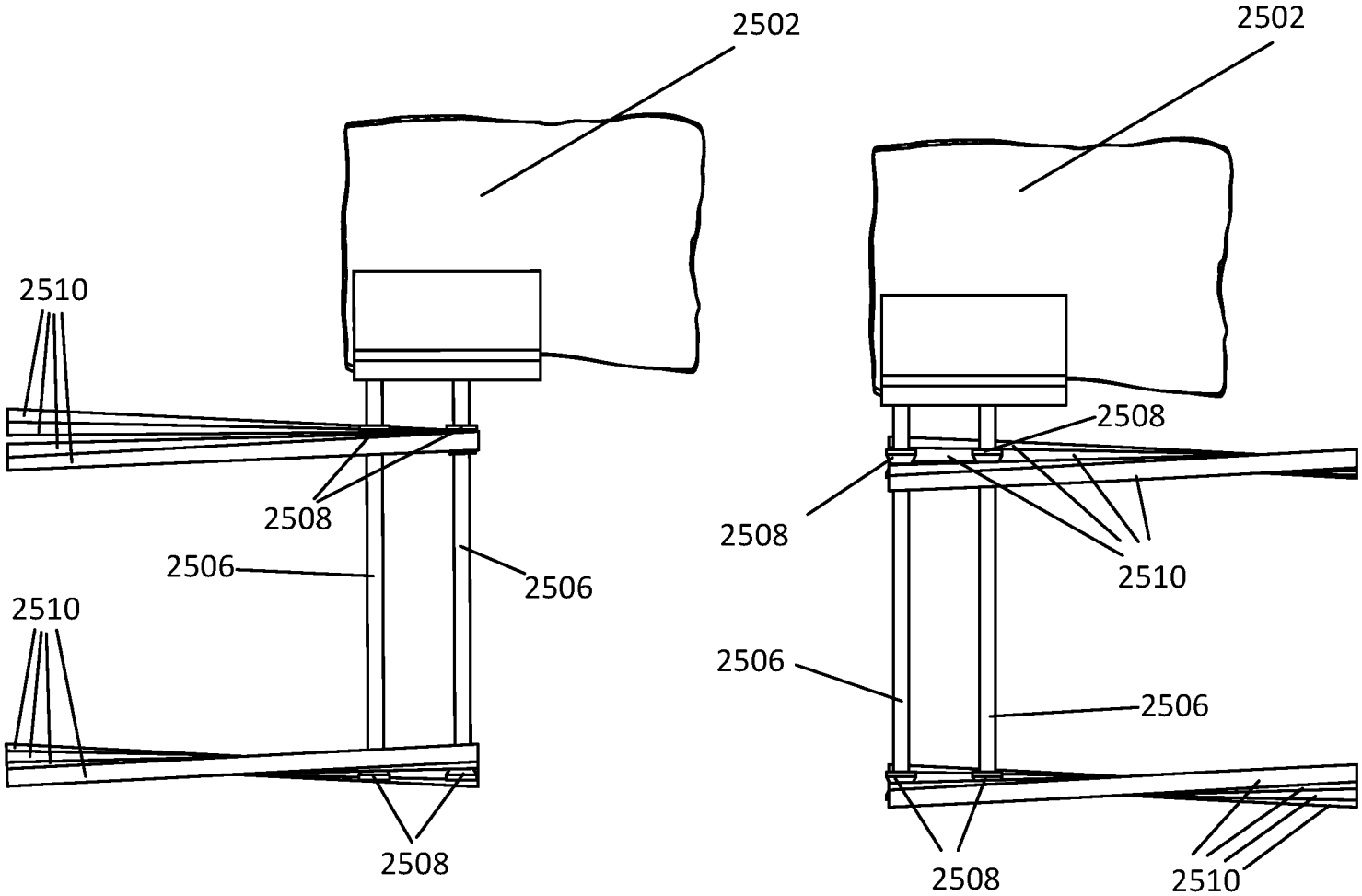
FIG. 28 shows the left side wall assembly of FIG. 25 at yet another viewing angle.

FIG. 28 shows the left side wall assembly 2500 of FIG. 25 at yet another viewing angle. Left side wall 2502 contacts user's an inner surface of a user's left arm is shown in this view. The left image shows wall 2502 in a deployed state as it contact's the user's torso. The right image shows wall 2502 in a retracted state. Guiderails 2510 are placed at an angle of approximately 10 degrees to provide tilt and move support wall 2502 slightly away from the cradle is it retracts below the user's waist.

Figure 29:
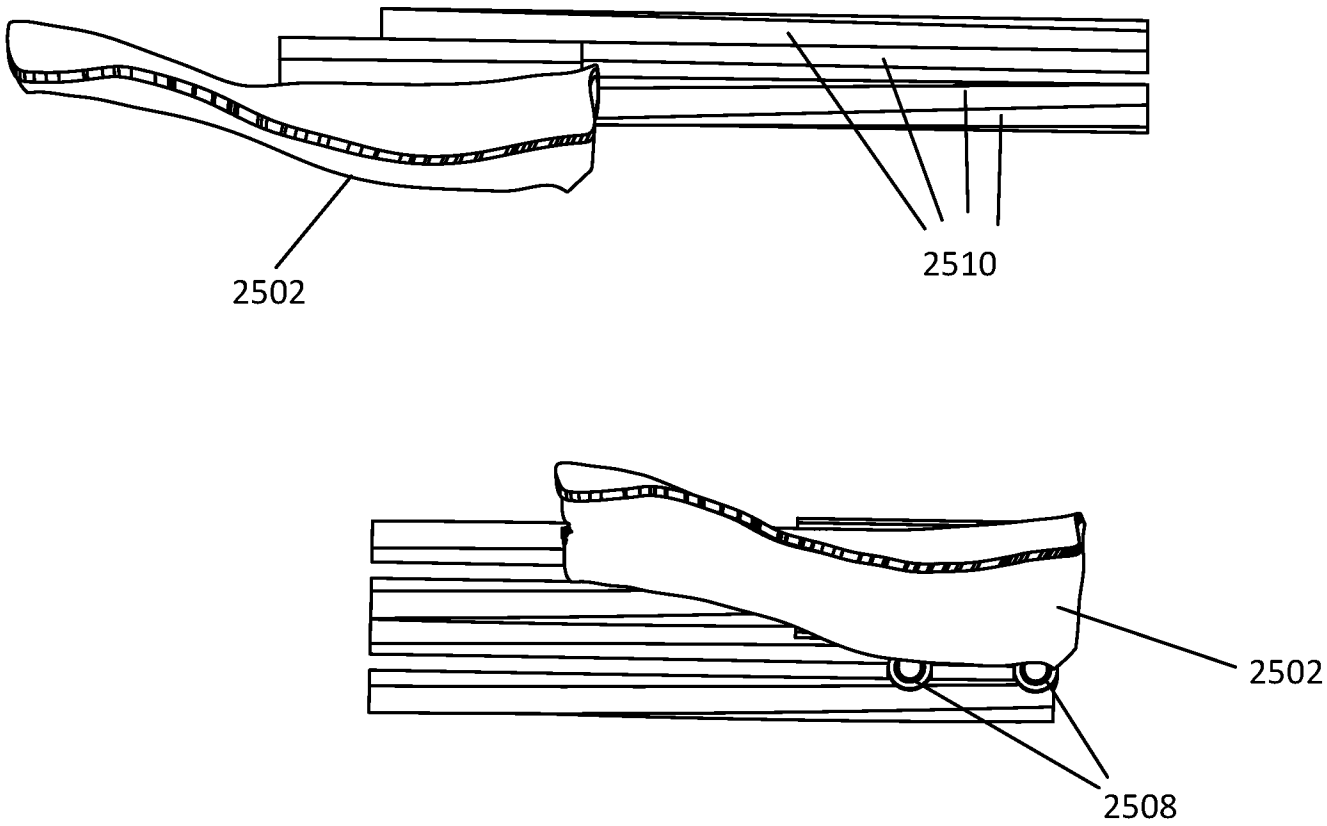
FIG. 29 shows the left side wall assembly of FIG. 25 in yet another viewing angle.

FIG. 29 shows the left side wall assembly 2500 of FIG. 25 in yet another viewing angle. Left side wall 2502, in this figure, is shown viewed from above a user's torso. The top image shows wall 2502 in a deployed state as it contacts the user's torso. The bottom image shows wall 2502 in a retracted state slightly away from the user's body and the cradle as it retracts below the user's waist.

Figure 30:
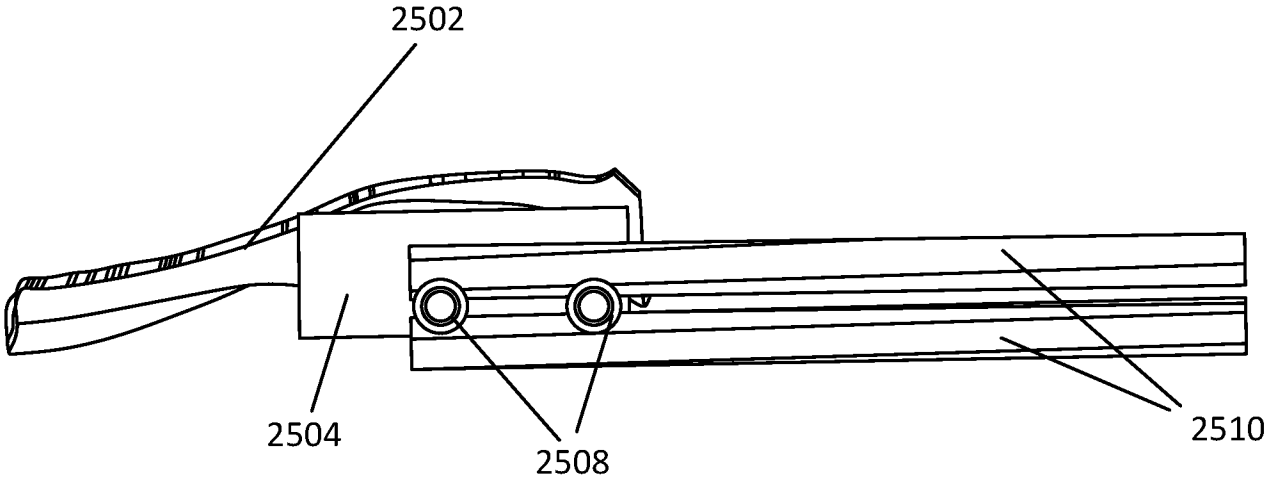
FIG. 30 shows the left side wall assembly of FIG. 25 in yet another viewing angle.
Figure 30:
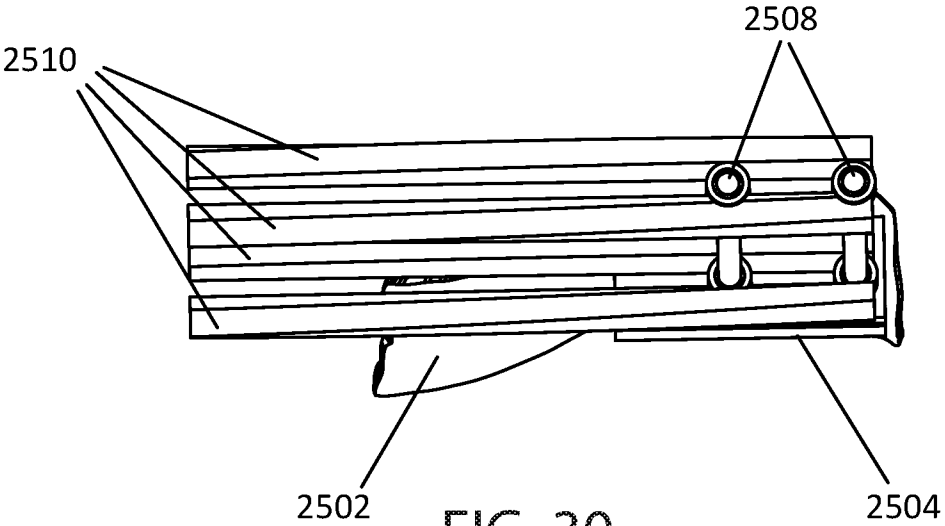

FIG. 30 shows the left side wall assembly 2500 of FIG. 25 in yet another viewing angle. Here, left side wall 2502 is viewed from under a user's torso. The top image shows wall 2502 in a deployed state as it contacts the user's torso. The bottom image shows wall 2502 in a retracted state slightly away from the user's body and the cradle as it retracts below the user's waist.

Figure 31:
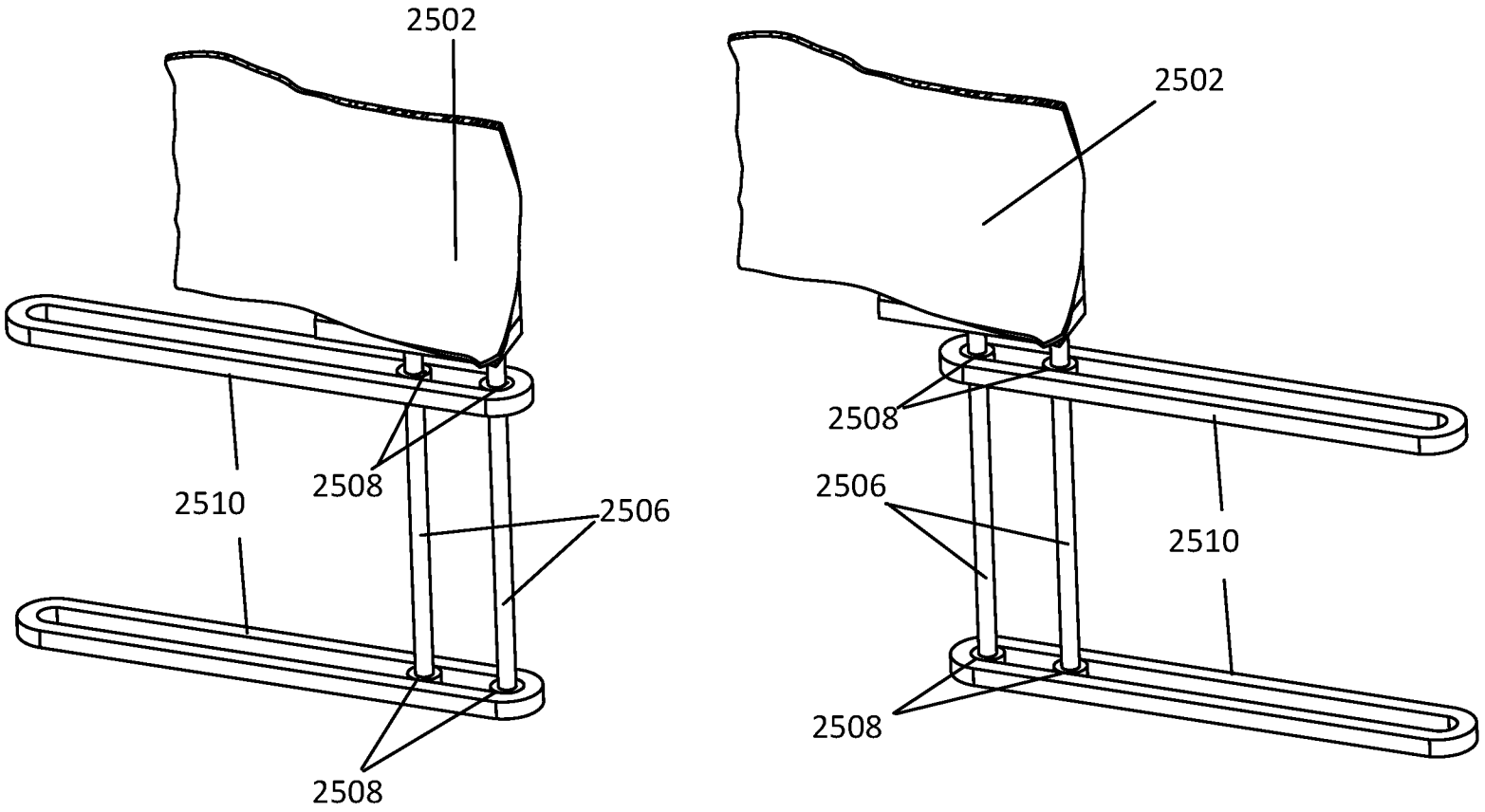
FIG. 31 is another embodiment of a left side wall assembly for torso support that retracts on the side and below a user's waist, comprising some of the same components as the previous embodiment, but arranged differently.

FIG. 31 is another embodiment of a left side wall assembly 2500 for torso support that retracts on the side and below a user's waist, comprising some of the same components as the previous embodiment, but arranged differently. The embodiment is similar to the one described in FIGS. 25-30 but has simplified guide rails 2510 not providing tilt and simplified rollers 2508. This type of guide groove may be better suited for bariatric patients. Left side wall 2502 contacts a user's torso when in a deployed position, as previously. The left image shows wall 2502 in a deployed state as it contacts the user's torso. The right image shows wall 2502 in a retracted state. It should be understood that the two ways to retract and deploy side walls shown in FIGS. 8-13 and 25-31 and corresponding mechanisms are just examples and other retraction paths and mechanical means can be devised following these examples and accommodating for different body types, cradles, and user preferences.

Although specific advantages have been enumerated above, various embodiments may include some, none, or all of the enumerated advantages.

Other technical advantages may become readily apparent to one of ordinary skill in the art after review of the following figures and description.

It should be understood at the outset that, although exemplary embodiments are illustrated in the figures and described below, the principles of the present disclosure may be implemented using any number of techniques, whether currently known or not. The present disclosure should in no way be limited to the exemplary implementations and techniques illustrated in the drawings and described below.

Unless otherwise specifically noted, articles depicted in the drawings are not necessarily drawn to scale.

Modifications, additions, or omissions may be made to the systems, apparatuses, and methods described herein without departing from the scope of the disclosure. For example, the components of the systems and apparatuses may be integrated or separated. Moreover, the operations of the systems and apparatuses disclosed herein may be performed by more, fewer, or other components and the methods described may include more, fewer, or other steps. Additionally, steps may be performed in any suitable order. As used in this document, "each" refers to each member of a set or each member of a subset of a set.

To aid the Patent Office and any readers of any patent issued on this application in interpreting the claims appended hereto, applicants wish to note that they do not intend any of the appended claims or claim elements to invoke 35 U.S.C. § 112(f) unless the words "means for" or "step for" are explicitly used in the particular claim.

I claim:

1. A body support device, for preventing and treating a disease or injury by optimization of sleep posture and assisted rollovers, comprising:

a cradle comprising a back rest, the back rest comprising left and right vertical openings spaced apart from each other by approximately a width of a human torso;

an electric motor for rotating the cradle around a longitudinal axis of the cradle and holding the cradle in a plurality of angles from a horizontal reference position;

a right torso-support assembly, located behind the back rest and aligned with the right vertical opening, the right torso-support assembly comprising:

a right torso support wall for supporting a right side of the human torso when the cradle is rotated to a first angle with respect to the horizontal reference position;

a second electric motor;

a carriage coupled to the second electric motor; and a right torso support connecting member slidably coupled through the carriage and to the right torso support wall;

wherein the right torso support wall extends through the right vertical opening by actuation of the second electric motor in response to the cradle being rotated to the first angle; and a left torso-support assembly, located behind the back rest and aligned with the left vertical opening, the left torso-support assembly comprising:

a left torso support wall for supporting a left side of the human torso when the body support device is rotated to a second angle with respect to the horizontal reference position;

a third electric motor;

a second carriage coupled to the third electric motor; and a left torso support connecting member slidably coupled through the carriage and to the left torso support wall;

wherein the left torso support wall extends through the left vertical opening by actuation of the third electric motor in response to the cradle being rotated to the second angle.

2. The body support device of claim 1:

wherein the right torso support wall is retracted behind the back rest through the right vertical opening by reverse actuation of the second electric motor in response to the body support device being rotated towards the horizontal reference position from the first angle and;

wherein the left torso support wall is retracted behind the back rest through the left vertical opening by reverse actuation of the third electric motor in response to the body support device being rotated towards the horizontal reference position from the second angle.

3. The body support device of claim 1, wherein:

the right torso support wall is formed from an actual contour of the right side of the human torso; and the left torso support wall is formed from an actual contour of the left side of the human torso.

4. The body support device of claim 1, further comprising:

a head rest comprising right and left vertical head slits spaced apart from each other by approximately a width of a human head;

a right head-support assembly, located behind the head rest and aligned with the right vertical head slit, the right head-support assembly comprising a right head support wall for supporting a right side of the human head when the body support device is rotated to the first angle, and a left head-support assembly, located behind the back rest and aligned with the left vertical head slit, the left head-support assembly comprising a left head support wall for supporting a left side of the human head when the body support device is rotated to the second angle.

5. The body support device of claim 4, wherein:

the right head-support assembly comprises:

a fourth electric motor; and a right head support connecting member coupled to the fourth electric motor and to the right head support wall;

wherein the right head support wall is extended through the right vertical head slit by actuation of the fourth electric motor in response to the body support device being rotated to the first angle;

and the left head-support assembly comprises:

a fifth electric motor; and a left head support connecting member coupled to the fifth electric motor and to the left head support wall;

wherein the left head support wall is extended through the left vertical head slit by actuation of the fifth electric motor in response to the body support device being rotated to the second angle.

6. The body support device of claim 1, wherein the right torso-support assembly further comprises:

a pair of parallel plates spaced apart from each other, the parallel plates comprising a plurality of opposing pairs of guide grooves; and the carriage and the second electric motor is slidably coupled within a first pair of opposing guide grooves;

wherein the carriage and the second electric motor moves substantially perpendicularly within the first pair of opposing guide grooves to the movement of the right torso support wall as the right torso support wall is extended through the right vertical opening, creating a sliding pivot point for the right torso support wall to extend or retract around a human torso of a user laying in the cradle.

7. The body support device of claim 6, wherein the right torso-support assembly further comprises:

a top end cap coupled to a top end of the right torso support connecting member, the top end cap slidably coupled within a second pair of opposing guide grooves;

a bottom end cap coupled to a bottom end of the right torso support connecting member the top end cap slidably coupled within a third pair of opposing guide grooves;

wherein the right torso support wall extends along an arc around the right side of the human torso, while changing its angle relative to the human torso, as the top end, the bottom end and the second carriage are guided within their respective guide grooves as the second electric motor extends the right torso support wall through the right vertical opening.

8. The body support device of claim 1, further comprising:

right and left vertical leg slits spaced apart from each other by approximately a width of two human legs;

a right leg-support assembly, located behind a leg rest and aligned with the right vertical leg slit, the right leg-support assembly comprising a right leg support wall for supporting a right leg of a user of the body support device when the body support device is rotated to the first angle, and a left leg-support assembly, located behind the leg rest and aligned with the left vertical leg slit, the left leg-support assembly comprising a left leg support wall for supporting a left leg of the user when the body support device is rotated to the second angle.

9. The body support device of claim 8, wherein:

the right leg-support assembly comprises:

a fourth electric motor; and a right leg support connecting member coupled to the second electric motor and to the right leg support wall;

wherein the right leg support wall is extended through the right vertical leg slit by actuation of the fourth electronic motor in response to the body support device being rotated to the first angle;

and the left leg-support assembly comprises:

a fifth electric motor; and a left leg support connecting member coupled to the third electric motor and to the left leg support wall;

wherein the left leg support wall is extended through the left vertical leg slit by actuation of the fifth electric motor in response to the body support device being rotated to the second angle.

10. The body support device of claim 1, further comprising:

a memory for storing processor-executable instructions;

first power amplification circuitry for driving the electric motor;

second power amplification circuitry for driving the second electric motor;

a sensor for generating a signal indicative of an intent of a user lying on the body support device to roll over to the right; and a processor, coupled to the memory, the first power amplifier, the second power amplifier and the sensor, for executing the processor-executable instructions that causes the body support device to:

receive, by the processor, the signal from the sensor when the body support device is in the horizontal reference position;

in response to receiving the signal, cause, by the processor, the first power amplification circuitry to cause the electric motor to rotate the cradle to the user's right; and in response to receiving the signal, cause, by the processor, the second power amplification circuitry to cause the second electric motor to extend the right torso support wall.

11. The body support device of claim 1, further comprising:

a memory for storing processor-executable instructions;

first power amplification circuitry for driving the electric motor;

second power amplification circuitry for driving the second electric motor;

a sensor for generating a signal indicative of an intent of a user lying on the body support device to roll over to the right; and a processor, coupled to the memory, the first power amplifier, the second power amplifier and the sensor, for executing the processor-executable instructions that causes the body support device to:

receive, by the processor, the signal from the sensor when the body support device is in the horizontal reference position;

in response to receiving the signal, determine, by the processor, whether the body support device has been in the horizontal reference position for less than a predetermined time period;

when the body support device has been in the horizontal reference position for less than a predetermined time period, ignore the signal; and when the body support device has been in the horizontal reference position for more than the predetermined time period:

cause, by the processor, the first power amplification circuitry to cause the electric motor to rotate the body support device to the user's right; and also in response to receiving the signal, cause, by the processor, the second power amplification circuitry to cause the second electric motor to extend the right torso support wall.

12. The body support device of claim 1, further comprising:

a memory for storing processor-executable instructions;

first power amplification circuitry for driving the electric motor;

second power amplification circuitry for driving the second electric motor; and a processor, coupled to the memory, the first power amplification circuitry, the second power amplification circuitry, for executing the processor-executable instructions that causes the body support device to:

cause, by the processor, the first power amplification circuitry to cause the electric motor to rotate in a first direction;

cause, by the processor, the second power amplification circuitry to cause the second electric motor to extend the right torso support wall through the right vertical opening when the processor determines that the cradle has been rotated a first angle from the horizontal reference position; and stop, by the processor via the first power amplification circuitry, rotation of the electric motor in the first direction when the processor determines that the cradle has achieved the first angle.

13. The body support device of claim 12, further comprising:

third power amplification circuitry for driving the third electric motor;

wherein the processor-executable instructions comprise further instructions that causes the body support device to:

maintain, by the processor via the first power amplification circuitry, the first angle for a first predetermined time period;

cause, by the processor, the first power amplification circuitry to cause the electric motor to rotate in a second direction;

cause, by the processor, the second power amplification circuitry to cause the second electric motor to retract the right torso support wall through the right vertical opening when the processor determines that the cradle has been rotated back to within 15 degrees of a horizontal reference position;

cause, by the processor, the third power amplification circuitry to cause the third electric motor to extend the left torso support wall through the left vertical opening when the processor determines that the cradle has been rotated a first angle from the horizontal reference position; and stop, by the processor via the first power amplification circuitry, rotation of the electric motor in the second direction when the processor determines that the cradle has achieved the second angle.

14. The body support device of claim 1, further comprising:

a left arm support assembly, located behind the back rest and aligned with the left vertical opening, the left arm support assembly comprising a left arm support wall for supporting a left arm of a user of the body support device when the cradle is rotated to the user's right; and a right arm support assembly, located behind the back rest and aligned with the right vertical opening, the right arm support assembly comprising a right arm support wall for supporting a right arm of the user when the body support device is rotated to the user's left.

15. The body support device of claim 1, further comprising:

an actuator for positioning the cradle anywhere between a supine position to an upright position to angle the cradle to raise a user's head above the user's feet or vice versa while cradle is in supine or any rotated position.

16. A method for preventing and treating a disease or injury by optimization of sleep posture and assisted rollovers, comprising:

receiving, by a processor from a sensor that monitors a user laying in a cradle of a body support device, a signal indicating that the user wishes to roll the cradle to the user's right;

in response to receiving the signal, causing, by the processor, power amplification circuitry to cause an electric motor to rotate the cradle to the user's right; and in response to receiving the signal, causing, by the processor, a second power amplification circuitry to cause a second electric motor to extend a right torso support wall to support the user when the cradle is rotated to the user's right.

* * * * *